US009061512B2

(12) United States Patent
Nozawa et al.

(10) Patent No.: US 9,061,512 B2
(45) Date of Patent: Jun. 23, 2015

(54) COVER AND LIQUID CONTAINER

(71) Applicant: SEIKO EPSON CORPORATION, Tokyo (JP)

(72) Inventors: Izumi Nozawa, Matsumoto (JP); Atsushi Kobayashi, Matsumoto (JP); Tadahiro Mizutani, Shiojiri (JP); Hiroyuki Nakamura, Shiojiri (JP); Ryota Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/900,474

(22) Filed: May 22, 2013

(65) Prior Publication Data

US 2013/0314479 A1 Nov. 28, 2013

(30) Foreign Application Priority Data

| | | |
|---|---|---|
| May 23, 2012 | (JP) | 2012-117059 |
| Jul. 6, 2012 | (JP) | 2012-152295 |
| Jul. 23, 2012 | (JP) | 2012-162701 |
| Aug. 8, 2012 | (JP) | 2012-176179 |
| Aug. 30, 2012 | (JP) | 2012-190566 |
| Aug. 31, 2012 | (JP) | 2012-191629 |

(51) Int. Cl.
*B41J 2/175* (2006.01)
*B41J 2/14* (2006.01)

(52) U.S. Cl.
CPC ..... *B41J 2/17566* (2013.01); *B41J 2/17503* (2013.01); *B41J 2/17553* (2013.01)

(58) Field of Classification Search
USPC ..... 347/7, 19, 49, 85, 86
See application file for complete search history.

(56) References Cited

U.S. PATENT DOCUMENTS

| | | | |
|---|---|---|---|
| 5,825,388 | A | 10/1998 | Sasaki |
| 5,980,032 | A | 11/1999 | Pawlowski, Jr. et al. |
| 6,086,193 | A | 7/2000 | Shimada et al. |
| 6,145,974 | A | 11/2000 | Shinada et al. |
| 6,155,678 | A | 12/2000 | Komplin et al. |
| 6,196,671 | B1 | 3/2001 | Breemes, Sr. et al. |
| 6,203,148 | B1 | 3/2001 | Kishida |
| 6,250,750 | B1 | 6/2001 | Miyazawa et al. |
| 6,254,226 | B1 | 7/2001 | Lengyel et al. |
| 6,290,348 | B1 | 9/2001 | Becker et al. |
| 6,585,007 | B2 | 7/2003 | Kubokawa |
| 6,623,104 | B1 | 9/2003 | Kotaki et al. |

(Continued)

FOREIGN PATENT DOCUMENTS

| | | | |
|---|---|---|---|
| EP | 0655336 | A1 | 5/1995 |
| EP | 0712727 | A2 | 5/1996 |

(Continued)

OTHER PUBLICATIONS

Search Report issued on Jul. 15, 2014 in European Patent Application No. 13168787.3.

*Primary Examiner* — Anh T. N. Vo
(74) *Attorney, Agent, or Firm* — Stroock & Stroock & Lavan LLP

(57) ABSTRACT

A cover for a liquid container which exposes at least a portion of a detecting member, having a liquid supply portion to a liquid ejecting apparatus through communicating with the liquid containing unit, and a first surface provided with a first container side engagement portion arranged between the liquid supply portion and the detecting member. The cover includes a first cover side engagement portion engaging with the first container side engagement portion.

24 Claims, 29 Drawing Sheets

(56) References Cited

U.S. PATENT DOCUMENTS

| | | | | |
|---|---|---|---|---|
| 6,776,479 | B2 | 8/2004 | Ardito et al. | |
| 6,824,258 | B2 | 11/2004 | Yamamoto et al. | |
| 6,848,776 | B2 | 2/2005 | Nishioka et al. | |
| 6,976,753 | B2 | 12/2005 | Kuwabara et al. | |
| 7,237,881 | B2 | 7/2007 | Hayasaki et al. | |
| 7,293,866 | B2 | 11/2007 | Miyazawa et al. | |
| 7,325,909 | B2 | 2/2008 | Yuen | |
| 7,393,088 | B2 | 7/2008 | Sasaki | |
| 7,445,323 | B2 | 11/2008 | Anderson, Jr. et al. | |
| 7,470,008 | B2 | 12/2008 | Yan | |
| 7,735,983 | B2 | 6/2010 | Pearson et al. | |
| 7,918,547 | B2 | 4/2011 | Hatasa et al. | |
| 7,938,523 | B2 | 5/2011 | Aldrich | |
| 8,113,640 | B2 * | 2/2012 | Shimizu | 347/86 |
| 8,142,000 | B2 | 3/2012 | Ishizawa et al. | |
| 8,177,341 | B2 * | 5/2012 | Shinada et al. | 347/86 |
| 8,177,342 | B2 | 5/2012 | Wanibe et al. | |
| 8,366,250 | B2 | 2/2013 | Wanibe et al. | |
| 8,366,251 | B2 | 2/2013 | Wanibe et al. | |
| 8,684,505 | B2 | 4/2014 | Campbell-Brown et al. | |
| 2002/0104578 | A1 | 8/2002 | Kubokawa | |
| 2005/0041076 | A1 | 2/2005 | Katayama | |
| 2005/0179750 | A1 | 8/2005 | Hayasaki et al. | |
| 2005/0185034 | A1 | 8/2005 | Anma et al. | |
| 2005/0219303 | A1 | 10/2005 | Matsumoto et al. | |
| 2005/0275699 | A1 | 12/2005 | Sasaki | |
| 2007/0024683 | A1 | 2/2007 | Yan | |
| 2007/0139492 | A1 | 6/2007 | Anderson, Jr. et al. | |
| 2007/0195141 | A1 | 8/2007 | Anma et al. | |
| 2007/0195144 | A1 | 8/2007 | McNestry | |
| 2008/0204529 | A1 | 8/2008 | Matsumoto et al. | |
| 2008/0239037 | A1 | 10/2008 | Inoue et al. | |
| 2009/0128609 | A1 | 5/2009 | Matsumoto et al. | |
| 2009/0322832 | A1 | 12/2009 | Wanibe et al. | |
| 2009/0322838 | A1 | 12/2009 | Wanibe et al. | |
| 2009/0322839 | A1 | 12/2009 | Ishizawa et al. | |
| 2010/0073438 | A1 | 3/2010 | Wanibe et al. | |
| 2010/0208015 | A1 | 8/2010 | Matsumoto et al. | |
| 2010/0302291 | A1 | 12/2010 | Matsumoto et al. | |
| 2010/0309265 | A1 | 12/2010 | Matsumoto et al. | |
| 2010/0309266 | A1 | 12/2010 | Matsumoto et al. | |
| 2011/0037815 | A1 | 2/2011 | Anma et al. | |
| 2011/0169899 | A1 | 7/2011 | Nozawa et al. | |
| 2012/0127247 | A1 | 5/2012 | Anma et al. | |
| 2012/0133713 | A1 | 5/2012 | Camp | |
| 2013/0208044 | A1 | 8/2013 | Matsumoto et al. | |

FOREIGN PATENT DOCUMENTS

| | | | |
|---|---|---|---|
| EP | 0739740 | A1 | 10/1996 |
| EP | 1053876 | A2 | 11/2000 |
| EP | 1053881 | A1 | 11/2000 |
| EP | 1095777 | A2 | 5/2001 |
| EP | 1170135 | A1 | 1/2002 |
| EP | 1892104 | A1 | 2/2008 |
| JP | 06-106729 | A | 4/1994 |
| JP | 08-112915 | A | 5/1996 |
| JP | 10-095129 | A | 4/1998 |
| JP | 10-250091 | A | 9/1998 |
| JP | 2000-203053 | A | 7/2000 |
| JP | 2001-063085 | A | 3/2001 |
| JP | 2001-130022 | A | 5/2001 |
| JP | 2002-036590 | A | 2/2002 |
| JP | 2002-120376 | A | 4/2002 |
| JP | 2002-225306 | A | 5/2002 |
| JP | 2005-170027 | A | 6/2005 |
| JP | 2005-349786 | A | 12/2005 |
| JP | 2007-112150 | A | 5/2007 |
| JP | 2008-246896 | A | 10/2008 |
| JP | 2009-061785 | A | 3/2009 |
| JP | 2009-241608 | A | 10/2009 |
| JP | 2010-005957 | A | 1/2010 |
| JP | 2011-140189 | A | 7/2011 |
| JP | 2011-207066 | A | 10/2011 |
| JP | 2012-035489 | A | 2/2012 |
| JP | 2012-126100 | A | 7/2012 |
| JP | 2012-136039 | A | 7/2012 |
| WO | 98/55325 | A1 | 12/1998 |

* cited by examiner

COVER AND LIQUID CONTAINER

Priority is claimed under 35 U.S.C. §119 to Japanese Application No. 2012-117059 filed on May 23, 2012, No. 2012-162701 filed on Jul. 23, 2012, No. 2012-152295 filed on Jul. 6, 2012, No. 2012-176179 filed on Aug. 8, 2012, No. 2012-191629 filed on Aug. 31, 2012, No. 2012-190566 filed on Aug. 30, 2012 which are hereby incorporated by reference in its entirety.

BACKGROUND

1. Technical Field

The present invention relates to a technology covering a liquid container.

2. Related Art

In the related art, a technology has been known which utilizes an ink cartridge (simply referred to as a "cartridge") containing an ink, as the technology supplying the ink, one example of a liquid, to a printer, one example of a liquid ejecting apparatus. The cartridge includes a liquid containing unit for containing the ink and a liquid supply portionliquid supply portion for supplying the ink in the liquid containing unit to the printer. In the liquid supply portionliquid supply portion, one end communicates with the liquid containing unit and the other end forms a liquid supply port which is open (for example, refer to U.S. Pat. Nos. 7,735,983 and 7,938,523).

The cartridge disclosed in U.S. Pat. Nos. 7,735,983 and 7,938,523, in some cases, for example, is likely to receive shocks during transportation, which causes the ink inside the liquid containing unit to leak out from the cartridge before use. If the ink leaks out from the cartridge, there are a lot of disadvantages. For example, there is a possibility that an amount of the ink which users can use may decrease. In addition, there is a possibility that the ink may smear on the users, the printer, or a printing medium. Such a disadvantage, without being limited to the cartridge for the printer, is a common issue to the liquid container used in the liquid ejecting apparatus.

SUMMARY

An advantage of some aspects of the invention can be achieved in the following forms.

(1) According to an aspect of the invention, there is provided a cover used in a liquid container which exposes at least a portion of a detecting member used for optically detecting an amount of a liquid inside a liquid containing unit or whether there exists the liquid inside the liquid containing unit, having a liquid supply portionliquid supply portion supplying the liquid to a liquid ejecting apparatus through communicating with the liquid containing unit, and a first surface provided with a first container side engagement portionengagement portion arranged between the liquid supply portionliquid supply portion and the detecting member, and being mounted on the liquid ejecting apparatus. The cover includes a first cover side engagement portionengagement portion engaging with the first container side engagement portionengagement portion in a state of the cover being mounted on the liquid container; and a cover portioncover portion covering the liquid supply portionliquid supply portion in a state of the cover being mounted on the liquid container. In this case, the cover portioncover portion can cover the liquid supply portionliquid supply portion, which can inhibit the liquid from leaking out from the liquid supply portionliquid supply portion. In addition, the first container side engagement portionengagement portion engaging with the first cover side engagement portionengagement portion on the first surface of the liquid container is arranged between the liquid supply portionliquid supply portion and the detecting member. Therefore, even though the liquid leaks out from a certain portion of the cover due to some reasons, an engagement portion between the first cover side engagement portionengagement portion and the first container side engagement portionengagement portion blocks the liquid from flowing out, which can inhibit the liquid from reaching the detecting member. Consequently, it is possible to inhibit the detecting member from getting filthy due to the liquid, and thereby it is possible to inhibit erroneous detection of a liquid amount inside the liquid containing unit from occurring.

(2) In the cover, the liquid container may further include a second surface opposing the first surface; a third surface intersecting the first surface and the second surface respectively; a fourth surface opposing the third surface; a fifth surface intersecting the first surface, the second surface, the third surface and the fourth surface respectively, an end portion crossing the first surface being arranged at a closer distance to the liquid supply portionliquid supply portion rather than the detecting member on the first surface; and a sixth surface opposing the fifth surface. The first cover side engagement portionengagement portion may have a first positioning portion, and the first positioning portion may pass through the center of the liquid supply portionliquid supply portion in the direction from the third surface toward the fourth surface in a state of the cover being mounted on the liquid container, and may cross a virtual plane parallel to the direction from the sixth surface toward the fifth surface. In this case, the first positioning portion passes through the center of the liquid supply portionliquid supply portion in the direction from the third surface toward the fourth surface in a state of the cover being mounted on the liquid container, and crosses a virtual plane parallel to the direction from the sixth surface toward the fifth surface. Accordingly, it is possible to reliably perform the positioning between the cover and the liquid container along the direction from the third surface toward the fourth surface. Consequently, it is possible to reliably cover the liquid supply portionliquid supply portion using the cover portioncover portion, and thereby it is possible to inhibit the liquid from leaking out from the liquid supply portionliquid supply portion.

(3) In the cover, the liquid container may further include a second surface opposing the first surface; a third surface intersecting the first surface and the second surface respectively; a fourth surface opposing the third surface; a fifth surface intersecting the first surface, the second surface, the third surface and the fourth surface respectively, an end portion crossing the first surface being arranged at a closer distance to the liquid supply portionliquid supply portion rather than the detecting member on the first surface; and a sixth surface opposing the fifth surface. In the first container side engagement portionengagement portion, the sixth surface side may be open and a first concave portion may be formed in the direction from the sixth surface toward the fifth surface. The first cover side engagement portionengagement portion may have the first positioning portion and a first convex portion engaging with the first concave portion. The first positioning portion, compared to the first convex portion, may be configured to protrude longer in the direction from the sixth surface toward the fifth surface in a state of the cover being mounted on the liquid container. In this case, the first positioning portion, compared to the first convex portion, protrudes longer along the direction from the sixth surface toward the fifth surface in a state of the cover being mounted on the liquid container. Accordingly, when mounting the cover on the liquid container while moving the cover in the direction from the sixth surface toward the fifth surface, it is possible to perform the positioning in such a way that the first positioning portion is first engaged with the first container side engagement portionengagement portion. Consequently, the subsequent engagement of the first convex portion with the first concave portion can be easily performed.

(4) In the cover, the liquid container may further include a second surface opposing the first surface; a third surface intersecting the first surface and the second surface respectively; a fourth surface opposing the third surface; a fifth surface intersecting the first surface, the second surface, the third surface and the fourth surface respectively, an end portion crossing the first surface being arranged at a closer distance to the liquid supply portionliquid supply portion rather than the detecting member on the first surface, and having a second container side engagement portionengagement portion; and a sixth surface opposing the fifth surface. The cover may further include a second cover side engagement portionengagement portion engaging with the second container side engagement portionengagement portion in a state of the cover being mounted on the liquid container, and having a second positioning portion. The second positioning portion may pass through the center of the liquid supply portionliquid supply portion in the direction from the third surface toward the fourth surface in a state of the cover being mounted on the liquid container, and may cross a virtual plane parallel to the direction from the sixth surface toward the fifth surface. In this case, the second positioning portion passes through the center of the liquid supply portionliquid supply portion in the direction from the third surface toward the fourth surface in a state of the cover being mounted on the liquid container, and crosses a virtual plane parallel to the direction from the sixth surface toward the fifth surface. Accordingly, it is possible to reliably perform the positioning between the cover and the liquid container along the direction from the third surface toward the fourth surface (the direction from the fourth surface toward the third surface). Consequently, it is possible to reliably cover the liquid supply portionliquid supply portion using the cover portioncover portion, and thereby it is possible to inhibit the liquid from leaking out from the liquid supply portionliquid supply portion.

(5) In the cover, the second container side engagement portionengagement portion may include a plurality of second concave portions formed in the direction from the fifth surface toward the sixth surface, the fifth surface side being open, and a second convex portion formed in the direction from the sixth surface toward the fifth surface. The second cover side engagement portionengagement portion may have a plurality of third convex portions engaging with the plurality of second concave portions in a state of the cover being mounted on the liquid container. The second positioning portion may be located between a plurality of the third convex portions, and may allow the second convex portion to be inserted in a state of the cover being mounted on the liquid container. In this case, the second convex portion in the second container side engagement portionengagement portion provided on the third surface of the liquid container is inserted to the second positioning portion included in the second cover side engagement portionengagement portion. Since the second convex portion is formed in the direction from the sixth surface toward the fifth surface, if the second convex portion is inserted to the second positioning portion, it is possible to reliably perform the positioning between the cover and the liquid container along the direction from the third surface toward the fourth surface. Consequently, it is possible to reliably cover the liquid supply portionliquid supply portion using the cover portioncover portion, and thereby it is possible to inhibit the liquid from leaking out from the liquid supply portionliquid supply portion.

(6) In the cover, the liquid container may further include a second surface opposing the first surface; a third surface intersecting the first surface and the second surface respectively; a fourth surface opposing the third surface; a fifth surface intersecting the first surface, the second surface, the third surface and the fourth surface respectively, an end portion crossing the first surface being arranged at a closer distance to the liquid supply portionliquid supply portion rather than the detecting member on the first surface, and having a second container side engagement portionengagement portion; and a sixth surface opposing the fifth surface. The second container side engagement portionengagement portion may have a liquid ejecting apparatus positioning portion engaging with the liquid ejecting apparatus in a state where the liquid container is mounted on the liquid ejecting apparatus. The cover may further include a second cover side engagement portionengagement portion engaging with the liquid ejecting apparatus positioning portion in a state of the cover being mounted on the liquid container. In this case, it is possible to utilize the liquid ejecting apparatus positioning portion used for engaging the liquid container with the liquid ejecting apparatus, in engaging the cover with the liquid container. Therefore, it is possible to more closely engage the cover with the liquid container. Furthermore, in the liquid container, as compared to a configuration preparing configuration elements used for engaging the cover in addition to the configuration elements used for engaging the liquid ejecting apparatus, it is possible to achieve a simplified configuration of the liquid container, and thereby it is possible to lower the manufacturing cost of the liquid container.

(7) The cover may include a connection portion arranged between the cover portioncover portion and the second cover side engagement portionengagement portion. The first surface, at a close distance to the end portion crossing the fifth surface, may have a slantslanted portion slantslanting toward the fifth surface, and at least a portion of the connection portion may be arranged to be slantslanted along the slantslanted portion in a state of the cover being mounted on the liquid container. In this case, since the connection portion is arranged to be slantslanted along the slantslanted portion of the liquid container in a state of the cover being mounted on the liquid container, the connection portion can reinforce the slanted portion. A portion at a close distance to the end portion where the surface and the surface (the first surface and the fifth surface) are crossing each other is weak compared to other portions. Therefore, if the connection portion reinforces the slanted portion, it is possible to reinforce such a weak portion. In addition, since the connection portion is arranged to be slanted along the slanted portion, it is possible to perform the positioning between the cover and the liquid container in the direction from the sixth surface toward the fifth surface (the direction from the fifth surface toward the sixth surface), utilizing the connection portion and the slanted portion. Consequently, it is possible to reliably cover the liquid supply portionliquid supply portion using the cover portioncover portion, and thereby it is possible to inhibit the liquid from leaking out from the liquid supply portionliquid supply portion.

(8) The cover may include a third cover side engagement portionengagement portion coming into contact with the second surface in a state of the cover being mounted on the liquid container. In this case, in the first surface and the second surface which oppose each other, it is possible to engage the cover with the liquid container. Consequently, it is possible to more reliably cover the liquid supply portionliquid supply portion using the cover portioncover portion, and thereby it is possible to more reliably perform the positioning between the cover and the liquid container along the direction from the first surface toward the second surface (the direction from the second surface toward the first surface).

(9) In the cover, the liquid container may further include a second surface opposing the first surface; a third surface intersecting the first surface and the second surface respectively; a fourth surface opposing the third surface; a fifth surface intersecting the first surface, the second surface, the third surface and the fourth surface respectively, an end portion crossing the first surface being arranged at a closer distance to the liquid supply portionliquid supply portion rather than the detecting member on the first surface, and having a second container side engagement portionengagement portion; and a sixth surface opposing the fifth surface. On the fourth surface, in a region closer to the fifth surface than the sixth surface, a fourth surface side concave portion may be formed in the direction from the fourth surface toward the third surface. The second cover side engagement portionengagement portion may further include a contact portion coming into contact with the fifth surface and the third surface, extending in the direction from the fifth surface toward the sixth surface over the fourth surface side concave portion and coming into contact with the fourth surface, in a state of the cover being mounted on the liquid container. In this case, the second cover side engagement portionengagement portion comes into contact with the third surface and the fourth surface which oppose each other, in a state of the cover being mounted on the liquid container. Accordingly, it is possible to hold (support from both sides) the liquid container using the second cover side engagement portionengagement portion. Consequently, it is possible to reliably perform the positioning between the cover and the liquid container along the direction from the third surface toward the fourth surface (the direction from the fourth surface toward the third surface). In addition, the contact portion comes into contact with the fourth surface, extending in the direction from the fifth surface toward the sixth surface over the fourth surface side concave portion. Therefore, as compared to a configuration where an end portion on the second surface side of the contact portion is located in a region having the fourth surface side concave portion, it is possible to improve a force holding (pinching) the liquid container. As a result, it is possible to more reliably perform the positioning.

(10) In the cover, the liquid container may further include a second surface opposing the first surface; a third surface intersecting the first surface and the second surface respectively; a fourth surface opposing the third surface; a fifth surface intersecting the first surface, the second surface, the third surface and the fourth surface respectively, an end portion crossing the first surface being arranged at a closer distance to the liquid supply portionliquid supply portion rather than the detecting member on the first surface, and having a second container side engagement portionengagement portion; and a sixth surface opposing the fifth surface. On the fourth surface, in a region closer to the fifth surface than the sixth surface, a fourth surface side concave portion may be formed in the direction from the fourth surface toward the third surface. The second cover side engagement portionengagement portion may further include an insertion portion inserted to the fourth surface side concave portion in a state of the cover being mounted on the liquid container, coming into contact with the fifth surface and the third surface, and coming into contact with the fourth surface using the insertion portion. In this case, the second cover side engagement portionengagement portion comes into contact with the third surface and the fourth surface which oppose each other in a state of the cover being mounted on the liquid container. Accordingly, it is possible to pinch the liquid container using the second cover side engagement portionengagement portion. Consequently, it is possible to reliably perform the positioning between the cover and the liquid container along the direction from the third surface toward the fourth surface (the direction from the fourth surface toward the third surface). In addition, since the second cover side engagement portionengagement portion has the insertion portion inserted to the fourth surface side concave portion of the liquid container, using the portion coming into contact with the fifth surface and the insertion portion, it is possible to reliably perform the positioning between the cover and the liquid container along the direction from the fifth surface toward the sixth surface (the direction from the sixth surface toward the fifth surface).

(11) According to another aspect of the invention, there is provided a liquid container having the attached cover.

A plurality of the configuring elements included in various aspects of the invention are not all indispensable. In order to partially or entirely realize the invention, or to partially or entirely achieve advantages disclosed in the present description, the plurality of configuration elements may be appropriately and partially modified, deleted, and replaced by other new configuration elements, and some limited content may be deleted. In addition, in order to partially or entirely realize the invention, or to partially or entirely achieve advantages disclosed in the present description, any combination of partial or entire technical features included in an aspect of the invention with partial or entire technical features included in other aspects may configure an independent embodiment.

For example, an aspect of the invention may be realized as an apparatus provided with one or more elements out of two elements, the first cover side engagement portionengagement portion and the cover portioncover portion. That is, the apparatus may include or may not include the first cover side engagement portionengagement portion. Furthermore, the apparatus may include or may not include the cover portioncover portion. For example, the first cover side engagement portionengagement portion may be configured as the first cover side engagement portionengagement portion engaging the first container side engagement portionengagement portion in a state of the cover being mounted on the liquid container. Furthermore, the cover portioncover portion may be configured as the cover portioncover portion covering the liquid supply portionliquid supply portion in a state of the cover being mounted on the liquid container. Such an apparatus may be realized as the cover and may also be realized as other apparatuses in addition to the cover. For example, the apparatus may also be realized as a cap for the cartridge containing the liquid. According to such an aspect, at least one of the various advantages may be achieved in miniaturizing the apparatus (members), saving an energy, facilitating the manufacturing works, and improving the usability. Any of the partial or entire technical features in each aspect of the above-described cover may be applied to the apparatus.

In addition, the invention may be realized in various aspects, and for example, may be realized in aspects such as cartridges, manufacturing methods of the cover, manufacturing methods of the liquid container and manufacturing methods of the cartridge.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order.

A to H. Various Embodiments

I. Modification Example

A. First Embodiment

A-1: Configuration of Liquid Ejecting System

Figure 1:
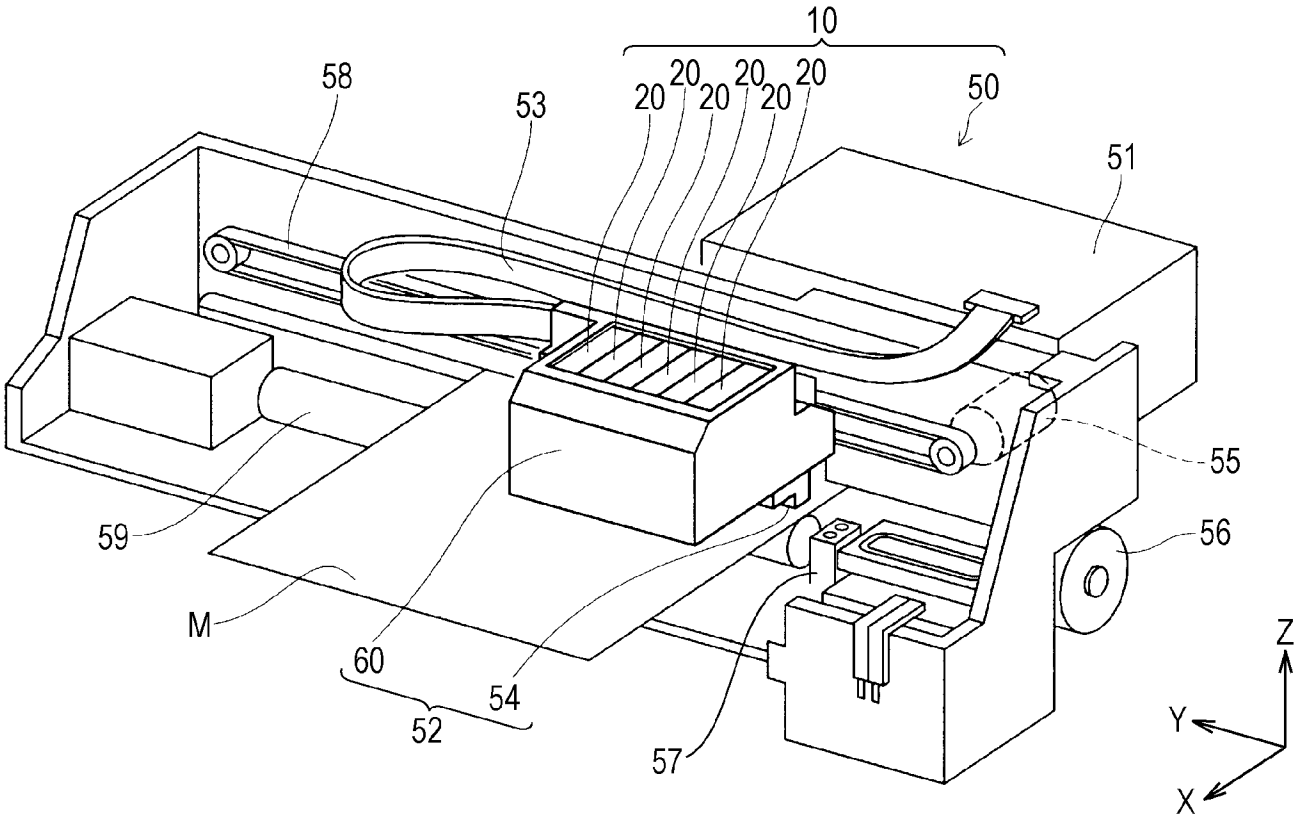
FIG. 1 is a perspective view illustrating a configuration of a liquid ejecting system.

FIG. 1 is a perspective view illustrating a configuration of a liquid ejecting system 10. FIG. 1 illustrates XYZ axes which are orthogonal to one another. The XYZ axes in FIG. 1 also correspond to XYZ axes in other drawings. The XYZ axes are also given to the subsequently illustrated drawings when necessary. The liquid ejecting system 10 includes a cartridge 20 as a liquid container and a printer 50 as a liquid ejecting apparatus. The liquid ejecting system 10 is configured such that a user can attach and detach the cartridge 20 to and from a holder 60 of the printer 50.

The cartridge 20 contains an ink inside thereof. The ink contained in the cartridge 20 is supplied to a head 54 via a liquid supply portionliquid supply portion and a liquid supply tube which are described below. In the present embodiment, a plurality of cartridges 20 is mounted so as to be attachable to and detachable from the holder 60 of the printer 50. In the embodiment, six types of cartridge 20, that is, total six cartridges 20 are mounted one by one on the holder 60 corresponding to six colors of ink (black, yellow, magenta, light magenta, cyan and light cyan). Meanwhile, the number of cartridges 20 mounted on the holder 60 is not limited to six.

The printer 50 is a small personal ink jet printer. In addition to the holder 60, the printer 50 includes a control unit 51 and a carriage 52 having the holder 60. The carriage 52 includes a head 54. The printer 50 circulates the ink from the cartridge 20 mounted on the holder 60 via the liquid supply tube (to be described later) to the head 54. The head 54 includes an ejecting mechanism such as a piezoelectric element, which ejects (supplies) the ink onto a printing medium 90 such as sheets and labels. This enables data such as characters, figures and images to be printed on the printing medium 90.

The control unit 51 controls each unit of the printer 50. The carriage 52 of the printer 50 is configured such that the head 54 is relatively movable with respect to the printing medium 90. A flexible cable 53 electrically connects between the control unit 51 and the carriage 52, and the ejecting mechanism of the head 54 is operated based on control signals from the control unit 51.

In the embodiment, the carriage 52 is configured to have the head 54 and the holder 60. In this manner, a type of printer 50 where the cartridge 20 is mounted on the holder 60 on the carriage 52 moving the head 54 is also called an "on-carriage type". In other embodiments, an unmovable holder 60 may be configured at a different portion from the carriage 52, and the ink may be supplied to the head 54 from the cartridge 20 mounted on the holder 60 via a tube. Such a type of printer is also called an "off-carriage type".

In the embodiment, the printer 50 includes a main scanning forwarding mechanism and sub-scanning forwarding mechanism in order to realize printing with respect to the printing medium 90 by relatively moving the carriage 52 and the printing medium 90. The main scanning forwarding mechanism of the printer 50 includes a carriage motor 55 and a drive belt 58. A power of the carriage motor 55 is transmitted to the carriage 52 via the drive belt 58, which moves the carriage 52 to reciprocate in a main scanning direction. The sub-scanning forwarding mechanism of the printer 50 includes a transportation motor 56 and a platen 59. The power of the transportation motor 56 is transmitted to the platen 59, which transports the printing medium 90 in a sub-scanning direction orthogonal to the main scanning direction.

A detection portion 57 is disposed at a position outside a printing region of the printer 50 in order to optically detect a remaining amount of the ink inside the cartridge 20. A light emitting portion and a light receiving portion are disposed inside the detection portion 57. The control unit 51 causes the light emitting portion of the detection portion 57 to emit light when the cartridge 20 passes over the detection portion 57 following the movement of the carriage 52, and based on whether the light receiving portion of the detection portion 57 receives the light or not, or otherwise based on a light receiving amount, detects an ink remaining state inside the cartridge 20 (specifically the presence or absence of the ink).

In the embodiment, in order to describe a use state (also referred to as a "use posture") of the liquid ejecting system 10, an X axis represents the axis along a sub-scanning direction (forward and backward direction) to which the printing medium 90 is transported, a Y axis represents the axis along a main scanning direction (leftward and rightward direction) to which the carriage 52 is moved to reciprocate, and a Z axis represents the axis along the direction of gravity (upward and downward direction). Further, the use state of the liquid ejecting system 10 means a state of the liquid ejecting system 10 placed on a horizontal plane. In the embodiment, the horizontal plane is a plane (an XY plane) parallel to the X axis and the Y axis.

The embodiment defines the sub-scanning direction (forward direction) as a +axis direction, the opposite direction (backward direction) as a −axis direction, the direction from below to above (upward direction) in the direction of gravity as a +Z direction, and the opposite direction (downward direction) as a −Z direction. The embodiment defines the direction from a right side surface toward a left side surface of the liquid ejecting system 10 as a +Y axis direction (leftward direction), and the opposite direction as a −Y axis direction (rightward direction). In the embodiment, an alignment direction of the plurality of cartridges 20 mounted on the holder 60 is the direction along the Y axis (leftward and rightward direction, simply referred to as a "Y axis direction"). Further, the direction (leftward and rightward direction) along the X axis direction is referred to as an "X axis direction", and the direction (upward and downward direction) along the Z axis direction is referred to as a "Z axis direction".

A-2. Configuration of Holder 60

Figure 2:
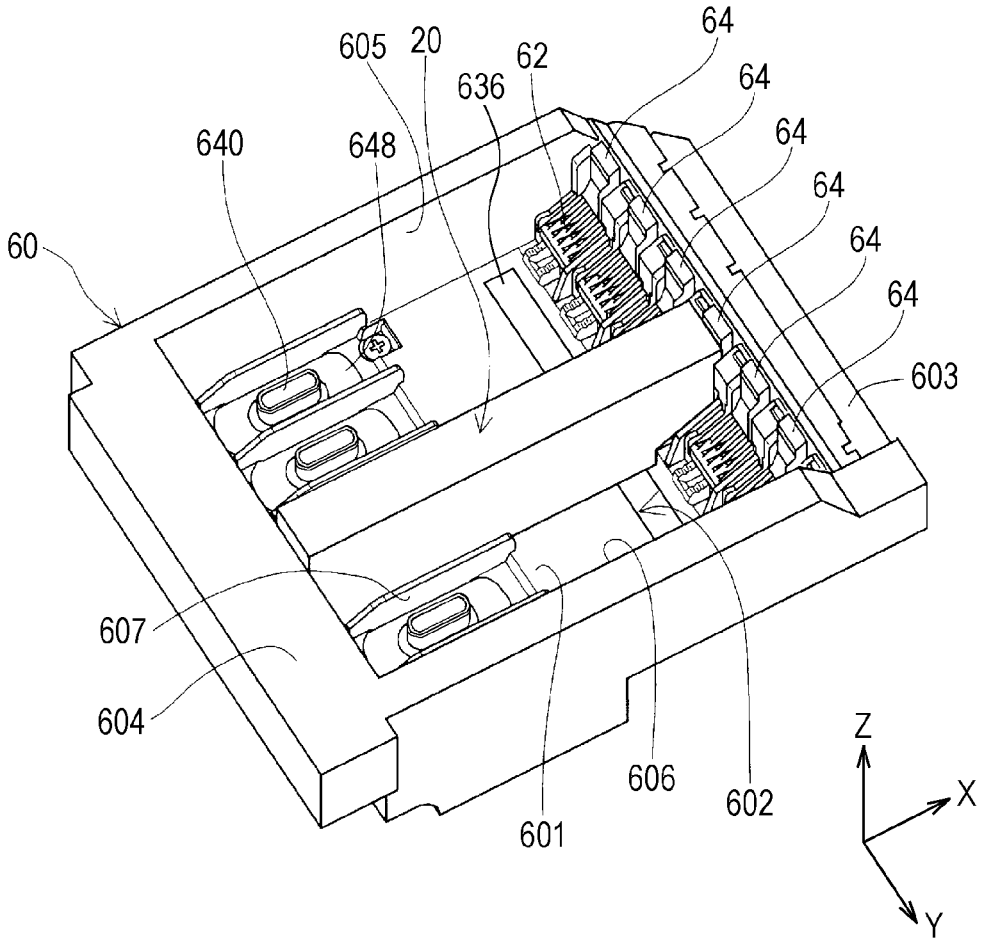
FIG. 2 is a first perspective view illustrating a holder on which a cartridge is mounted.
Figure 3:
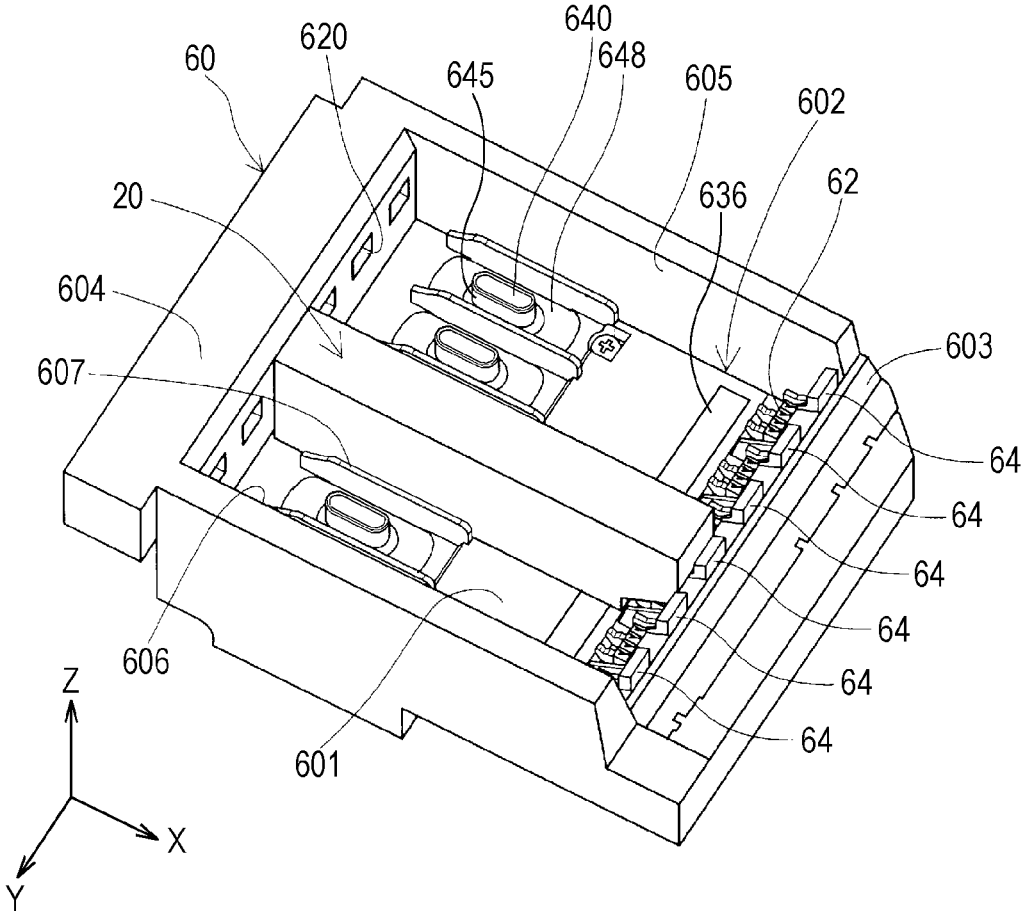
FIG. 3 is a second perspective view illustrating a holder on which a cartridge is mounted.

FIG. 2 is a first perspective view illustrating the holder 60 on which the cartridge 20 is mounted. FIG. 3 is a second perspective view illustrating the holder 60 on which the cartridge 20 is mounted. The holder 60 has five wall portions 601, 603, 604, 605 and 606. Four wall portions 603, 604, 605 and 606 extend from a peripheral edge portion of the wall portion 601 in the +Z axis direction so as to form a concave portion. The concave portion becomes a cartridge containing chamber 602 (also referred to as a "cartridge mounting portion 602") which contains the cartridge 20. In addition, the cartridge containing chamber 602 is divided by a partitioning wall 607 into a plurality of slots (mounting spaces) capable of accepting each of the cartridges 20. Such a partitioning wall 607 functions as a guide when the cartridges 20 are inserted to the slots, but may be omitted. In addition, a through hole 636 is formed in order to optically detect the ink remaining state utilizing the detection portion 57 such that the light can pass through the wall portion 601.

The holder 60 includes a liquid supply tube 640, a lever 64, a contact mechanism 62 and a locking hole 620 for every slot. One side surface of each slot (side surface in the +Z axis direction: upper surface) is open, which allows the cartridge 20 to be attached to and detached from the holder 60 via the one open side surface (upper surface).

The liquid supply tube 640 forms a flow path for circulating the ink of the cartridge 20 to the head 54. The liquid supply tube 640 is connected to the liquid supply portionliquid supply portion of the cartridge 20 in a state where the cartridge 20 is mounted on the printer 50 (mounted state). An elastic member 648 is disposed in the periphery of the liquid supply tube 640. The elastic member 648 tightly closes the periphery of the liquid supply portionliquid supply portion of the cartridge 20 in the mounted state. This prevents the ink from leaking to the periphery out from the liquid supply portionliquid supply portion of the cartridge 20.

The lever 64 is used when attaching and detaching the cartridge 20. In addition, the lever 64 locks the cartridge 20 in the state where the cartridge 20 is mounted on the holder 60 (mounted state).

The contact mechanism 62 is electrically connected to a circuit board of the cartridge 20 to be described later. In addition, the contact mechanism 62 is electrically connected to the control unit 51. In this manner, various items of information (colors of the ink in the cartridge 20 or the ink remaining state) are transmitted between the cartridge 20 and the printer 50.

The locking hole 620 is a through hole penetrating the wall portion 604 in the thickness direction. The locking hole 620 allows a second locking portion (to be described later) of the cartridge 20 to be inserted in the state where the cartridge 20 is mounted on the holder 60.

A-3. External Configuration of Cartridge 20

Figure 4:
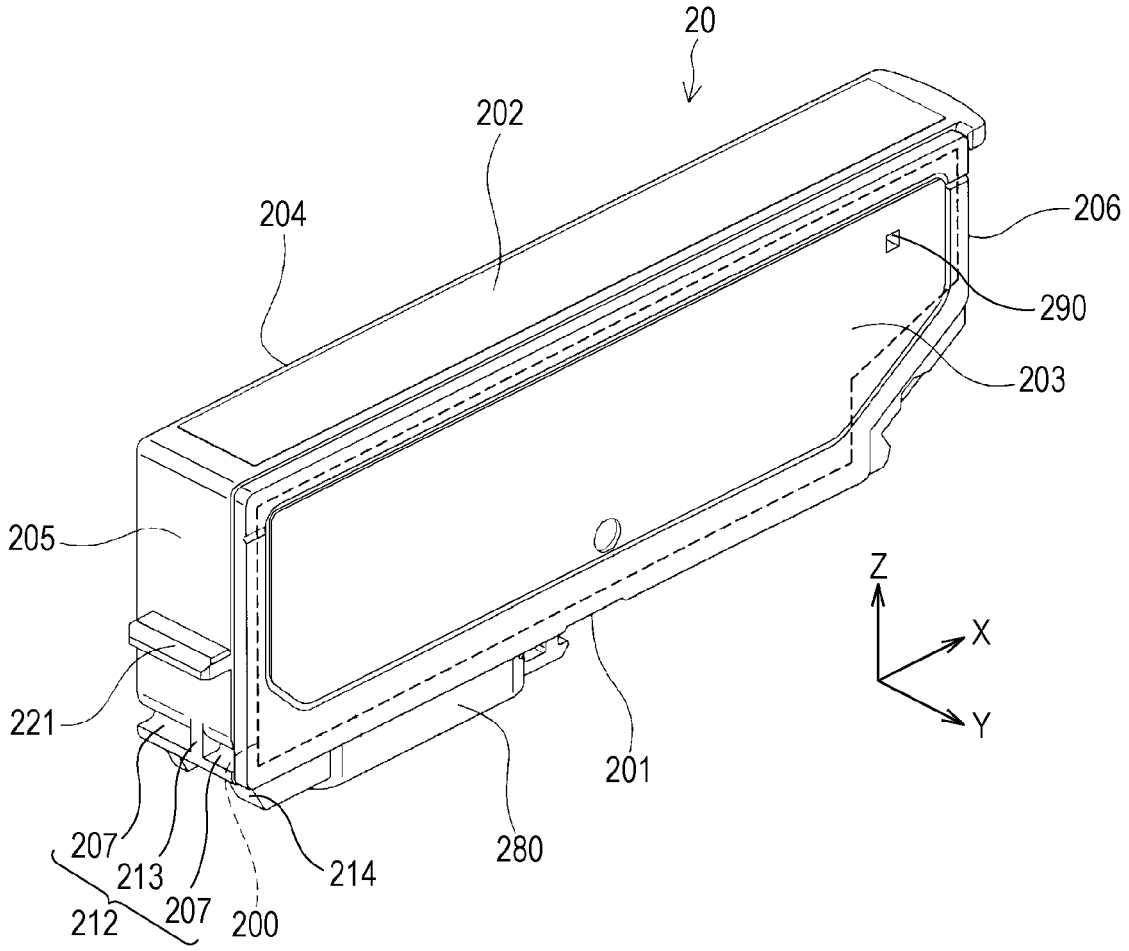
FIG. 4 is a first external perspective view of a cartridge.
Figure 5:
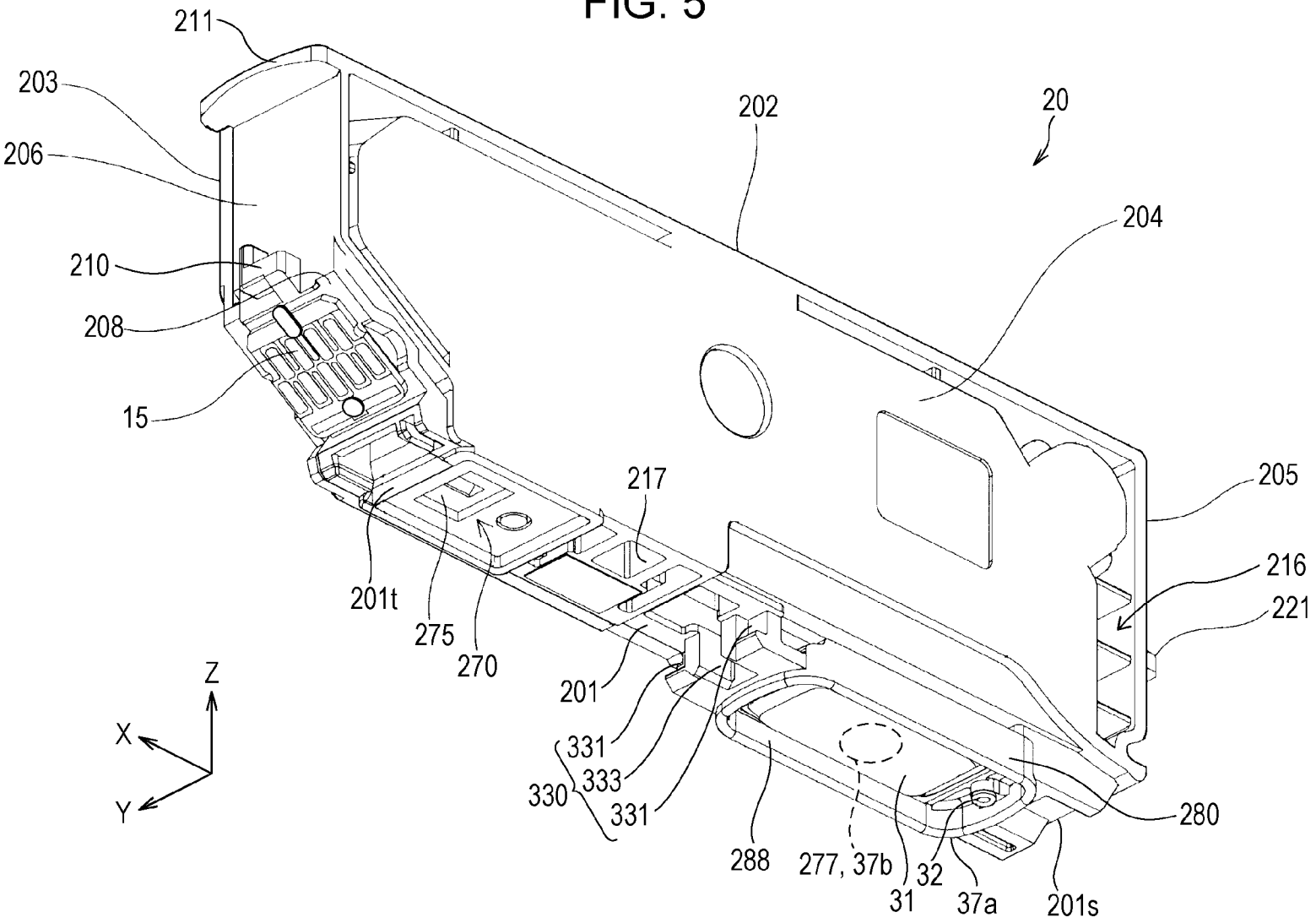
FIG. 5 is a second external perspective view of a cartridge.
Figure 6:
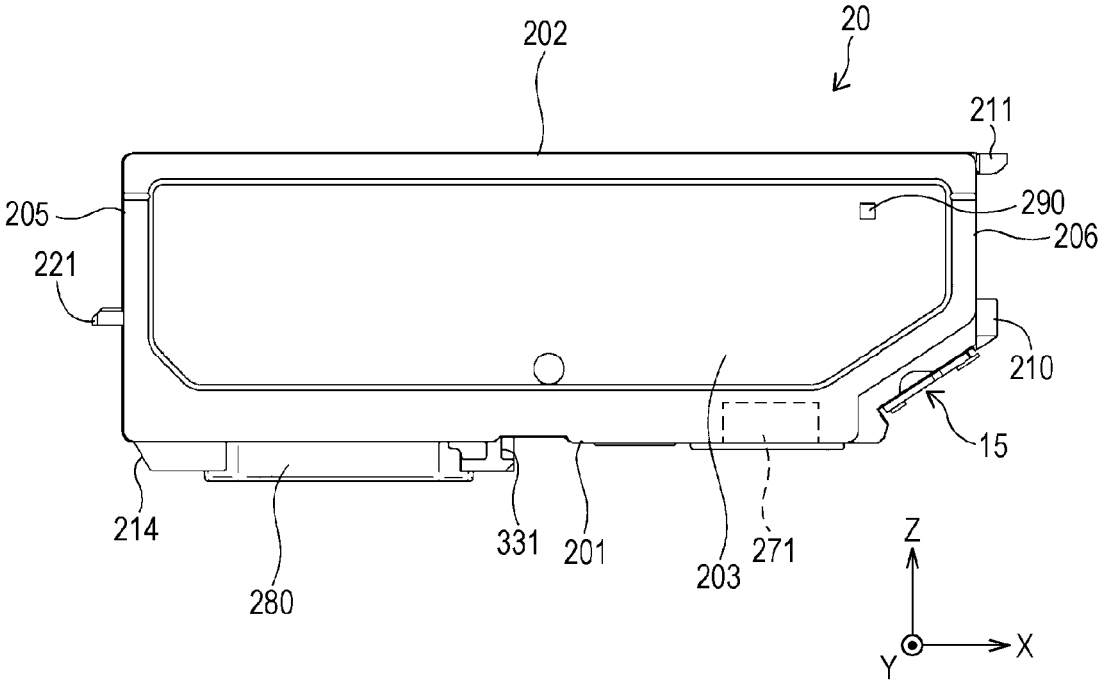
FIG. 6 is a front view of a cartridge.
Figure 7:
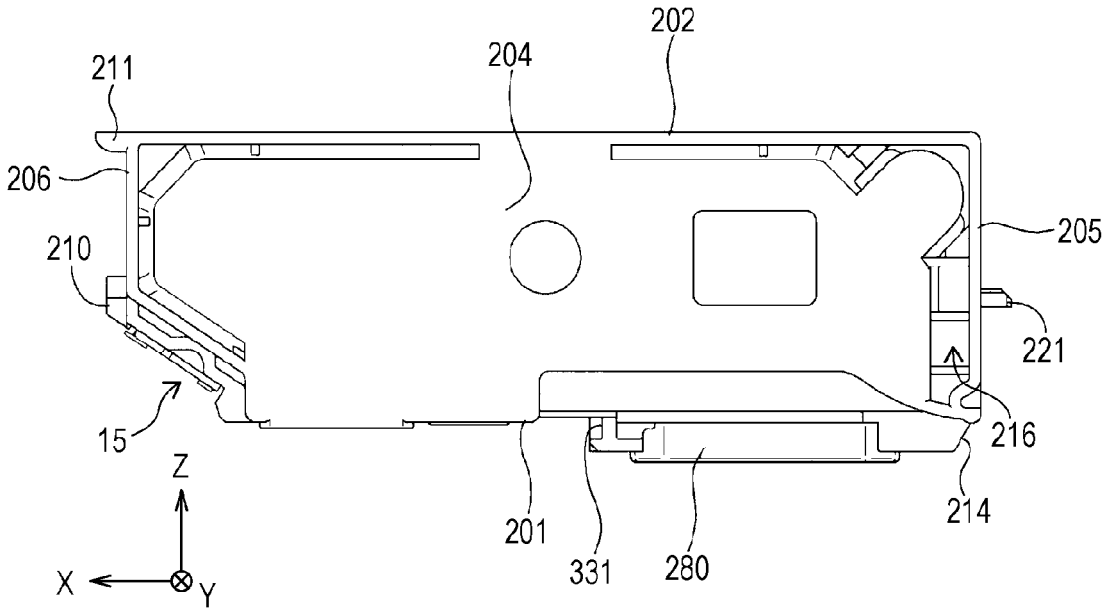
FIG. 7 is a rear view of a cartridge.
Figure 8:
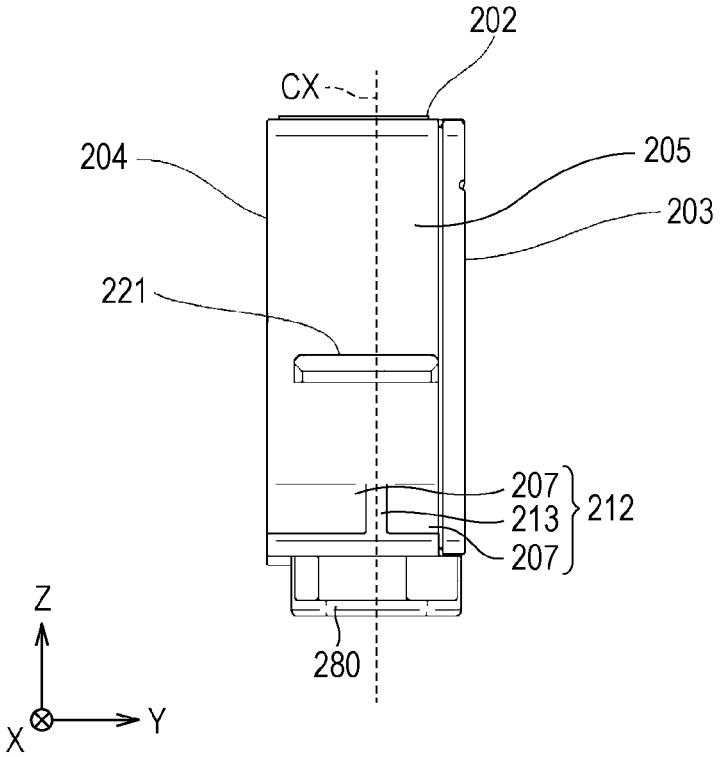
FIG. 8 is a left-side view of a cartridge.
Figure 9:
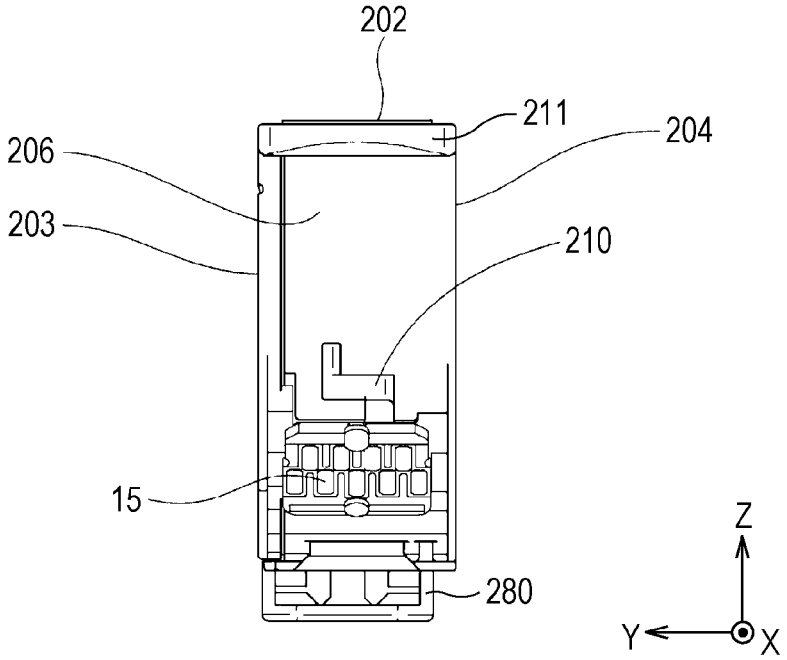
FIG. 9 is a right-side view of a cartridge.
Figure 10:
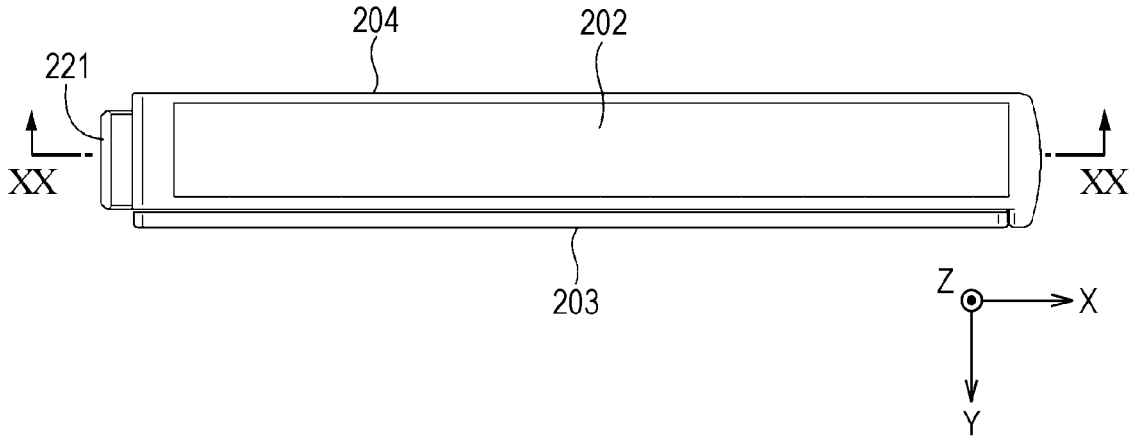
FIG. 10 is a plan view of a cartridge.
Figure 11:
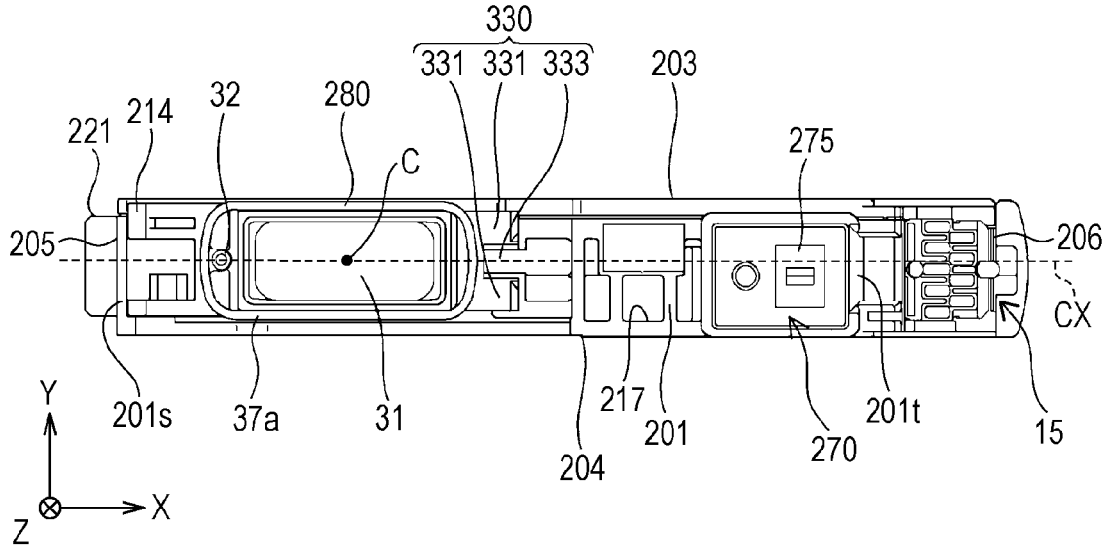
FIG. 11 is a bottom view of a cartridge.

FIG. 4 is a first external perspective view of the cartridge 20. FIG. 5 is a second external perspective view of the cartridge 20. FIG. 6 is a front view of the cartridge 20. FIG. 7 is a rear view of the cartridge 20. FIG. 8 is a left-side view of the cartridge 20. FIG. 9 is a right-side view of the cartridge 20. FIG. 10 is a plan view of the cartridge 20. FIG. 11 is a bottom view of the cartridge 20. The cartridge 20 of the embodiment is a so-called semi-airtight type of cartridge 20 which intermittently introduces outside air to a liquid containing unit 200 following the consumption of the ink. Further, an inner configuration of the cartridge 20 will be described later.

As illustrated in FIG. 4, the cartridge 20 includes a liquid containing unit 200 for containing the ink inside thereof and a liquid supply portionliquid supply portion 280 for circulating the ink in the liquid containing unit 200 to the printer 50 outside.

As illustrated in FIGS. 4 to 11, the cartridge 20 has a substantially rectangular parallelepiped shaped appearance. The cartridge 20 includes six surfaces (walls) 201 to 206. The six surfaces 201 to 206 configure an external surface (contour) of the cartridge 20. The six surfaces are configured to include a first surface 201, a second surface 202, a third surface 203, a fourth surface 204, a fifth surface 205 and a sixth surface 206. Each of the surfaces 201 to 206 is a substantially plane. To be substantially plane includes a case where the entire surface is completely flat and a case where the surface partially has concave and convex portions. That is, even though the surface partially has some concave and convex portions, a case is included where the surfaces or walls configuring the contour of the cartridge 20 can be appreciated. Any outer shape of the first to sixth surfaces 201 to 206 is rectangular in a plane view.

The first surface 201 and the second surface 202 oppose each other. The sixth surface 206 and the fifth surface 205 oppose each other. The third surface 203 and the fourth surface 204 oppose each other. Here, the direction where the first surface 201 and the second surface 202 oppose each other is the Z axis direction (direction along a first direction). The direction where the sixth surface 206 and the fifth surface 205 oppose each other is the X axis direction. The direction where the third surface 203 and the fourth surface 204 oppose each other is the Y axis direction. In the embodiment, the first surface 201 configures a bottom surface in a state where the cartridge 20 is mounted on the printer 50. Here, as illustrated in FIG. 11, an end portion (edge) at the sixth surface 206 side on the first surface 201 is also called a first end portion 201*t*. In addition, an end portion (edge) at the fifth surface 205 side on the first surface 201 is also called a second end portion 201*s*. In addition, in a state where the cartridge 20 is mounted on the printer 50, the −Z axis direction (the first direction) is the vertically downward direction.

The sixth surface 206 crosses the first surface 201. The fifth surface 205 crosses the first surface 201. The second surface 202 crosses the fifth surface 205 and the sixth surface 206. The third surface 203 crosses the first surface 201, the second surface 202, the fifth surface 205 and the sixth surface 206. The fourth surface 204 crosses the first surface 201, the second surface 202, the fifth surface 205 and the sixth surface 206. Here, an expression that two surfaces cross each other means that the two surfaces are in any state among a state where the two surfaces mutually intersect and actually cross each other, a state where a virtually extending surface of one surface crosses the other surface, and a state where virtually extending mutual surfaces cross each other.

As illustrated in FIGS. 4 and 5, the liquid supply portionliquid supply portion 280 is disposed to protrude from the first surface 201. Specifically, the liquid supply portionliquid supply portion 280 extends from the first surface 201 along the −Z axis direction (the first direction). The liquid supply portionliquid supply portion 280 is connected to the printer 50. As illustrated in FIG. 5, the liquid supply portionliquid supply portion 280 is configured such that one end portion 37*b* has a liquid communication port 277, communicating with the liquid containing unit 200, and the other end portion 37*a* is formed to be open. Here, the other end portion 37*a* is located in the −Z axis direction (the first direction side) with respect to the one end portion 37*b*. In addition, the ink supply unit 280 has a flow path circulating the ink in the direction (the Z axis direction) along the first direction. The above-described liquid supply portionliquid supply portion 280 will be described below in a different viewpoint. That is, the liquid supply portionliquid supply portion 280 protrudes outward from a member (the first surface) configuring the cartridge 20. In addition, the liquid supply portionliquid supply portion 280 has an opening 288 at the end portion 37*a*, one end thereof. The protruding direction of the liquid supply portionliquid supply portion 280 is the −Z axis direction. A liquid supply tube 640 of the printer 50 is inserted into the liquid supply portionliquid supply portion 280 through the opening 288. As illustrated in FIG. 4, an air introduction port 290 is formed on the third surface 203 in order to introduce air into the cartridge 20.

As illustrated in FIGS. 5 and 11, inside the liquid supply portionliquid supply portion 280, there are formed a liquid outflow portion 31 through which the ink is circulated toward the liquid supply tube 640 of the printer 50, and a communication port 32 as an opening for communicating the inside and the outside of the liquid supply portionliquid supply portion 280. That is, the communication port 32 is the opening for connecting the outside and the inside of the liquid supply portionliquid supply portion 280. The liquid outflow portion 31 is configured to be capable of maintaining the ink. If mounted, the ink supply tube 640 (refer to FIGS. 2 and 3) is inserted into the liquid supply portionliquid supply portion 280 from the opening 288 as a liquid supply port, which enables the ink to be circulated from the liquid supply portionliquid supply portion 280 to the liquid supply tube 640. Here, in a non-use state before the cartridge 20 is provided for use in the printer 50, the flow path from the inside of the liquid containing unit 200 to the liquid outflow portion 31 is filled with the ink. In addition, the cartridge 20 has a communication path communicating the inside and the outside of the liquid supply portionliquid supply portion 280. One end of the communication path is the communication port 32 and the other end is the air introduction port 290 (refer to FIG. 4) formed on the third surface 203. Further, the communication path will be described in detail later. The liquid outflow portion 31, when mounted, comes into contact with the liquid supply tube 640 circulating the ink to the head 54.

As illustrated in FIGS. 5 and 11, a prism unit 270 is arranged on the first surface 201 to form a portion of the first surface 201. The prism unit 270 includes a so-called right-angle prism. The right-angle prism of the prism unit 270 is located inside the liquid containing unit 200. As illustrated in FIGS. 5 to 7, and 11, the prism unit 270 includes a transmission surface 275 as a transmission portion forming a portion of the first surface 201, and two surfaces (reflection surfaces) 271 (refer to FIG. 6) crossing at a substantially right angle. The light emitted from a detection unit 57 (refer to FIG. 1) is transmitted through the transmission surface 275. In addition, the light reflected on a surface 271 toward the detection unit 57 is transmitted through the transmission surface 275. As illustrated in FIG. 11, the transmission surface 275 is arranged at a closer side to the first end portion 201*t* than the second end portion 201*s* on the first surface 201. In contrast, the liquid supply portionliquid supply portion 280 is arranged at a closer side to the second end portion 201*s* than the first end portion 201*t* on the first surface 201. Specifically, in order to separate the transmission surface 275 and the liquid supply portionliquid supply portion 280 as much as possible, the transmission surface 275 comes close to the first end portion 201*t* and the liquid supply portionliquid supply portion 280 comes close to the second end portion 201*s*.

In addition, as illustrated in FIGS. 5 and 11, the first container side attachment unit 330 having a concave and convex appearance is formed between the liquid supply portionliquid supply portion 280 and the prism unit 270, on the first surface 201. The first container side attachment unit 330 is configured to have a pair of first container locking portions 331 and a container acceptance portion 333.

The first container locking portions 331 are open at the sixth surface 206 side, and are concave portions formed along the direction from the sixth surface 206 toward the fifth surface 205. A pair of the first container locking portions 331 is arranged with a predetermined interval in the Y axis direction. The container acceptance portion 333 is formed as a space between a pair of the first container locking portions 331. As illustrated in FIG. 11, the container acceptance portion 333 crosses a plane CX. The plane CX passes through a center C of the opening 288 of the liquid supply portionliquid supply portion 280 in the Y axis direction (the width direction) and is a surface parallel to the X and Z axes (the surface parallel to the third surface 203 and the fourth surface 204). In other words, the plane CX passes through the center C and is a plane (a virtual plane) parallel to the direction from the sixth surface 206 toward the fifth surface 205.

A pair of the first container locking portions 331 and the container acceptance portion 333 are used in positioning a cap with respect to the opening 288 in a case where the cap for closing the opening 288 is attached to the cartridge 20. The details will be described later. In addition, as illustrated in FIGS. 4 and 11, a slanted portion 214 slanting from the first surface 201 toward the fifth surface 205 is formed close to an end portion crossing the fifth surface 205, on the first surface 201. In addition, as illustrated in FIGS. 5 and 11, a concave portion 217 is formed on the first surface 201. The concave portion 217 is a recess formed in the direction from the first surface 201 toward the second surface 202, and functions as a so-called thickness slimmer. If the thickness of an outer shell (a main body member 22) to be described later of the cartridge 20 is thick, there is a possibility that air bubbles (voids) may occur inside the member and the member may be warped. Therefore, the cartridge 20 is configured such that the thickness slimmer is formed to partially decrease (make) the main body member 22 (thin) in thickness, whereby inhibiting the above-described air bubbles and warp from occurring.

As illustrated in FIG. 5, a first locking portion 210 with a projection shape is formed on the sixth surface 206. The first locking portion 210 is locked by a lever 64 in the mounted state. In addition, as illustrated in FIGS. 5, 6, 7 and 9, a protrusion 211 protruding in the +Z axis direction is disposed at an end portion intersecting with the second surface 202 on the sixth surface 206. The protrusion 211 functions as a grip for users when the cartridge 20 is removed from the holder 60. As illustrated in FIG. 4, a second locking portion 221 with a projection shape is formed on the fifth surface 205. The second locking portion 221 is inserted to and locked by a locking hole 620 illustrated in FIG. 2 in the mounted state.

As illustrated in FIGS. 4 and 8, a second container side attachment unit 212 having a concave and convex appearance is formed at a close position to an end portion of the first surface 201, on the fifth surface 205. The second container side attachment unit 212 is configured to have a pair of concave portions 207 and a convex portion 213. The concave portions 207 are open at the fifth surface 205 side and are formed as grooves formed along the direction from the fifth surface 205 toward the sixth surface 206. A pair of the concave portions 207 is arranged with a predetermined interval in the Y axis direction. The convex portion 213 is configured as a wall formed between a pair of the concave portions 207 along the direction from the sixth surface 206 toward the fifth surface 205. As illustrated in FIG. 8, the convex portion 213 crosses the above-described plane CX. A pair of the concave portions 207 and the convex portion 213 is used for attaching a cap to the cartridge 20 in a case where the cap for closing an opening 288 on the fifth surface 205 is attached to the cartridge 20. The details will be described later.

As illustrated in FIG. 5, a circuit board 15 is disposed on a connection surface 208 connecting the first surface 201 and the sixth surface 206. A plurality of terminals coming into contact with the contact mechanism 62 in the mounted state is formed on the surface of the circuit board 15. In addition, a storage device storing various items of information (the ink remaining state, the ink colors and the like) of the cartridge 20 is disposed on a rear surface of the circuit board 15.

As illustrated in FIGS. 5 and 7, a thickness slimmer 216 is formed in a peripheral area closer to the fifth surface 205 than the sixth surface 206 on the fourth surface 204. The thickness slimmer 216 is a portion (the concave portion) formed in the direction from the fourth surface 204 toward the third surface 203. The thickness slimmer 216 has a similar function to that of the above-described concave portion 217.

A-4. Internal Configuration of Cartridge 20

Figure 12:
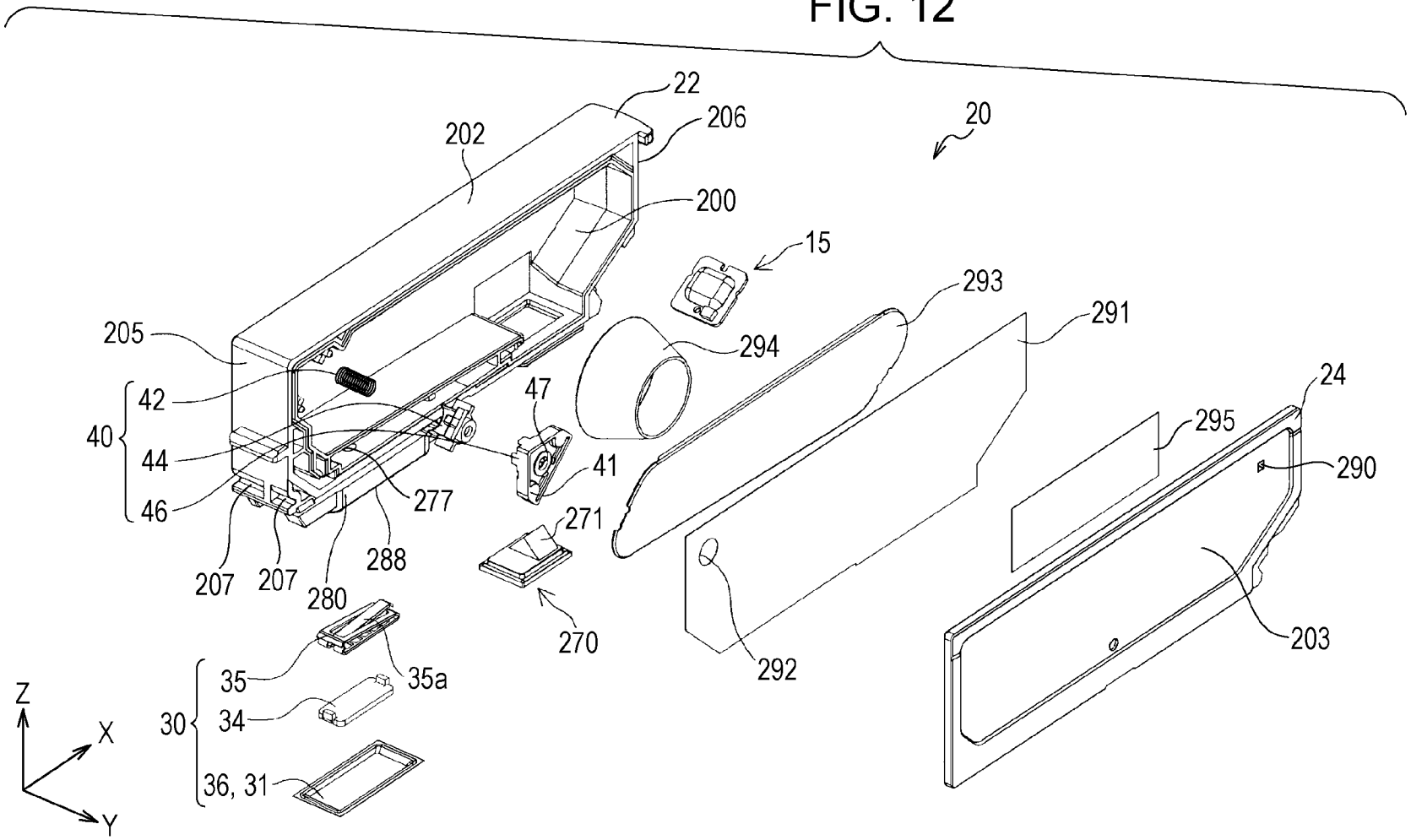
FIG. 12 is an exploded perspective view of a cartridge.
Figure 13:
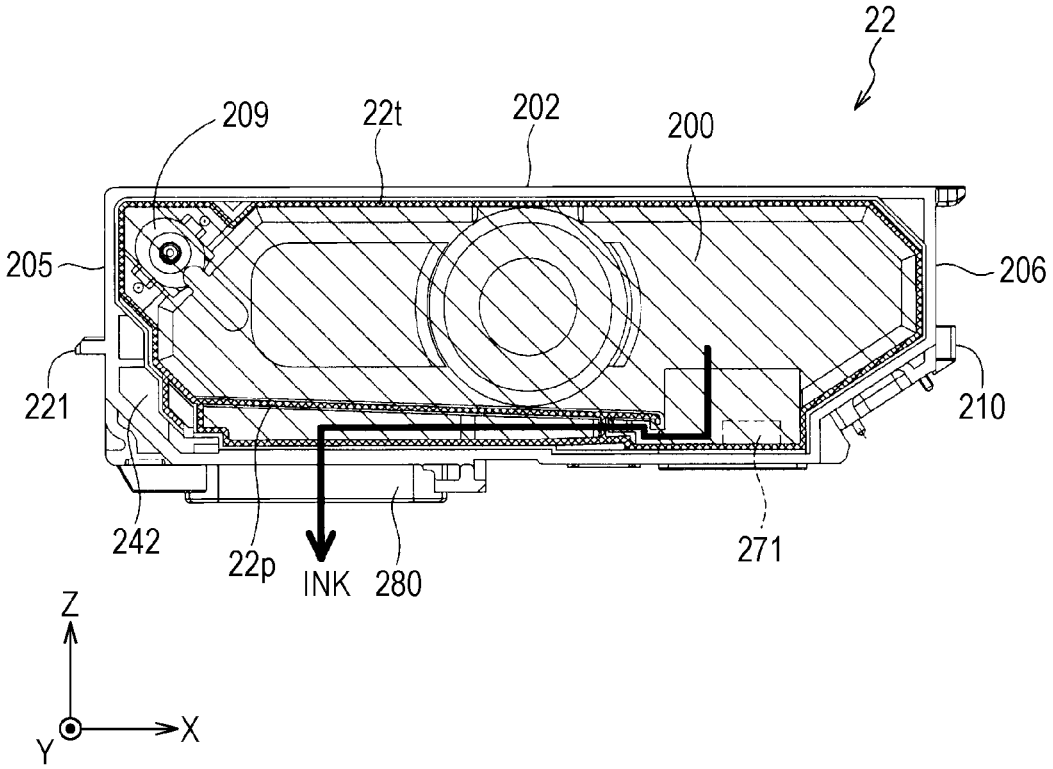
FIG. 13 is a front view of a main body member.

FIG. 12 is an exploded perspective view of the cartridge 20. FIG. 13 is a front view of the main body member 22. FIG. 13 illustrates a surface 271 of the prism unit 270 using a dashed line. In addition, FIG. 13 illustrates how the ink in the liquid containing unit 200 is circulated outward through the liquid supply portionliquid supply portion 280 using an arrow. As illustrated in FIG. 12, the cartridge 20 includes the main body member 22 and a lid member 24. The main body member 22 and the lid member 24 form an outer surface (an outer shell) of the cartridge 20. In addition, the cartridge 20 includes a valve mechanism 40, a coil spring 294 as a biasing member, a pressure plate 293 and a sheet member (a film member) 291.

The main body member 22 and the lid member 24 are formed of synthetic resins such as polypropylene. In addition, the sheet member 291 is formed of the synthetic resins (for example, materials including nylon and polypropylene), having flexibility. That is, the sheet member 291 is configured to be variable by way of an external force.

The sheet member 291 has a ventilation port 292. This enables the cartridge 20 to take air into the liquid containing unit 200 through the air introduction port 290, the ventilation port 292, a through hole 47 (to be described later).

The main body member 22 is a member to form the liquid containing unit 200 and the liquid supply portionliquid supply portion 280. The main body member 22 has a concave shape and one side surface thereof is open. The sheet member 291 is adhered to the main body member 22 so as to cover the opening on the one side surface of the main body member 22. Specifically, as illustrated in FIG. 13, the sheet member 291 is adhered, in an airtight manner, to an end surface 22*t* forming an opening of the main body member 22, and to an end surface 22*p* of a rib inside the liquid containing unit 200. This forms the liquid containing unit 200 for containing the ink. That is, the liquid containing unit 200 is formed from the sheet member 291 which is variable in a portion of a wall portion dividing an internal space. This enables the liquid containing unit 200 to have a changeable volume. Further, in FIG. 13, in order to facilitate understanding, a portion to which the sheet member 291 is adhered is indicated by cross hatching and a portion in which the liquid containing unit 200 is formed is indicated by single hatching.

In addition, as illustrated in FIG. 13, the lid member 24 is attached to a further outside area than the area to which the sheet member 291 is adhered, in an end surface of the main body member 22 in the +Y axis direction side. Then, a first communication chamber 242 which is a portion of a communication path communicating the inside and outside of the liquid supply portionliquid supply portion 280 is formed on the further outside area than the area where the liquid containing unit 200 is formed, in the main body member 22.

A space is formed between the sheet member 291 and the lid member 24. The space forms a portion of the communication path communicating the inside and outside the liquid supply portionliquid supply portion 280.

The pressure plate 293 is formed of the synthetic resins such as polypropylene. The pressure plate 293 is arranged in contact with the sheet member 291. The coil spring 294 is arranged inside the liquid containing unit 200. Specifically, the coil spring 294 is in contact with the pressure plate 293 and a surface (an opposing surface) opposing the pressure plate 293 in surfaces of the main body member 22. The coil spring 294 is biased the pressure plate 293 in the direction to which the volume of the liquid containing unit 200 expands. The coil spring 294 expands and contracts (moves) along the Y axis direction.

The valve mechanism 40 is a mechanism for intermittently introducing the air into the liquid containing unit 200 with the ink of the liquid containing unit 200 being consumed. As illustrated in FIG. 12, the valve mechanism 40 includes a spring member 42, a lever valve 44 and a cover valve 46. The cover valve 46 is contained in a corner portion 209 (refer to FIG. 13) where the fifth surface 205 and the second surface 202 are crossing and attached to the main body member 22. The cover valve 46 is formed of the synthetic resins such as polypropylene, for example. The cover valve 46 has a concave shape, where the sheet member 291 is adhered to an end surface 41 forming an opening in the airtight manner. The concave portion of the cover valve 46 communicates with the ventilation port 292. In addition, the through hole 47 passing through a rear side of the cover valve 46 is formed at a bottom portion of the concave portion of the cover valve 46.

The lever valve 44 is pressed against the cover valve 46 by the spring member 42 to close the through hole 47. The lever valve 44 has a portion which is brought into contact when the pressure plate 293 is displaced. The lever valve 44, for example, may be formed of the synthetic resins such as polypropylene. In addition, the lever valve 44 may be molded in two colors using an elastic member such as elastomer and the synthetic resins such as polypropylene.

The liquid supply portionliquid supply portion 280 communicates with the liquid containing unit 200. As illustrated in FIG. 12, the liquid supply portionliquid supply portion 280, inside thereof, includes a supplying member 30. The supplying member 30 includes a pressing member 35, a form (a porous member) 34 and a sheet member (a filter member) 36. The pressing member 35, the form 34 and the sheet member 36 are arranged in order from one end portion 37*b* of the liquid supply portionliquid supply portion 280 toward the other end portion 37*a*. The pressing member 35 is formed of metal, for example. The pressing member 35 has a spring portion 35*a* and the form 34 is biased (pressed) downward (the −Z axis direction) using the spring portion 35*a*. The form 34 and the sheet member 36, for example, are formed of the synthetic resins such as polyethylene-telephthalate. The sheet member 36 comes into contact with the liquid supply tube 640 (refer to FIG. 2) in the mounted state, and circulates the ink to the printer 50 side. That is, the sheet member 36 forms the liquid outflow portion 31.

A-5. Operation of Communication Path and Cartridge 20

Figure 14:
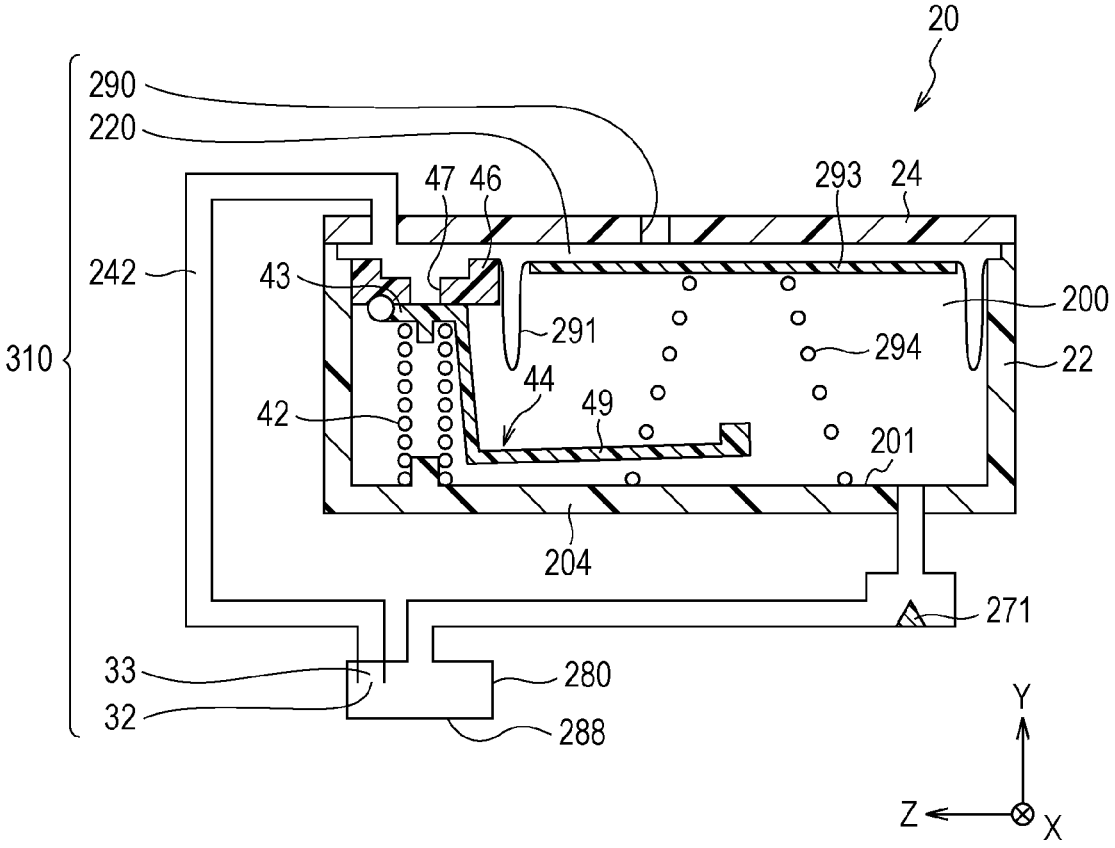
FIG. 14 is a first view illustrating an operation of a cartridge.
Figure 15:
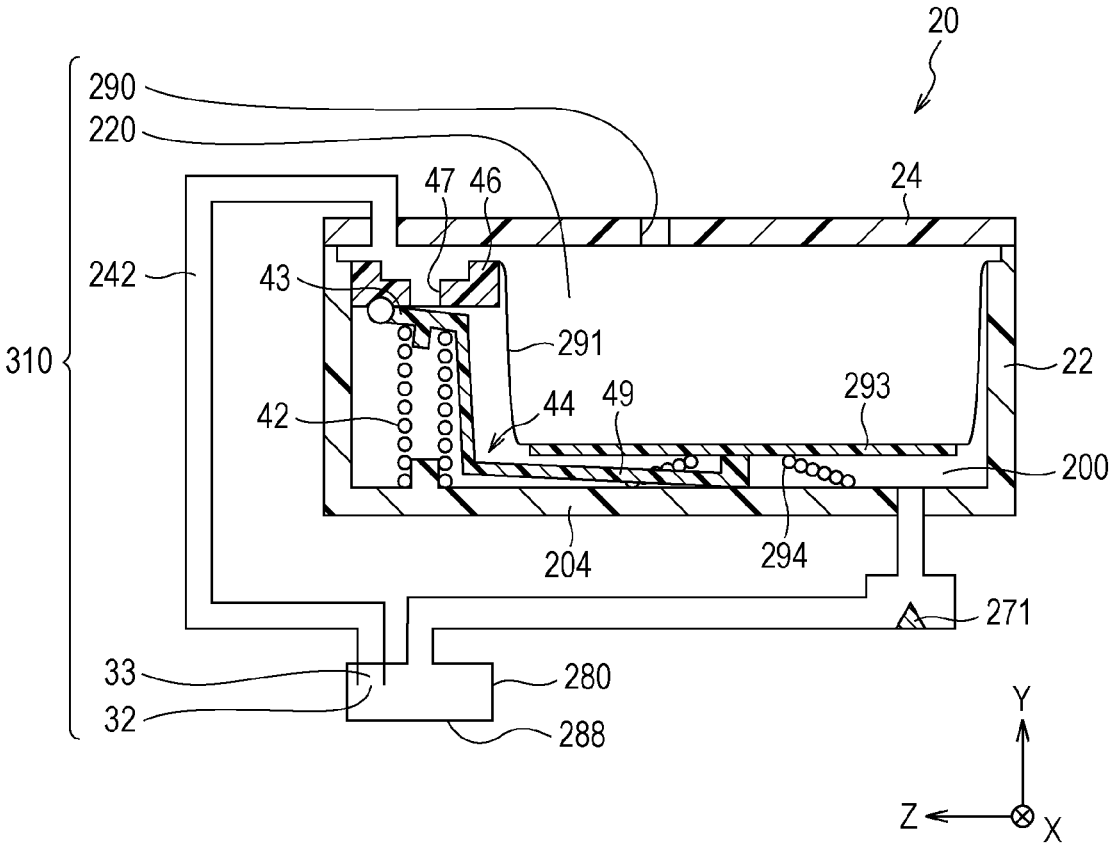
FIG. 15 is a first view illustrating an operation of a cartridge.
Figure 16:
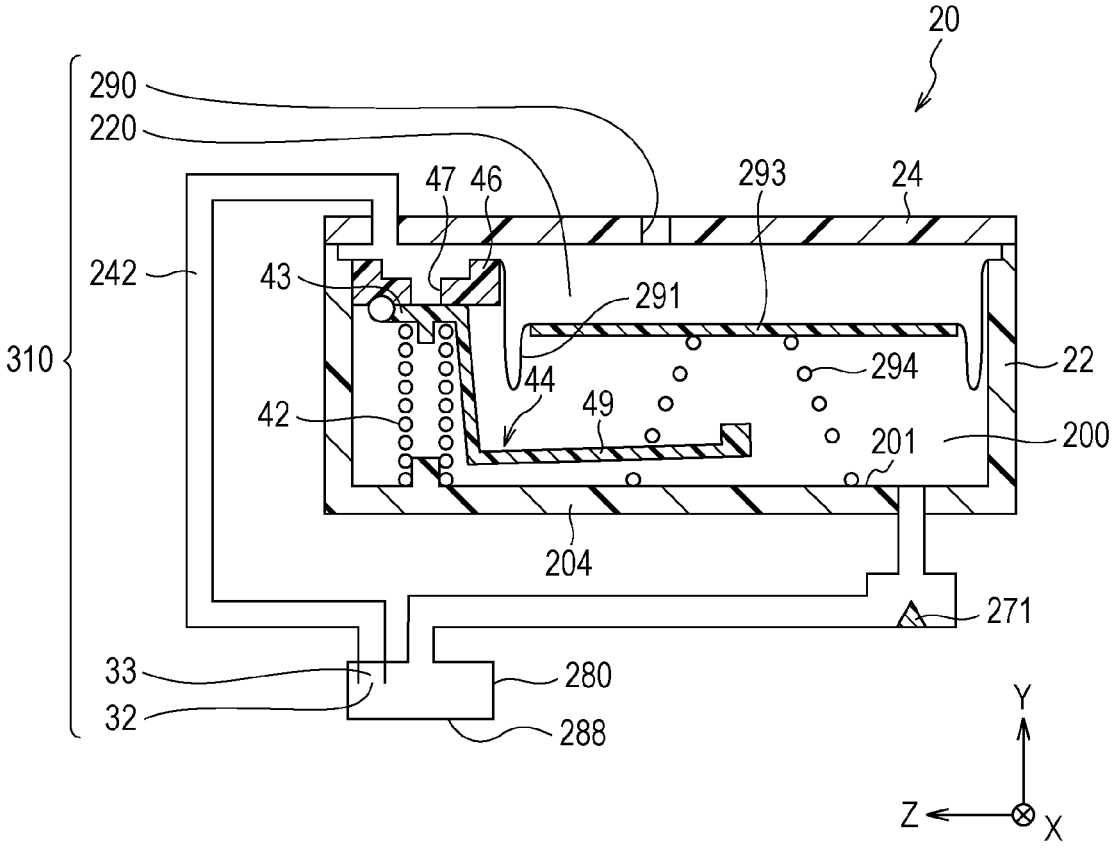
FIG. 16 is a first view illustrating an operation of a cartridge.

FIG. 14 is a first view for illustrating an operation of the cartridge 20. FIG. 15 is a second view for illustrating the operation of the cartridge 20. FIG. 16 is a third view for illustrating the operation of the cartridge 20. Further, FIGS. 14 to 16 are schematic views for illustrating an inner state of the cartridge 20 so as to be easily understood.

Before describing the operation of the cartridge 20, a communication path 310 will be described which communicates between the inside and outside of the liquid supply portionliquid supply portion 280. In the communication path 310, one end portion is the communication port 32 and the other end portion is the air introduction port 290. The communication path 310 sequentially includes one end side flow path 33, a first communication chamber 242 and an air chamber 220 in the middle thereof in the flowing direction of the liquid from the communication port 32 toward the air introduction port 290. The one end side flow path 33 is formed inside the liquid supply portionliquid supply portion 280. The air chamber 220 is a space between the lid member 24 and the sheet member 291.

In this manner, the cartridge 20 includes the communication path 310, which can inhibit a pressure inside the liquid supply portionliquid supply portion 280 (specifically, a portion including the opening 288 in the liquid supply portionliquid supply portion 280, where the air is present) from being extremely different from the outside pressure.

For example, when the cartridge 20 is mounted on the printer 50 (during the mounting operation), the elastic member 648 (refer to FIG. 2) of the holder 60 tightly closes the periphery of the opening 288 of the liquid supply portionliquid supply portion 280. Here, when tightly closing the periphery of the opening 288, a portion of the elastic member 648 cuts into the liquid supply portionliquid supply portion 280, which causes the volume inside the liquid supply portionliquid supply portion 280 to be decreased and the pressure inside the liquid supply portionliquid supply portion 280 to be increased. In general, the flow path from the liquid containing unit 200 to the liquid outflow portion 31 includes a portion having a high flow path resistance such that the ink may not leak out from the liquid outflow portion 31. In the embodiment, for example, a meniscus of the liquid is formed and the flow path resistance is increased using the sheet member 36 and the form 34 which can maintain the liquid. Accordingly, in a state directly after the periphery of the opening 288 is tightly closed and the volume inside the liquid supply portionliquid supply portion 280 is decreased, the air is not sufficiently circulated in the liquid containing unit 200 by the decreased amount. However, the decreased amount of the air is allowed to escape outward using the communication path 310, which enables the pressures outside and inside the liquid supply portionliquid supply portion 280 to be substantially constantly maintained.

If the communication path 310 is not disposed in the cartridge 20, for example, compressed air inside the liquid supply portionliquid supply portion 280 gradually flows in the liquid containing unit 200 after mounting the cartridge 20. This causes unexpected air to infiltrate into the liquid containing unit 200 and thereby there occurs a possibility that the pressure inside the liquid containing unit 200 may not be maintained within a proper pressure range. In addition, for example, if the air inside the liquid supply portionliquid supply portion 280 flows in the liquid containing unit 200 unslan- the increased pressure inside the liquid supply portionliquid supply portion 280 and the pressure inside the liquid containing unit 200 are kept balanced, the pressure inside the liquid containing unit 200 is increased compared to a state before the air flows in. In a case where the cartridge 20 is detached from the holder 60 in this state, the pressure inside the liquid supply portionliquid supply portion 280 becomes an atmospheric pressure. That is, the pressure inside the liquid supply portionliquid supply portion 280 is decreased, and thereby the ink is caused to leak out from the liquid containing unit 200 having the high pressure via the supplying member 30.

In addition, for example, during the non-use of the cartridge 20, there is a case where a cover (film or cap) for closing the opening 288 is attached to the opening 288 in order to inhibit the ink from leaking out. In addition, during the non-use of the cartridge 20, there is a case where the cartridge 20 is contained in a packing pack decompressed to a lower pressure than the atmospheric pressure. If the cartridge 20 is contained in the packing pack and then the inside of the packing pack is decompressed in a state of the cover being attached, the air chamber 220 is also decompressed. Then, an absolute value of a negative pressure inside the liquid containing unit 200 is increased (that is, it becomes a more negative pressure). On the other hand, the inside of the liquid supply portionliquid supply portion 280 maintains the atmospheric pressure immediately after the pack is decompressed since the inside is a space inhibiting gasses from circulating to and from the outside. This causes an unbalance in pressures inside the liquid supply portionliquid supply portion 280 and inside the liquid containing unit 200, and the air gradually flows in the liquid containing unit 200 from the inside of the liquid supply portionliquid supply portion 280. In addition, if the cartridge 20 is detached from the decompressed pack, the air chamber 220 returns to have the atmospheric pressure and the absolute value of the negative pressure inside the liquid containing unit 200 is decreased (it becomes to have the initially set negative pressure). On the other hand, the inside of the liquid supply portionliquid supply portion 280 maintains the decompressed state, which gives rise to a possibility that the ink may leak out from the liquid containing unit 200 to the liquid supply portionliquid supply portion 280 side.

Next, an operation of the cartridge 20 will be described. As illustrated in FIG. 14, the lever valve 44 includes a valve portion 43 for closing the through hole 47, and a lever portion 49 for opening and closing the valve portion 43. During the non-use of the cartridge 20 (a brand-new state), the liquid containing unit 200 is filled with the ink. In this state, the valve portion 43 of the lever valve 44 is biased by the spring member 42 to close the through hole 47. In addition, the coil spring 294 biases the pressure plate 293 in the direction (the +Y axis direction) to which the volume of the liquid containing unit 200 expands. This allows the pressure inside the liquid containing unit 200 to be maintained with the lower pressure (negative pressure) than the atmospheric pressure.

As illustrated in FIG. 15, if the ink of the liquid containing unit 200 is consumed and the pressure plate 293 comes close to the fourth surface 204 side, the pressure plate 293 presses the lever portion 49 to the fourth surface 204 side. This causes the valve portion 43 to be separated from the through hole 47 and thereby the outside air temporarily communicates with the liquid containing unit 200. That is, the lever valve 44 is in an open state of the valve. Then, the outside air flows in the liquid containing unit 200 through the air introduction port 290, the air chamber 220, the ventilation port 292 and the through hole 47. This causes the volume of the liquid containing unit 200 to be increased by an introduced amount of air as illustrated in FIG. 16. At the same time, the negative pressure inside the liquid containing unit 200 is a little decreased (comes close to the atmospheric pressure). Then, as illustrated in FIG. 16, if a certain amount of the air is introduced into the liquid containing unit 200, the pressure plate 293 is separated from the lever portion 49. This causes the valve portion 43 to close the through hole 47 again. That is, the lever valve 44 is in a closed state of the valve. In this manner, if the negative pressure inside the liquid containing unit 200 becomes high with the ink being consumed in the liquid containing unit 200, the lever valve 44 is primarily in the open state of the valve, whereby enabling the pressure inside the liquid containing unit 200 to be maintained in a proper pressure range.

A-6. Configuration of Cap

Figure 17:
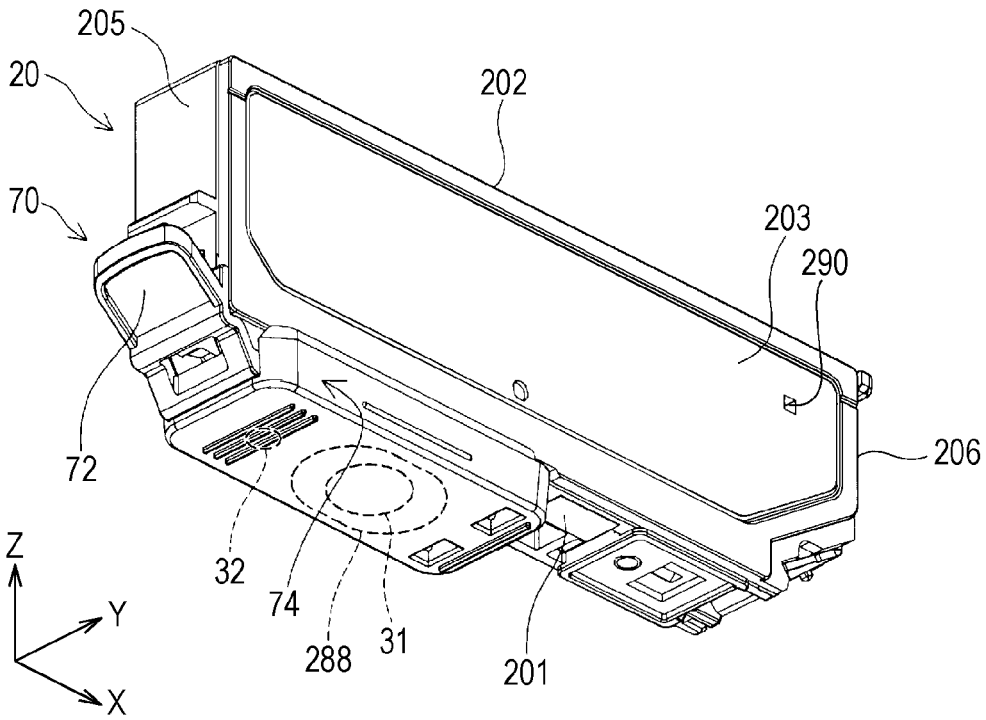
FIG. 17 is a perspective view of a cartridge to which a cap is attached.

FIG. 17 is a perspective view of the cartridge 20 on which a cap is mounted. Further, the cartridge 20 in FIG. 17 represents a state of being detached from the holder 60. In a state where the cartridge 20 is detached from the holder 60, a cap 70 is attached to be attachable to and detachable from the cartridge 20 so as to cover the opening 288 of the liquid supply portionliquid supply portion 280. Further, the cap 70 is detached from the cartridge 20 before the cartridge 20 is mounted on the holder 60. The cap 70 includes a cap main body 74 for covering the opening 288 and a cap lever 72 as the lever used in detaching the cap 70 from the cartridge 20. When the cartridge 20 is mounted on the holder 60, users grip the cap lever 72 to detach the cap from the cartridge 20. As illustrated in FIG. 17, the cap lever 72 protrudes outward from an outer surface of the cartridge 20. Specifically, the cap lever 72 protrudes outward (the −X axis direction side) from the fifth surface 205. Here, the cap lever 72 and the communication port 32 are located at the same side (the −X axis direction side) with respect to the liquid outflow portion 31. Further, in the embodiment, the cap lever 72 may be omitted.

Figure 18:
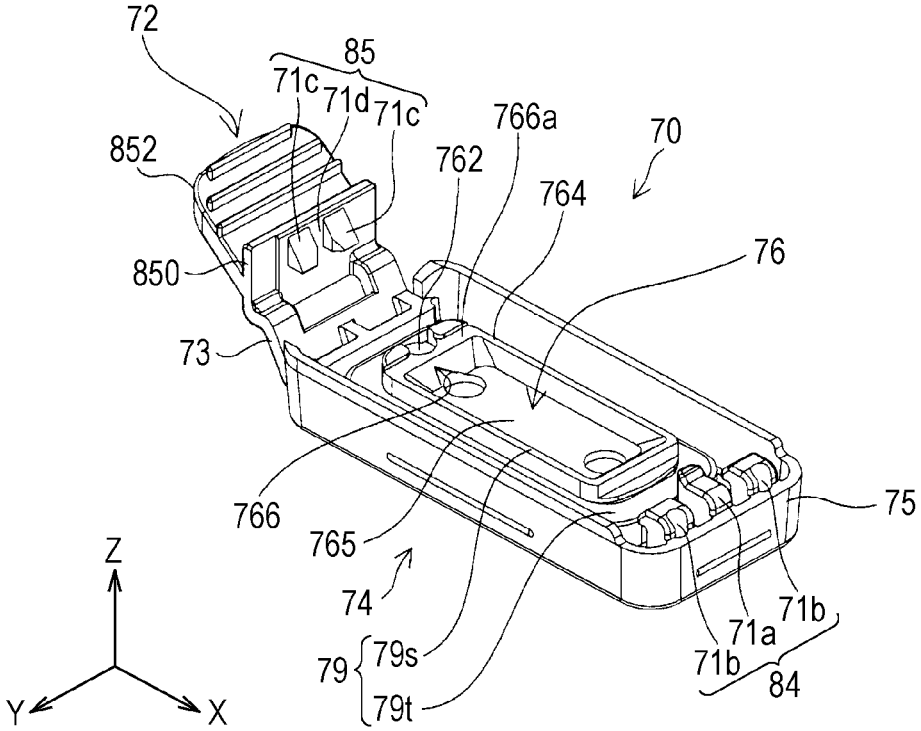
FIG. 18 is a first perspective view of a cap.
Figure 19:
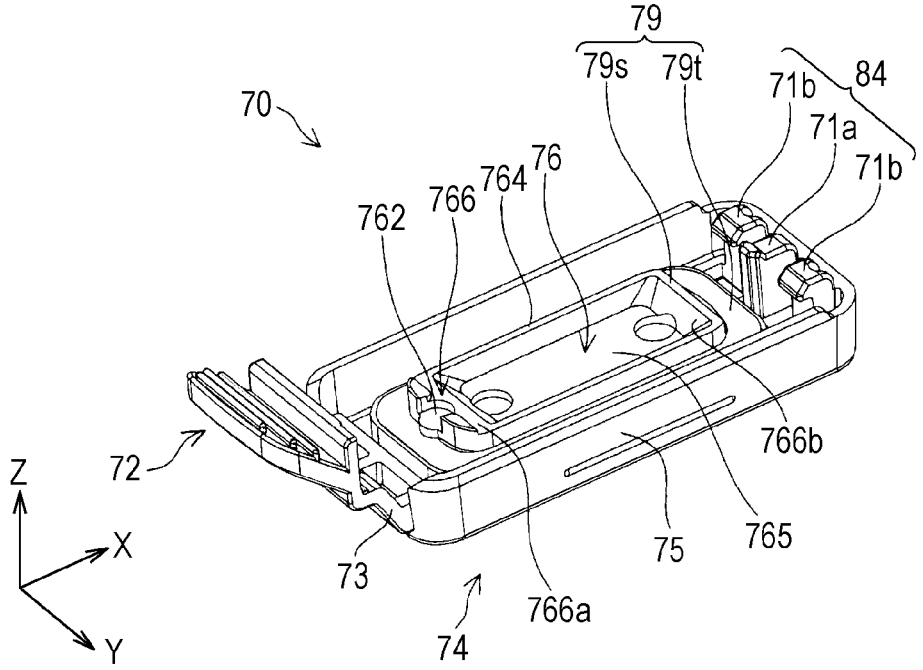
FIG. 19 is a second perspective view of a cap.
Figure 20:
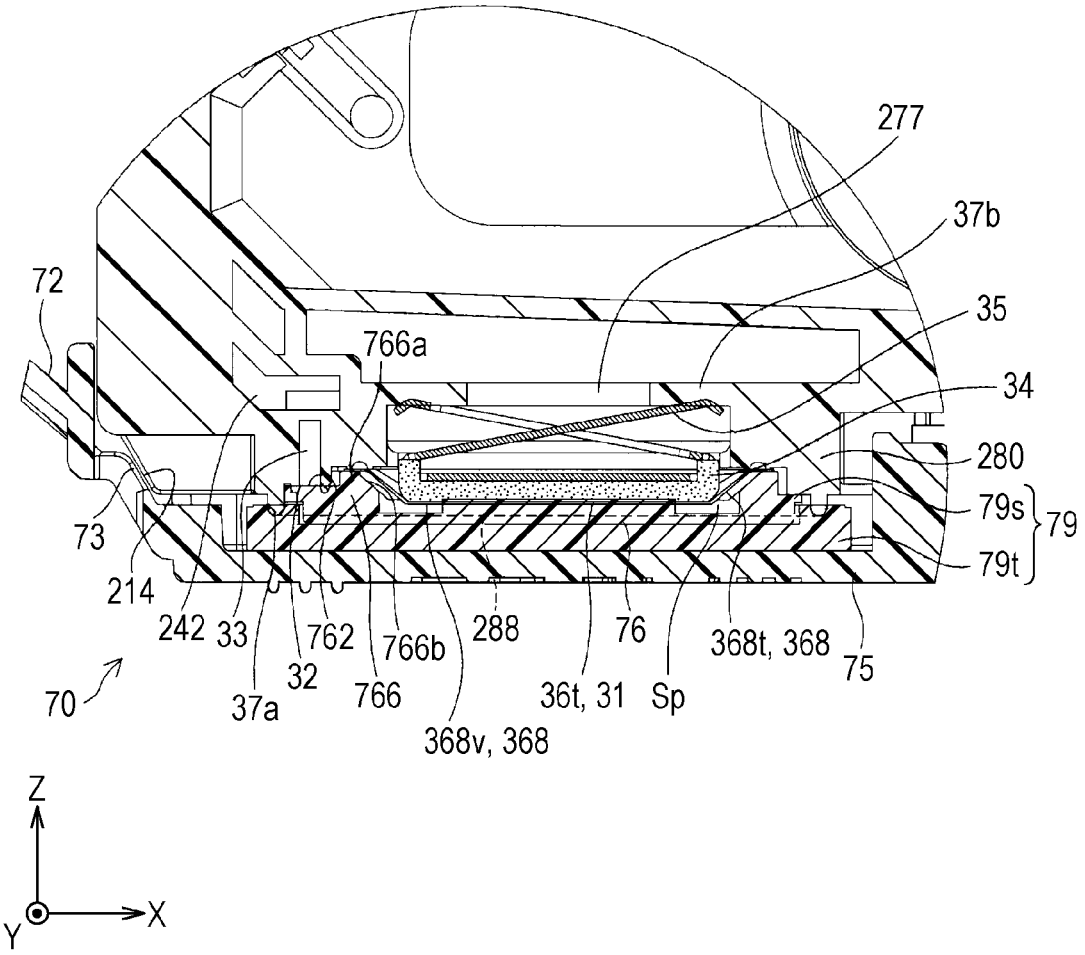
FIG. 20 is a partial cross-sectional view of a cartridge.

FIG. 18 is a first perspective view of the cap 70. FIG. 19 is a second perspective view of the cap 70. FIG. 20 is a partial cross-sectional view of the cartridge 20 on which the cap 70 is mounted. Further, FIG. 20 illustrates a portion of the cross-section along the line XX-XX in FIG. 10.

As illustrated in FIGS. 18 and 19, the cap main body 74 includes a base portion 75 with a concave shape and a first cap member 79 for covering the opening 288 by being arranged at a bottom portion of the base portion 75 and coming into close contact with the other end portion 37*a* of the cartridge 20. The first cap member 79 is formed of elastomer or the like, which provides the elasticity. In addition, the base portion 75 and the cap lever 72 are formed of the synthetic resins such as polypropylene.

The base portion 75 includes a first engagement portion 84. The first engagement portion 84 is arranged at an opposite side (the +X axis direction side) end portion to a side connecting to the cap lever 72 in the base portion 75. The first engagement portion 84 is configured to have an insertion piece 71*a* and a pair of first projections 71*b* that sandwich the insertion piece 71*a* and that are arranged with a spaced interval therebetween in the Y axis direction. The first projections 71*b* have portions protruding inward to the base portion 75 (in other words, in the direction toward the cap lever 72). The insertion piece 71*a* is arranged between a pair of the first projections 71*b*. Similar to a pair of the first projections 71*b*, the insertion piece 71*a* has a portion protruding inward to the base portion 75 (in other words, in the direction toward the cap lever 72). A pair of the first projections 71*b* is locked by the first container locking portion 331. Specifically, in a case where the cap 70 is mounted on the cartridge 20, a portion of a pair of the first projections 71*b* is inserted to the first container locking portion 331 of the cartridge 20 and the first projections 71*b* are locked by the first container locking portion 331. This performs the positioning of the cap 70 with respect to the cartridge 20 in the X axis direction (the longitudinal direction of the first surface 201 of the cartridge 20). Specifically, if the cap 70 attempts to move with respect to the cartridge 20 in the −X axis direction in a state where the cap 70 is mounted on the cartridge 20, the first container locking portion 331 abuts against the first projections 71*b*, which regulates a movement thereof in the −X axis direction. Further, the insertion piece 71*a* crosses the above-described plane CX (refer to FIGS. 8 and 11) in a state where the cap 70 is mounted on the cartridge 20.

When the insertion piece 71*a* is accepted by the container acceptance portion 333, the positioning of the cap 70 is performed with respect to the cartridge 20 in the Y axis direction of the cap 70 (the short direction of the first surface 201 of the cartridge 20). Specifically, if the cap 70 attempts to move with respect to the cartridge 20 in the Y axis direction in a state where the cap 70 is mounted on the cartridge 20, the cap 70 (specifically, the surface formed from a pair of the first container locking portions 331) abuts against the container acceptance portion 333, which regulates a movement thereof in the Y axis direction.

Here, in a state where the cap 70 is mounted on the cartridge 20, the insertion piece 71*a* is formed so as to protrude longer along the direction (the −X axis direction) from the sixth surface 206 toward the fifth surface 205, compared to a pair of the first projections 71*b*. In this manner, when the cap 70 is mounted on the cartridge 20, the positioning can be performed by engaging the insertion piece 71*a* first in the first engagement portion 84 with the first container side engagement portionengagement portion 330 (the container acceptance portion 333) of the cartridge 20. Accordingly, thereafter, when two of the first projections 71*b* which are shorter than the insertion piece 71*a* in the −X axis direction are engaged with the first container side engagement portionengagement portion 330 (the first container locking portion 331) of the cartridge 20, the engagement can be easily performed.

The cap lever 72 includes a connection portion 73 extending obliquely along a predetermined direction between the X axis direction and the +Z axis direction, an erected portion 850 connected to the connection portion 73 and extending in the +Z axis direction, and a manipulation portion 852 connected to the erected portion 850 and extending obliquely along a predetermined direction between the X axis direction and the +Z axis direction. The above-described "extending obliquely", in other words, means that it is arranged to be slanted at a predetermined angle with respect to the base portion 75 (an acceptance portion 76 to be described later). The connection portion 73, in the base portion 75, is connected to the opposite side (the −X axis direction side) to the side having the insertion piece 71*a* and a pair of the first projections 71*b*. The manipulation portion 852 functions as a projection gripped by users' fingers, when the cap 70 is detached from the cartridge 20.

The erected portion 850 has a thin plate shape and connects the connection portion 73 and the manipulation portion 852, being arranged to protrude in the +Z axis direction. The erected portion 850 opposes the fifth surface 205 of the cartridge 20 in a state where the cap 70 is mounted on the cartridge 20. A second engagement portion 85 is formed close to an end portion of the erected portion 850 in the +Z axis direction. The second engagement portion 85 includes a positioning portion 71*d* and a pair of second projections 71*c* sandwiching the positioning portion 71*d* and arranged with a spaced interval therebetween in the Y axis direction. The positioning portion 71*d* is configured as a concave portion formed between a pair of the second projections 71*c*. A pair of the second projections 71*c* has appearances with convex shapes respectively protruding in the +X axis direction, and is respectively arranged with a spaced interval by the length of the positioning portion 71*d* in the Y axis direction. In a state where the cap 70 is mounted on the cartridge 20, a pair of the second projections 71*c* is inserted to corresponding concave portions 207 disposed on the fifth surface 205 of the cartridge 20. In addition, in a state where the cap 70 is mounted on the cartridge 20, a convex portion 213 disposed on the fifth surface 205 of the cartridge 20 is inserted to the positioning portion 71*d*. This brings a second arrangement member 79*t* into contact with the other end portion 37*a* forming the opening 288 of the cartridge 20 in an airtight manner to seal (cap) the opening 288. The positioning portion 71*d* crosses the above-described plane CX in a state where the cap 70 is mounted on the cartridge 20.

As illustrated in FIG. 20, in a state where the cap 70 is mounted on the cartridge 20, the connection portion 73 is arranged slanting along the slanted portion 214. In general, similarly to the slanted portion 214, a portion corresponding to a surface-to-surface (the first surface 201 and the fifth surface 205) boundary (a corner) is likely to weaken. Therefore, in a state where the cap 70 is mounted on the cartridge 20, the connection portion 73 is configured to be previously slanted so as to be arranged along the slanted portion 214. This allows the slanted portion 214 to be reinforced using the connection portion 73. In addition, since the connection portion 73 is configured to be previously slanted so as to be arranged along the slanted portion 214, the connection portion 73 can be used in positioning when the cap 70 is mounted on the cartridge 20. More specifically, when the cap 70 is mounted on the cartridge 20, the connection portion 73 comes into contact with slanted portion 214, which regulates a deviation of the cap 70 in the +X axis direction. For this reason, the cap 70 can be mounted on the cartridge 20 without being deviated, which can inhibit the ink flowing out of the liquid outflow portion 31 from leaking out from the cap 70.

As illustrated in FIGS. 18 to 20, the first cap member 79 has a sealing portion 762 and an acceptance portion 76. The sealing portion 762 covers the communication port 32 in a state where the cap 70 is mounted on the cartridge 20. The acceptance portion 76 accepts the liquid outflow portion 31 (the sheet member 36) in a state where the cap 70 is mounted on the cartridge 20. The acceptance portion 76 has a concave shape.

The first cap member 79 further has a cap stepped portion 766 as a second stepped portion, which is located between the sealing portion 762 and the acceptance portion 76. The cap stepped portion 766 is formed using a peripheral edge portion 764 of the acceptance portion 76. The cap stepped portion 766 includes a convex portion 766*a*. The convex portion 766*a* extends to one end portion 37*b* side (the +Z axis direction) rather than a bottom portion 765 of the acceptance portion 76 or the sealing portion 762.

As illustrated in FIG. 20, in a state where the cap 70 is mounted on the cartridge 20, the acceptance portion 76 comes into contact with at least a portion of a sheet central portion 368. In addition, the peripheral edge portion 764 has an opposing portion 766*b* slanting along the direction to which the slanted portion 368*t* of the liquid outflow portion 31 slants. The opposing portion 766*b* is formed across the peripheral direction of the peripheral edge portion 764. In other words, the opposing portion 766*b* is erected from the peripheral edge of the bottom portion 765 of the acceptance portion 76. Here, it is not necessary to have the same slanting angle with respect to the first direction (the −Z axis direction) between the slanted portion 368*t* and the opposing portion 766*b*, but they may be slanted in the same direction. In the embodiment, the slanted portion 368*t* and the opposing portion 766*b* have mutually opposing surfaces which are substantially parallel to each other.

Further, as illustrated in FIG. 20, the first cap member 79 includes a first arrangement member 79*s* forming the acceptance portion 76 and the sealing portion 762, and a second arrangement member 79*t* coming into contact with the other end portion 37*a*.

The above-described cap 70 corresponds to a cover in claims. In addition, the prism unit 270 corresponds to a detecting member in claims, the first engagement portion 84 to a first cover side engagement portionengagement portion in claims, the acceptance portion 76 to a portion of the cover in claims, the second container side engagement portionengagement portion 212 to a second container side engagement portionengagement portion in claims, the insertion piece 71*a* to a first positioning portion in claims, the first container locking portion 331 to a first concave portion in claims, the first projection 71*b* to a first convex portion in claims, the positioning portion 71*d* to a second positioning portion in claims, the second engagement portion 85 to a second cover side engagement portionengagement portion in claims, the concave portion 207 to a second concave portion in claims, the convex portion 213 to a second convex portion in claims, the second projection 71*c* to a third convex portion in claims, the second locking portion 221 to a liquid ejecting apparatus positioning portion, and the thickness slimmer 216 to a fourth surface side concave portion respectively.

A-7. Advantageous Effect

In the first embodiment described above, the cap 70 covers the opening 288 of the cartridge 20 in a mounted state on the cartridge 20. This can decrease a possibility that the ink may leak out from the opening 288 during the transportation of the cartridge 20. In addition, the communication port 32 and the cap lever 72 are located at the same side with respect to the liquid outflow portion 31. This causes an unstable posture even when users attempt to place the cartridge 20 on a predetermined surface in a state where the cap lever 72 is pulled down. Accordingly, it is possible to prevent the cartridge 20 from being placed on a predetermined surface in a state where the cap lever 72 is pulled down. This can decrease a possibility that the ink leaking out may reach the communication port 32 even in a case where the ink leaks out from the liquid outflow portion 31. In addition, the cap 70 has a sealing portion 762. This can decrease a possibility that the ink may flow in the communication path 310 via the communication port 32.

In addition, the cap 70 has the cap stepped portion 766. This can decrease a possibility that the ink may reach the sealing portion 762 through the acceptance portion 76 since the cap stepped portion can hinder the circulation of the ink. Here, the cap stepped portion 766 is formed using the peripheral edge portion 764 of the acceptance portion 76. This eliminates a need to dispose a member for disposing steps separately. In addition, the cap stepped portion 766 can be easily formed using the peripheral edge portion 764 in such a manner that the acceptance portion 76 is made to have a concave shape and the sealing portion 762 is arranged outside the acceptance portion 76.

In addition, the opposing portion 766*b* of the cap 70 slants along the direction to which the slanted portion 368*t* of the liquid outflow portion 31 is slanting. This enables a decreased volume of an inner chamber Sp containing the air formed by the liquid supply portionliquid supply portion 280 and the cap 70. This can limit an amount of the air flowing in the liquid containing unit 200 via the liquid outflow portion 31, when the cap 70 is mounted on the cartridge 20, even in a case where the inner chamber Sp is compressed and thereby the air of the inner chamber Sp reversely flows in the liquid containing unit 200. Here, the inner chamber Sp is a space located at the opening 288 side (downstream side) rather than the liquid outflow portion 31, in a space formed using the liquid supply portionliquid supply portion 280 and the cap 70. In addition, here, the upstream side and the downstream side are referenced by the flowing direction of the liquid flowing from one end portion 37*b* of the liquid supply portionliquid supply portion 280 to the other end portion 37*a*.

In addition, the acceptance portion 76 can further decrease the volume of the inner chamber Sp where the air is present by coming into contact with at least a portion of the sheet central portion 368. This can further limit the volume of the air flowing in the liquid containing unit 200 from the inner chamber Sp via the liquid outflow portion 31.

In addition, the cap 70 has the opposing portion 766*b* which slants corresponding to the direction to which the slanted portion 368*t* is slanting (refer to FIG. 20). The opposing portion 766*b* is formed using the peripheral edge portion (the cap stepped portion 766) of the acceptance portion 76. Since there is the opposing portion 766*b*, it is possible to decrease a possibility that the ink leaking out from the liquid outflow portion 31 may flow out from the cap 70. In other words, the cap 70 has the cap stepped portion 766 erected to the liquid outflow portion side (the +Z axis direction) from a peripheral edge of an opposing surface to the liquid outflow portion 31. This can maintain the ink inside the acceptance portion 76 even in a case where the ink leaking out from the liquid outflow portion 31 flows smearing the opposing surface to the liquid outflow portion 31 inside the cap 70. Accordingly, it is possible to inhibit the ink from flowing further outward from the acceptance portion 76.

In addition, the first engagement portion 84 and the second engagement portion 85 have a function of engaging the cap 70 with the cartridge 20 and a function of positioning the cap 70 in an apparatus with respect to the cartridge 20. Therefore, since the cap 70 can be reliably (without being deviated) mounted on the cartridge 20, the opening 288 can be reliably covered using the cap 70. In addition, this can decrease a possibility that the liquid outflow portion 31 is accepted by the acceptance portion 76 and the ink may flow further outward from the acceptance portion 76, and a possibility that the ink may evaporate from the liquid outflow portion 31.

In addition, the first container side engagement portionengagement portion 330 which is an engagement destination for the first engagement portion 84 in the cartridge 20 is arranged between the prism unit 270 (the transmission surface 275) in the first surface 201 and the liquid supply portionliquid supply portion 280. Therefore, even in a case where the ink leaks outward from the acceptance portion 76, the ink is blocked by the engagement portion of the first engagement portion 84 with the first container side engagement portionengagement portion 330, which can inhibit the ink from flowing out to the transmission surface 275 side (the +X axis direction). For this reason, it is possible to inhibit the transmission surface 275 from getting filthy due to the ink.

In addition, in a state where the cap 70 is mounted on the cartridge 20, the insertion piece 71*a* of the cap 70 passes through the center C of the opening 288 of the liquid supply portionliquid supply portion 280 in the Y axis direction (the width direction) and crosses the surface (the plane CX) in parallel to the X axis and the Z axis. In addition, the insertion piece 71*a* is inserted to the container acceptance portion 333 formed on the first surface 201. This enables the reliable positioning in the mounting position of the cap 70 and the cartridge 20 in the width direction.

In addition, in a state where the cap 70 is mounted on the cartridge 20, the positioning portion 71*d* of the cap 70 passes through the center C of the opening 288 of the liquid supply portionliquid supply portion 280 in the Y axis direction (the width direction) and crosses the surface (the plane CX) in parallel to the X axis and the Z axis. In addition, the convex portion 213 formed on the fifth surface 205 is inserted to the positioning portion 71*d*. This enables the reliable positioning in the mounting position of the cap 70 and the cartridge 20 in the width direction.

In addition, in a state where the cap 70 is mounted on the cartridge 20, the connection portion 73 is formed to be previously slanted (slanted with respect to the base portion 75) so as to be arranged along the slanted portion 214. Therefore, in a state where the cap 70 is mounted on the cartridge 20, the connection portion 73 can reinforce the slanted portion 214. Additionally, when the cap 70 is mounted on the cartridge 20, the connection portion 73 comes into contact with the slanted portion 214, which can regulate the deviation of the cap 70 in the +X axis direction. Therefore, since the cap 70 can be reliably mounted on the cartridge 20 without being deviated, it is possible to inhibit the ink flowing out of the liquid outflow portion 31 from leaking out from the cap 70.

In addition, in the first engagement portion 84, the insertion piece 71*a* is configured to be longer along the −X axis direction (in a state where the cap 70 is mounted on the cartridge 20, the direction from the sixth surface 206 toward the fifth surface 205), compared to the two of the first projections 71*b* which are adjacent to each other. For this reason, when the cap 70 is mounted on the cartridge 20, it is possible to perform the positioning by firstly engaging the insertion piece 71*a* with the first container side engagement portionengagement portion 330 (the container acceptance portion 333). Accordingly, thereafter, when two of the first projections 71*b* are engaged with the first container side engagement portionengagement portion 330 (the first container locking portion 331), the engagement can be easily performed.

B. Second Embodiment

B-1. Configuration of Cartridge

Figure 21:
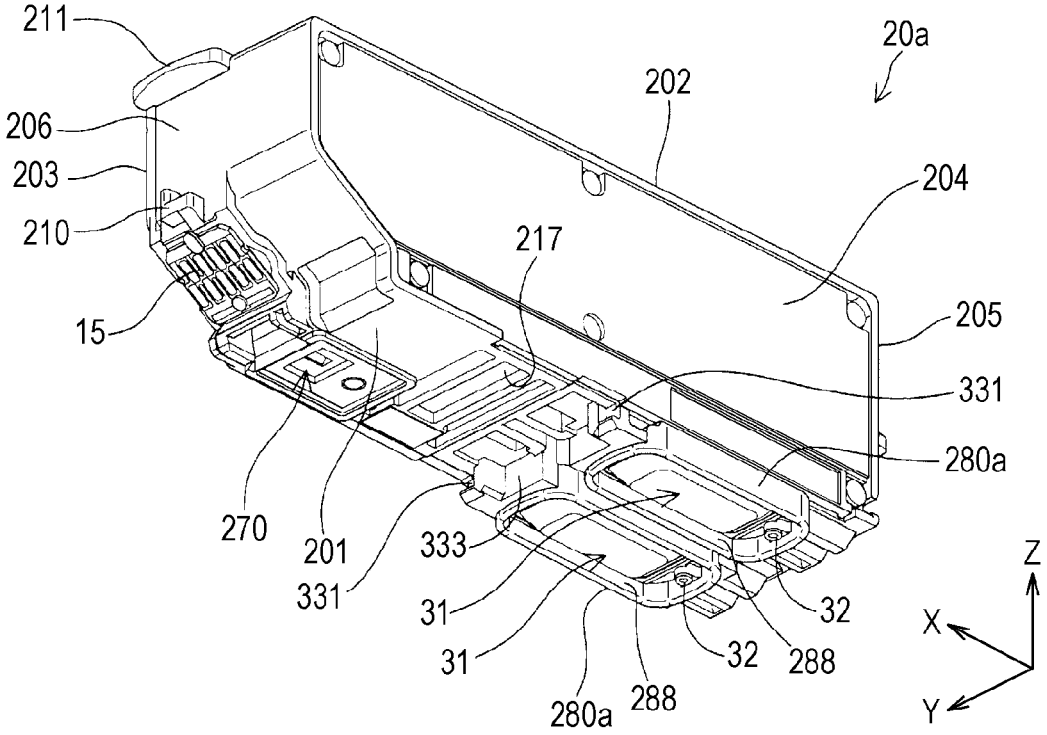
FIG. 21 is a perspective view of a cartridge in a second embodiment.
Figure 22:
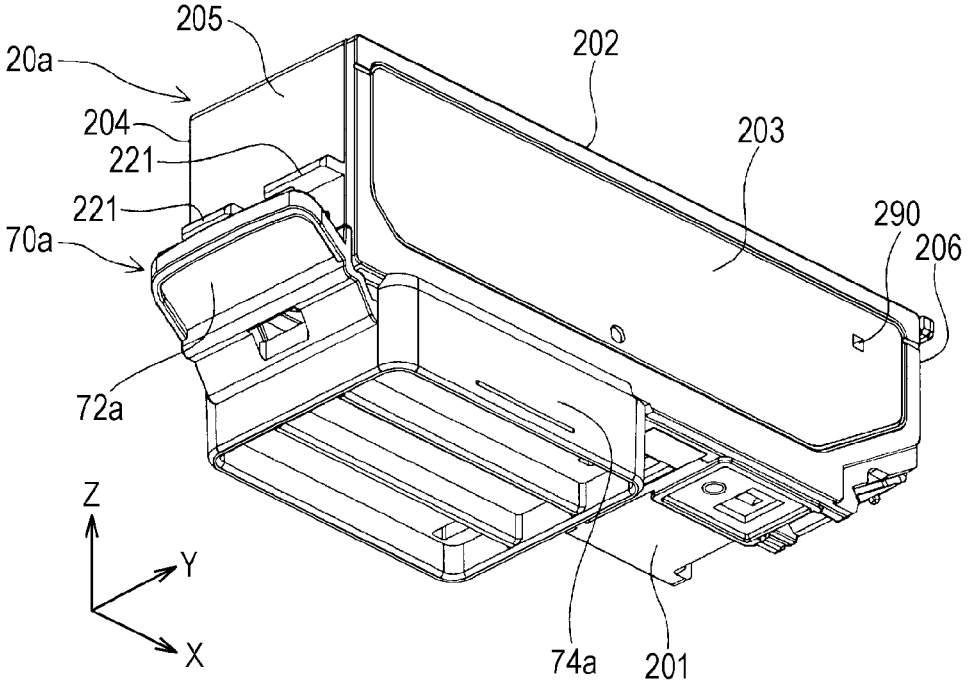
FIG. 22 is a perspective view of a cartridge on which a cap in a second embodiment is mounted.

FIG. 21 is a perspective view of a cartridge 20*a* in a second embodiment. FIG. 22 is a perspective view of the cartridge 20*a* on which a cap 70*a* of the second embodiment is mounted. The cartridge 20*a* of the second embodiment has a larger dimension in the Y axis direction than the cartridge 20 in the first embodiment. The cartridge 20*a* is mounted on the holder 60 using two slots of the holder 60 (refer to FIGS. 2 and 3). The cartridge 20*a* can contain a larger amount of ink than the cartridge 20 in the first embodiment.

As illustrated in FIG. 21, the cartridge 20*a* has two liquid supply portionliquid supply portions 280*a* protruding from the first surface 201. The two liquid supply portionliquid supply portions 280*a* respectively have the same configuration as the liquid supply portionliquid supply portion 280 in the first embodiment. That is, the cartridge 20*a* in the second embodiment is configured such that the ink inside thereof is divided to be supplied from the two liquid supply portionliquid supply portions 280*a* to the printer 50 side.

As illustrated in FIG. 22, a single cap 70*a* to close two openings 288 is mounted on the cartridge 20*a*. Similarly to the cartridge 20 in the first embodiment, the cap 70*a* includes the cap main body 74 and a cap lever 72*a*. The cap lever 72*a* protrudes outward from the fifth surface 205, similarly to the first embodiment.

Figure 23:
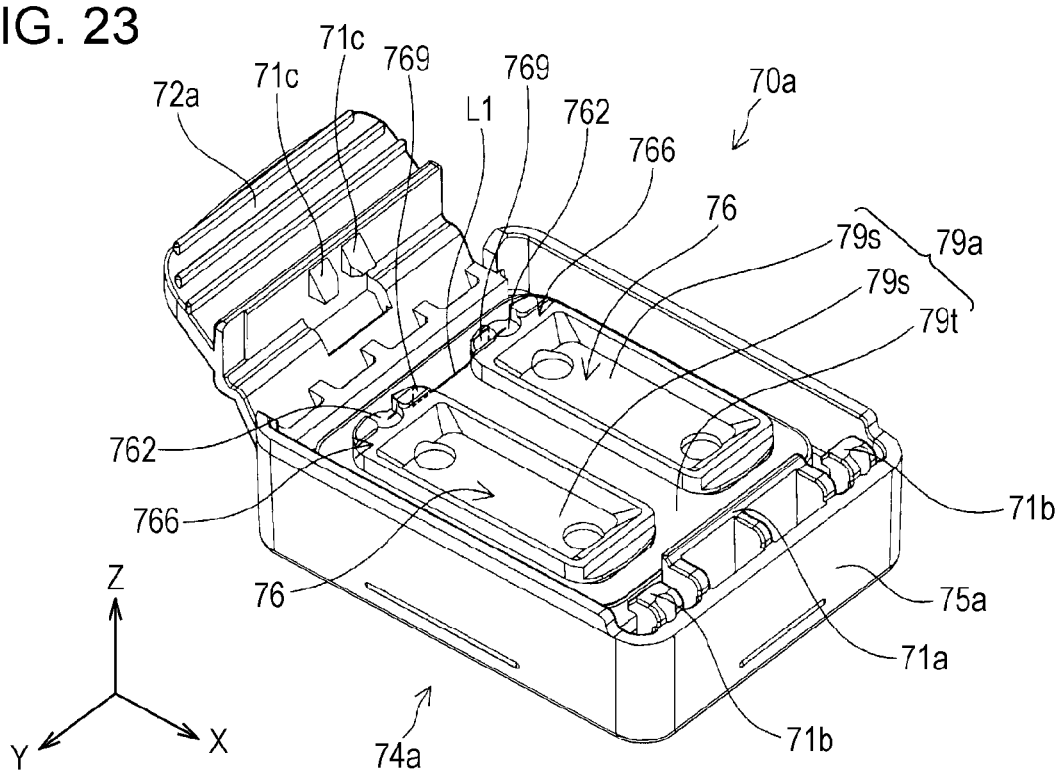
FIG. 23 is a first perspective view of a cap.
Figure 24:
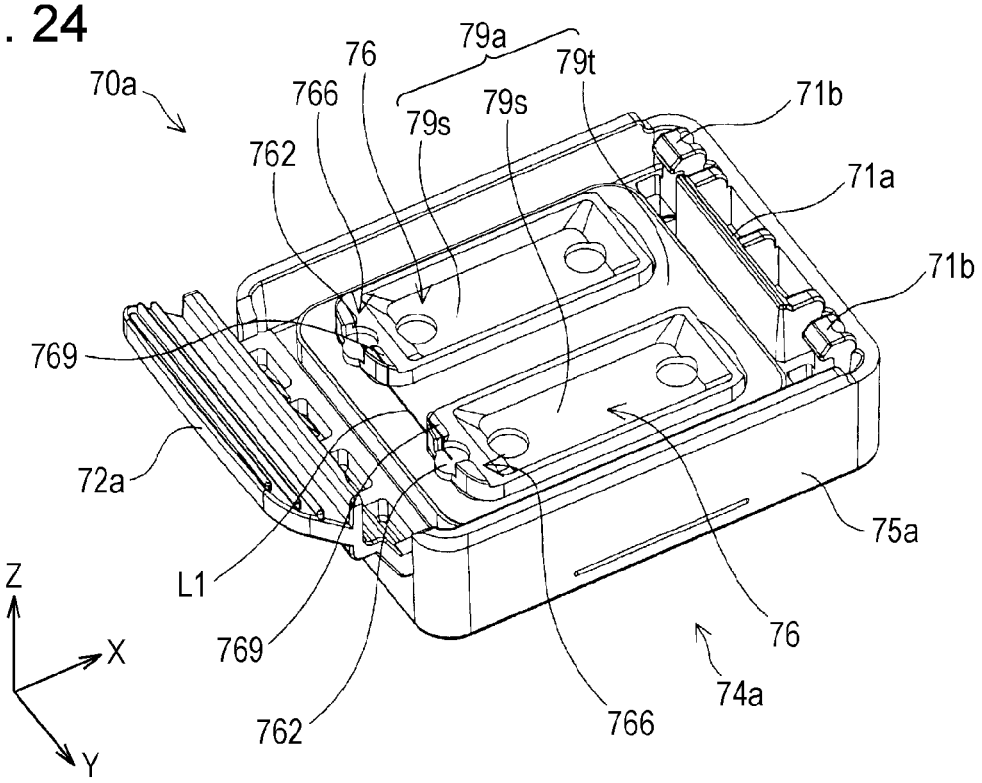
FIG. 24 is a second perspective view of a cap.

FIG. 23 is a first perspective view of the cap 70*a*. FIG. 24 is a second perspective view of the cap 70*a*. The cap 70*a* in the second embodiment includes a base portion 75*a* with a concave shape and a first cap member 79*a* for closing the openings 288, being arranged at a concave portion of the base portion 75*a*. The first cap member 79*a* is a member having the flexibility, such as rubber, similarly to the first embodiment. A different point from the first cap member 79 in the first embodiment is that two first arrangement members 79*s* corresponding to the two liquid supply portionliquid supply portions 280*a* are arranged on the second arrangement member 79*t*. Each of the first arrangement members 79*s* has the same configuration as that in the first embodiment described above and for example, respectively has a sealing portion 762, a cap stepped portion 766 and an acceptance portion 76.

A stepped portion 769 is formed as a first stepped portion across on a line L1 (on the shortest line L1) connecting two sealing portions 762 along a surface of the cap 70*a*. The stepped portion 769 is formed in such a manner that the first arrangement members 79*s* forming the sealing portions 762 are prepared for each of the liquid supply portionliquid supply portions 280*a* and the first arrangement members 79*s* are arranged on the same plane (on the surface of the second arrangement member 79*t*).

B-2. Advantageous Effect

In the second embodiment described above, even in a case where the ink reaches one of the sealing portions 762, the stepped portion 769 can inhibit the ink which has reached one of the sealing portions 762 from reaching the other sealing portion 762. In addition, regarding that the same configuration as that of the first embodiment is provided, the same advantageous effect as that of the first embodiment is achieved.

C. Third Embodiment

C-1. Configuration of Cartridge 20 and Cap 70*b*

Figure 25:
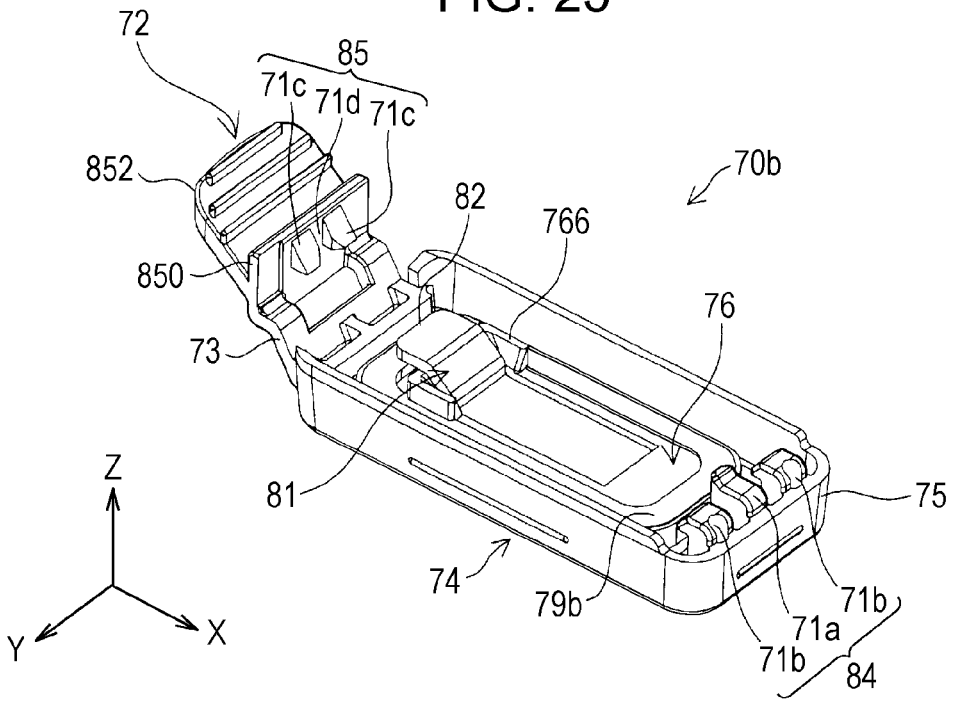
FIG. 25 is a first perspective view of a cap in a third embodiment.
Figure 26:
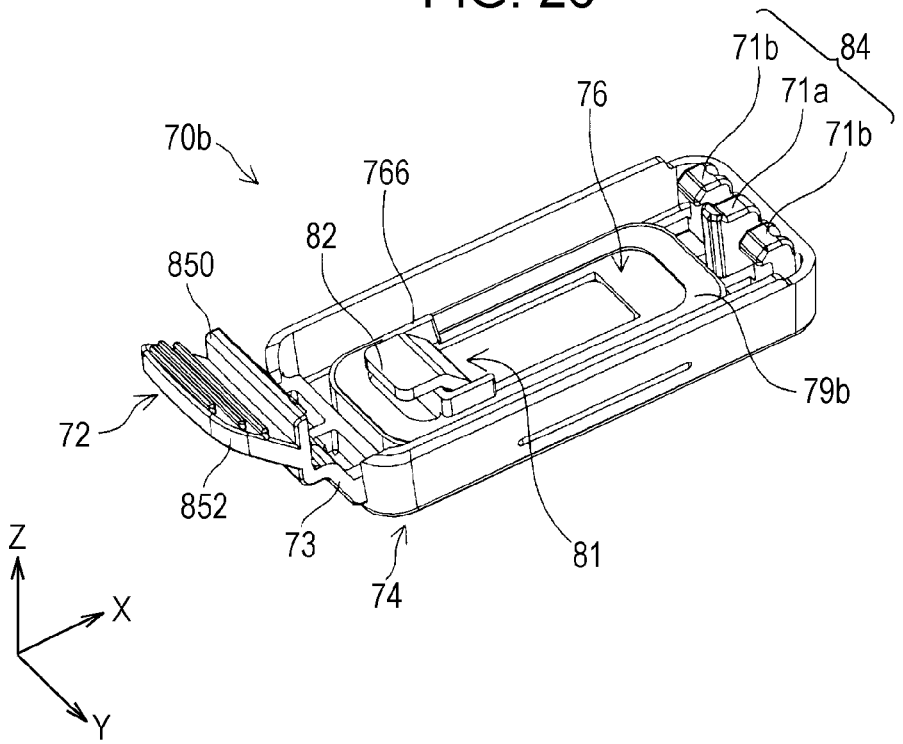
FIG. 26 is a second perspective view of a cap in a third embodiment.
Figure 27:
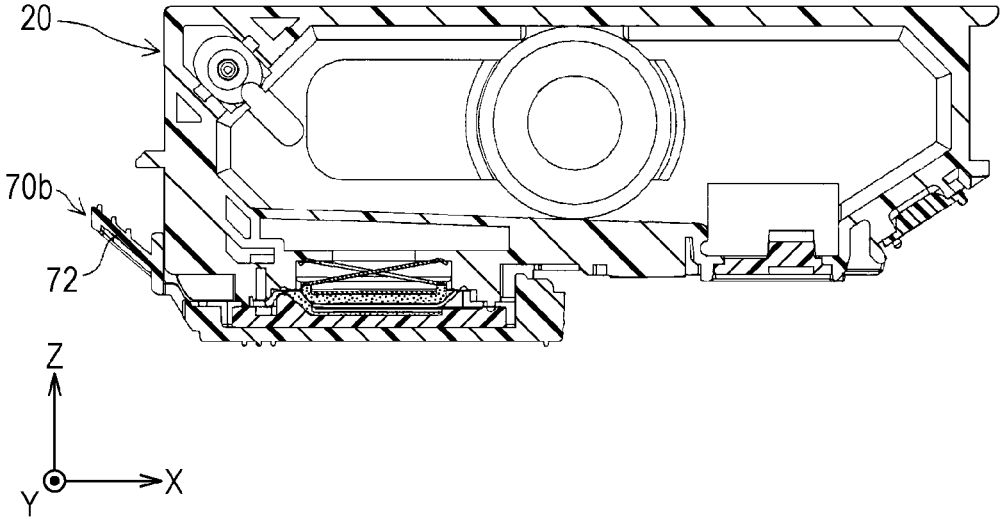
FIG. 27 is a cross-sectional view of a cartridge on which a cap is mounted.
Figure 28:
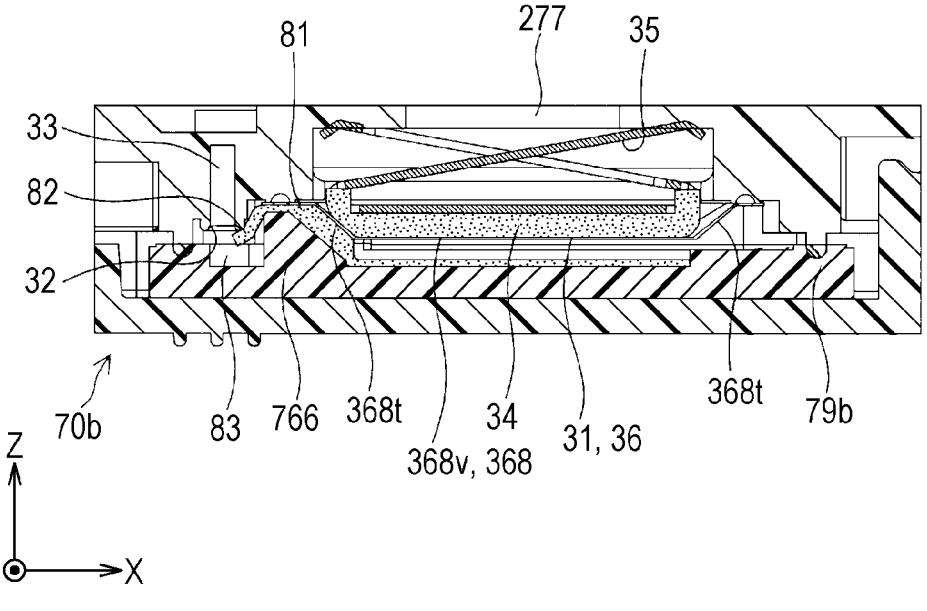
FIG. 28 is an enlarged view of a portion in FIG. 27.

FIGS. 25 and 26 are perspective views of a cap 70*b* in a third embodiment. FIG. 27 is a cross-sectional view of the cartridge 20 on which the cap 70*b* is mounted. FIG. 28 is an enlarged view of a portion in FIG. 27.

As illustrated in FIG. 27, similarly to the cartridge 20 in the first embodiment, the cartridge 20 in the third embodiment can be obtained by mounting the cap 70*b* thereon. The cartridge 20 in the third embodiment has the same configuration as the cartridge 20 in the first embodiment. In addition, an outer structure (appearance shape) forming the appearance of the cap 70*b* in the third embodiment has the same configuration as the cap 70 (refer to FIGS. 17 to 19) in the first embodiment. Furthermore, as illustrated in FIG. 25, the cap 70*b* is common to the cap 70 in the first embodiment in that they have the first engagement portion 84 and the second engagement portion 85. A different point between the cap 70*b* in the third embodiment and the cap 70 in the first embodiment is mainly the point that a first cap member 79*b* is integrally molded, the point that the sealing portion 762 is not provided and the point that a liquid absorber 81 is disposed. Accordingly, the same reference numerals are given to the same configuration elements as those of the cap 70 in the first embodiment, and the description thereof will not be repeated. Further, the first cap member 79*b* may be integrally molded.

As illustrated in FIG. 25, the liquid absorber 81 which is a member absorbing the ink is arranged at the acceptance portion 76 and the cap stepped portion 766. As illustrated in FIG. 28, the liquid absorber 81 is arranged at a position opposing the liquid outflow portion 31 (the sheet member 36). The liquid absorber 81 prevents the ink leaking out of the liquid outflow portion 31 from flowing out to other portions. The liquid absorber 81 may be a sufficient member if the liquid absorber 81 has a function of maintaining the ink. The member having the function of maintaining the ink includes porous bodies, for example, Bell Eater (made by AION Co., Ltd.) and the like.

As illustrated in FIGS. 25 and 26, the liquid absorber 81 extends up to the outside of the acceptance portion 76, riding over the cap stepped portion 766 from the acceptance portion 76. Specifically, an end portion 82 of the liquid absorber 81 is located at the communication port 32 side rather than the cap stepped portion 766. The liquid absorber 81 has a sheet shape. In a state where the cap 70*b* is mounted on the cartridge 20 (hereinafter, simply referred to as an "attachment state"), the liquid absorber 81, together with acceptance portion 76 and the cap stepped portion 766, accepts the liquid outflow portion 31 (the sheet member 36). That is, it can be described that at least a partial wall surface of the acceptance portion 76 is formed using the liquid absorber 81.

As illustrated in FIG. 28, in the present embodiment, in the attachment state, a portion (also referred to as an "opposing portion") arranged on the acceptance portion 76 within the liquid absorber 81 is arranged with a spaced interval, without coming into contact with a first central portion 368*v* configuring the liquid outflow portion 31 (the sheet member 36). In addition, in the attachment state, the opposing portion of the liquid absorber 81 and the liquid outflow portion 31 (the sheet member 36) are arranged opposing each other in the Z axis direction. That is, in the attachment state, the opposing portion of the liquid absorber 81 and the liquid outflow portion 31 (the sheet member 36) have an overlapped positional relationship in a case of being projected on a plane (an XY plane) in parallel to the Z axis direction.

In addition, as illustrated in FIG. 28, in the attachment state, a portion (also referred to as an "absorber stepped portion") arranged on the cap stepped portion 766 within the liquid absorber 81 is arranged so as to come into contact with a slanted portion 368*t* located at the communication port 32 side, among four slanted portions 368*t* configuring the liquid outflow portion 31 (the sheet member 36). In other words, the liquid absorber 81 is arranged so as to be pinched by the cap stepped portion 766 and the slanted portion 368*t* of the liquid outflow portion 31.

Furthermore, as illustrated in FIG. 28, at least a portion of the liquid absorber 81 opposes the communication port 32 in the Z axis direction. That is, in the attachment state, the liquid absorber 81 and the communication port 32 have a positional relationship where at least a portion is overlapped, in a case of being projected on the plane (the XY plane) in parallel to the Z axis direction. In addition, the liquid absorber 81 (specifically, an end portion 82) is arranged with a spaced interval, without coming into contact with the communication port 32.

C-2. Advantageous Effect

The cap 70*b* in the third embodiment described above includes the liquid absorber 81. This enables the liquid absorber 81 to absorb the ink leaking out even in a case where the ink leaks out from the liquid outflow portion 31 (the sheet member 36) during the transportation of the cartridge 20 in a state where the cap 70*b* is mounted thereon. As a result, when using the cartridge 20, even though the cap 70*b* is detached from the cartridge 20, it is possible to decrease a possibility that the ink may leak out. This can decrease a possibility that users' hand may get filthy due to the ink.

In addition, in the attachment state, the liquid absorber 81 is arranged with a spaced interval, without coming into contact with the first central portion 368*v* configuring the sheet member 36, and is arranged such that at least a portion opposes the first central portion 368*v* in the Z axis direction. Therefore, without causing damage to the first central portion 368*v* which flows out the ink to the printer, it is possible to absorb the ink leaking out from the first central portion 368*v*.

In addition, in the attachment state, the portion (the absorber stepped portion) arranged on the cap stepped portion 766 within the liquid absorber 81 is arranged so as to come into contact with the slanted portion 368*t* (a communication port side slanted portion 368*t*) located at the communication port 32 side, among four slanted portions 368*t* configuring the liquid outflow portion 31 (the sheet member 36) (refer to FIG. 28). Therefore, the ink absorbed by the liquid absorber 81 can be circulated to the liquid outflow portion 31 via the communication port side slanted portion 368*t*. Accordingly, the ink absorbed by the liquid absorber 81 can be returned to the liquid outflow portion 31 (the sheet member 36). As a result, when using the cartridge 20, even though the cap 70*b* is detached from the cartridge 20, it is possible to decrease a possibility that the ink may leak out. For example, this can decrease a possibility that users' hand may get filthy due to the ink. In addition, it is possible to decrease an amount of the ink which cannot be used. Furthermore, since the liquid absorber 81 is arranged to be sandwiched between the cap stepped portion 766 and the slanted portion 368*t* of the liquid outflow portion 31 (refer to FIG. 28), it is possible to narrow the flow path through which the ink flows from the liquid outflow portion 31 to the communication port 32. This can decrease a possibility that the ink may flow into the communication port 32.

In addition, in the attachment state, the liquid absorber 81 and the communication port 32 have a positional relationship where at least a portion is overlapped, in a case of being projected on the plane (the XY plane) in parallel to the Z axis direction (refer to FIG. 28). Therefore, even if the ink flows out to a space 83 (refer to FIG. 28) configured to have the communication port 32 and the cap 70*b*, it is possible to decrease a possibility that the ink may flow into the communication port 32. In addition, a portion of the liquid absorber 81 is arranged with a spaced interval so as not to come into contact with the communication port 32. Accordingly, it is possible to decrease a possibility that the ink maintained by the liquid absorber 81 may directly flow into the communication port 32. Further, regarding that the same configuration as that of the first embodiment is provided, the same advantageous effect as that of the first embodiment is achieved.

C-3. Modification Example of Third Embodiment

The third embodiment described above employs the liquid absorber 81 as the member having the function of maintaining (absorbing) the ink (refer to FIG. 25). Alternatively, the function (the structure) of maintaining (absorbing) the ink may be provided for the acceptance portion 76 itself. The structure enabling the ink to be maintained includes concave and convex shapes involving grooves formed on the surface of the acceptance portion 76. The concave and convex shapes generate a capillarity, which enables the ink to be maintained by the acceptance portion 76.

In the third embodiment described above, the liquid absorber 81 is arranged at the acceptance portion 76 and the cap stepped portion 766. In contrast, the liquid absorber 81 may only be arranged at the acceptance portion 76 or otherwise only at the cap stepped portion 766. This enables the ink leaking out from the liquid outflow portion 31 to be absorbed. In this case, on an inner surface of the cap 70*b*, it is preferable to arrange the liquid absorber 81 in at least a portion from a portion opposing the liquid outflow portion 31 within the cap 70*b* and a portion opposing the communication port 32. This can decrease a possibility that the ink leaking out from the liquid outflow portion 31 may flow into the communication port 32.

In the third embodiment described above, in the attachment state, the portion (the opposing portion) arranged on the acceptance portion 76 within the liquid absorber 81 is arranged with a spaced interval, without coming into contact with the first central portion 368*v* configuring the liquid outflow portion 31 (the sheet member 36), but may be arranged so as to come into contact therewith. Both of the liquid absorber 81 and the first central portion 368*v* are arranged to come into contact with each other, which enables the liquid absorber 81 to further absorb the ink.

In the third embodiment described above, in the attachment state, the portion (the absorber stepped portion) arranged on the cap stepped portion 766 within the liquid absorber 81 is arranged so as to come into contact with the slanted portion 368*t* located at the communication port 32 side, among four slanted portions 368*t* configuring the liquid outflow portion 31 (the sheet member 36). However, the portion may be arranged to be brought into contact with at least one among the four slanted portions 368*t*, and may be arranged to be brought into contact with two or more. In addition, both of the liquid absorber 81 and the slanted portions 368*t* may not be brought into contact with each other. Even in this manner, narrowing the space between the cap stepped portion 766 and the slanted portions 368 of the liquid outflow portion 31 can decrease a possibility that the ink may flow out. Furthermore, the liquid absorber 81 is arranged so as to be sandwiched between the cap stepped portion 766 and the slanted portions 368*t* of the liquid outflow portion 31. However, the liquid absorber 81 may be arranged so as to be sandwiched between the cap stepped portion 766 and the attachment portion 362 (refer to FIG. 19). Even in this manner, narrowing the space between the cap stepped portion 766 and the slanted portions 368*t* of the liquid outflow portion 31 can decrease a possibility that the ink may flow out.

In the third embodiment described above, in the attachment state, the liquid absorber 81 is arranged such that at least a portion is overlapped with the communication port 32 in a case of being projected on the XY plane, but may not be overlapped therewith. A portion of the liquid absorber 81 may be present in the space 83 connected to the communication port 32. Even in this manner, it is possible to decrease the amount of the ink flowing into the communication port 32.

In the third embodiment described above, in the attachment state, the liquid absorber 81 is arranged such that the end portion 82 of the liquid absorber 81 may not be brought into contact with the communication port 32, but may be brought into contact therewith. Bringing both of the end portion 82 and the communication port 32 into contact with each other enables the liquid absorber 81 to absorb the ink when the ink leaking out to the space 83 connected to the communication port 32 attempts to flow into the communication port 32.

Figure 29:
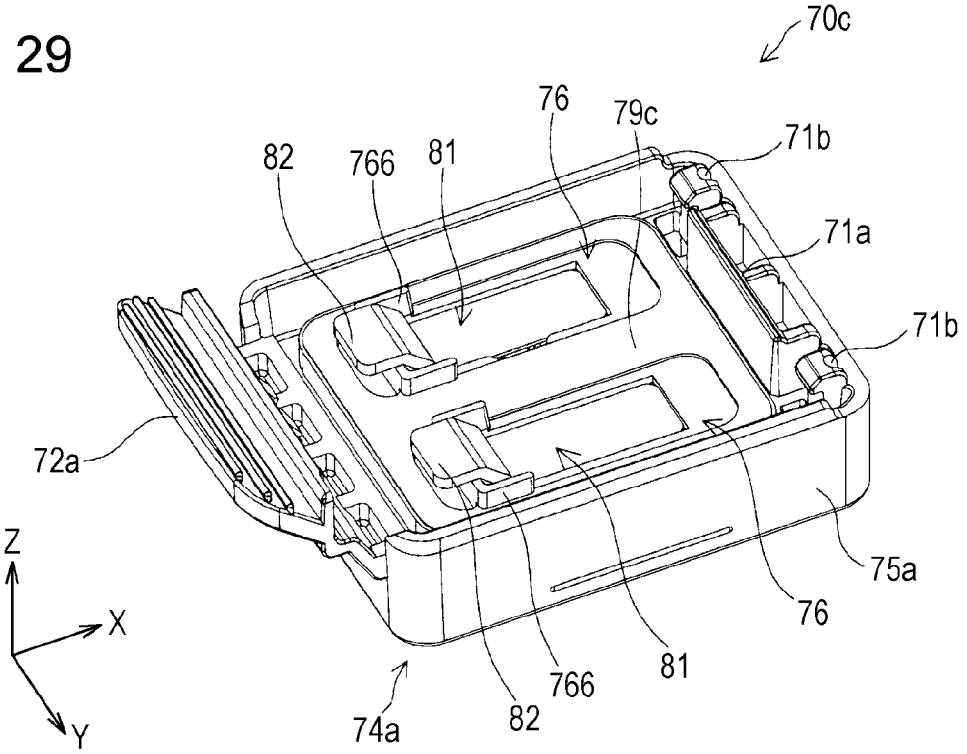
FIG. 29 is a first perspective view of a cap as a modification example.
Figure 30:
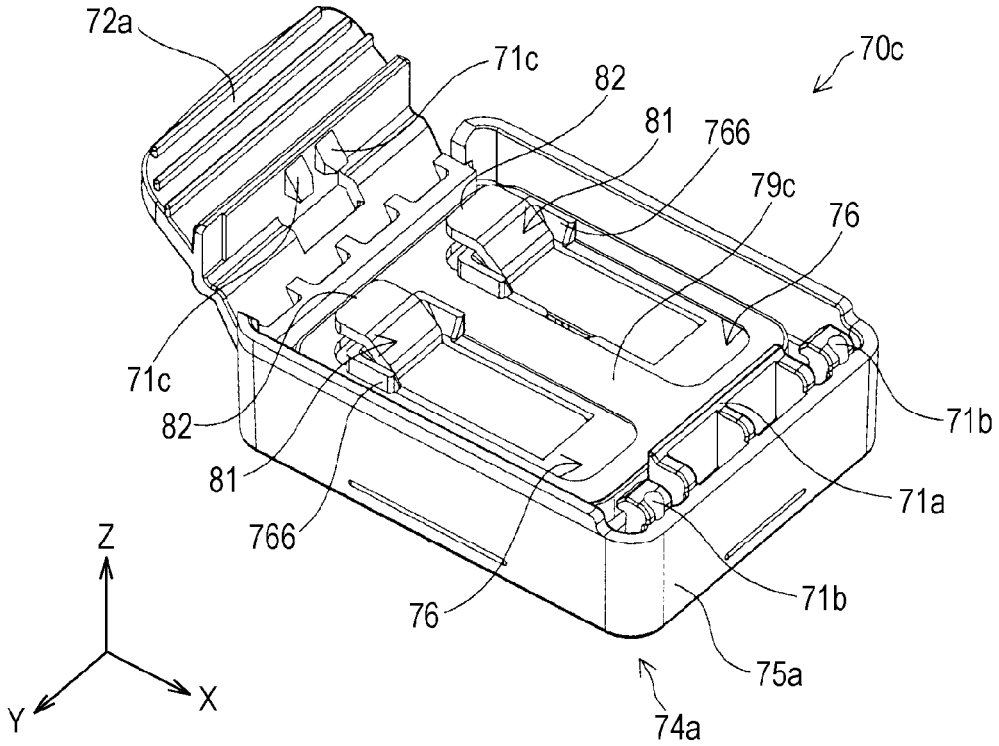
FIG. 30 is a second perspective view of a cap as a modification example.

The cap 70*b* in the third embodiment described above may be modified so as to be applicable to the cartridge having a plurality of the liquid supply portionliquid supply portions 280. FIG. 29 is a first perspective view of a cap 70*c* as a modification example. FIG. 30 is a second perspective view of the cap 70*c* as a modification example. The cap 70*c* which is the modification example of the cap 70*b* in the third embodiment described above can be attached to the cartridge 20*a* (refer to FIG. 21) in the second embodiment. The cap 70*c* includes a first cap member 79*c* having a wider width in the Y axis direction than the first cap member 79*b* in the third embodiment. In addition, the first cap member 79*c*, corresponding to the two liquid supply portionliquid supply portions 280*a* of the cartridge 20*a* (refer to FIG. 21), includes two acceptance portions 76, two cap stepped portions 766 and two liquid absorbers 81. In addition, the same reference numerals are given to the same configuration elements as those of the cap 70*a* (refer to FIG. 23) in the second embodiment, and the description thereof will not be repeated. Even in the cap 70*c* of the modification example, with regard to the same configuration as the cap 70*b* of the second embodiment, the same advantageous effect is achieved.

D. Fourth Embodiment

D-1. Configuration of Cartridge 20 and Cap 70*d*

Figure 31:
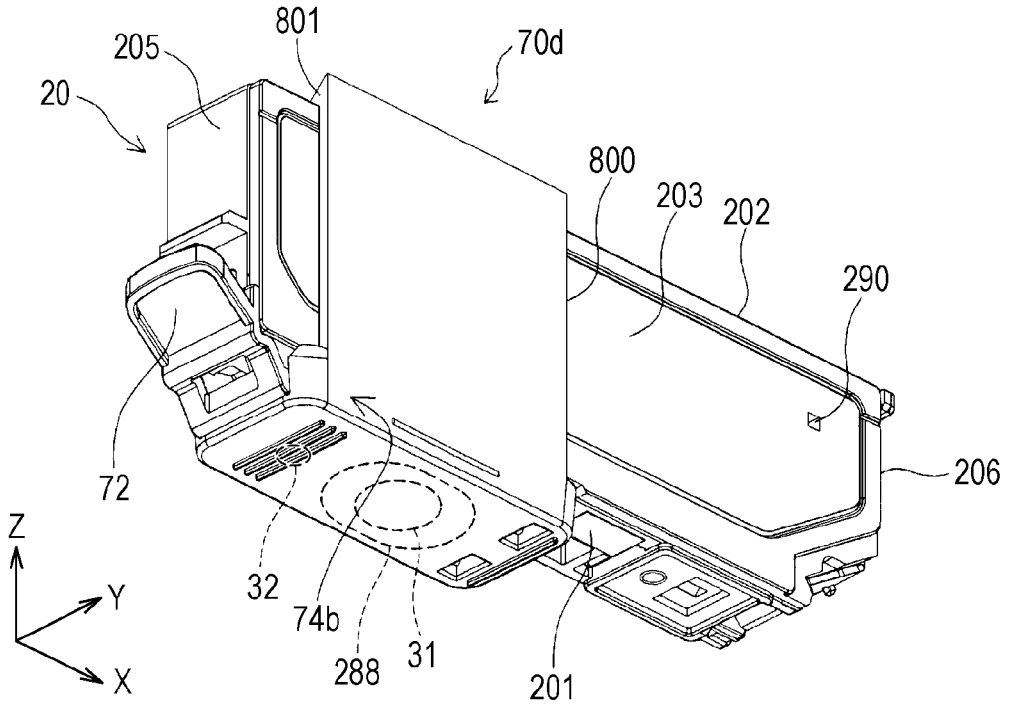
FIG. 31 is a perspective view of a cartridge on which a cap in a fourth embodiment is mounted.
Figure 32:
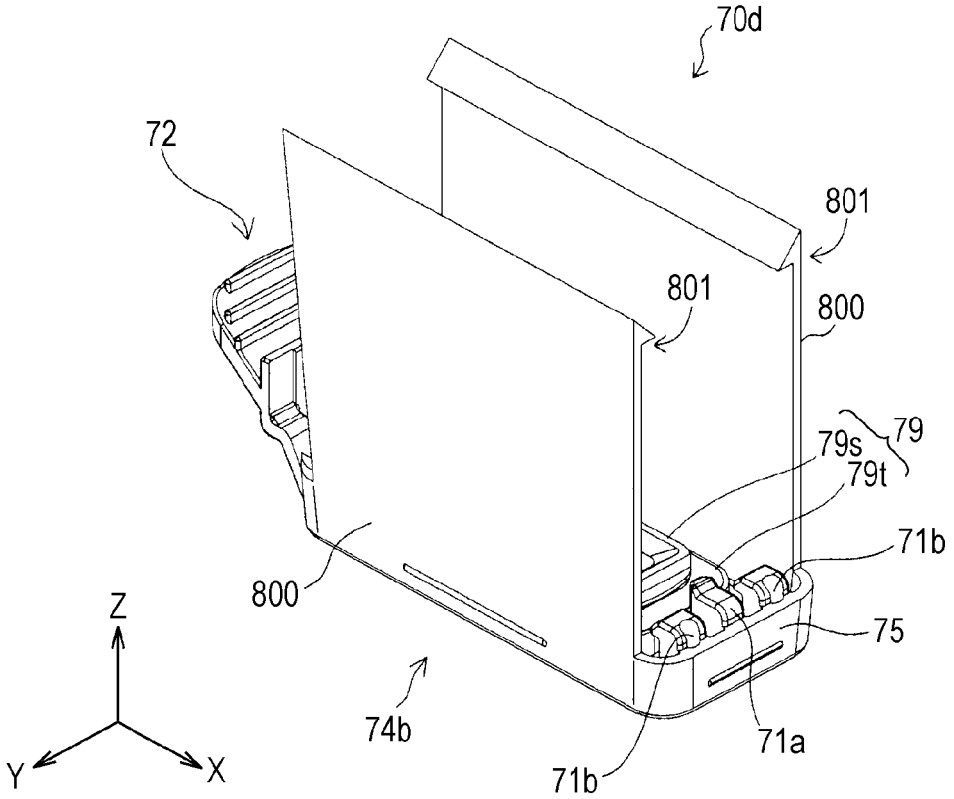
FIG. 32 is a first perspective view of a cap.
Figure 33:
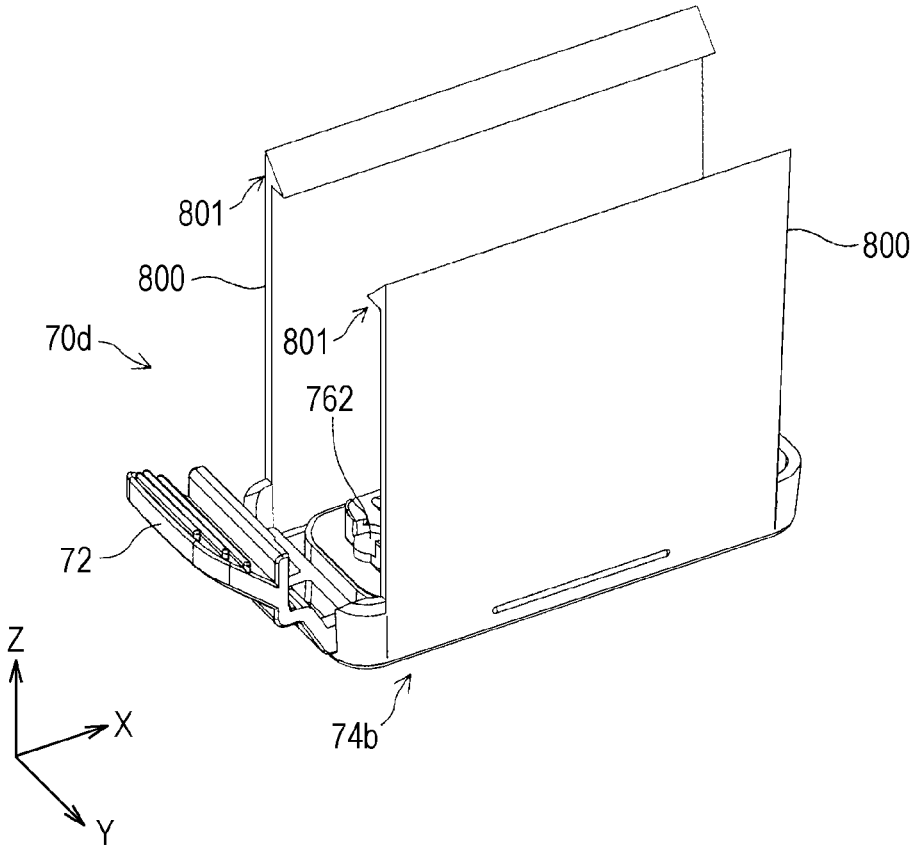
FIG. 33 is a second perspective view of a cap.

FIG. 31 is a perspective view of the cartridge 20 on which a cap 70*d* in a fourth embodiment is mounted. FIG. 32 is a first perspective view of the cap 70*d*. FIG. 33 is a second perspective view of the cap 70*d*.

As illustrated in FIG. 31, similarly to the cartridge 20 of the first embodiment, a cap (the cap 70*d*) can be mounted on the cartridge 20 of the fourth embodiment. The cartridge 20 of the fourth embodiment has the same configuration as the cartridge 20 of the first embodiment. The cap 70*d* of the fourth embodiment is different from the cap 70 of the first embodiment in that a pair of wall portions 800 is provided. Since other configurations are the same as those of the cap 70 in the first embodiment, the description thereof will not be repeated.

A cap main body 74*b* of the fourth embodiment has a pair of the wall portions 800 in addition to the base portion 75 and the first cap member 79. A pair of the wall portions 800 each is a flat plate shaped section with a quadrangular shape in a plane view. One of a pair of the wall portions 800 is connected to an end surface in the +Z axis direction of a wall located in the −Y axis direction most in the base portion 75, and the other is connected to an end surface in the +Z axis direction of a wall located in the +Y axis direction most in the base portion 75. In other words, a pair of the wall portions 800 is arranged to be apart from each other by the length (the width) of the base portion 75 in the Y axis direction, and all are arranged to be in parallel to the X axis and the Z axis. Similarly to the base portion 75, a pair of the wall portions 800 is formed of the synthetic resins such as polypropylene and has flexibility in the Y axis direction. For this reason, a pair of the wall portions 800 is bent in the Y axis direction (the +Y axis direction and the −Y axis direction) when the cap 70*d* is mounted on the cartridge 20, which can inhibit the cartridge 20 and the cap 70*d* from being damaged.

A pair of the wall portions 800 each has a third engagement portion 801 in an end portion (an end portion in the +Z axis direction) opposite to an end portion connected to the base portion 75. The third engagement portion 801 has a substantially triangular shape in a cross-sectional view (when viewed in the +X axis direction or in the −X axis direction). The thickness (the length in the Y axis direction) of the third engagement portion 801 is thicker (longer) than the thickness of the wall portions 800. As illustrated in FIG. 31, this configuration allows the third engagement portion 801 to engage (come into contact) with the second surface 202 in a state where the cap 70*d* is mounted on the cartridge 20. Therefore, the cartridge 20 is vertically maintained (supported therebetween) by the cap 70*d*. Further, the third engagement portion 801 corresponds to a third cover side engagement portionengagement portion in claims.

D-2. Advantageous Effect

The cap 70*d* of the fourth embodiment described above includes the third engagement portion 801 engaging (coming into contact) with the second surface 202 in a state where the cap 70*d* is mounted on the cartridge 20. For this reason, it is possible to regulate the deviation in the Y axis direction when the cap 70*d* is mounted on the cartridge 20. Therefore, it is possible to reliably close the opening 288 using the cap 70*d*. Accordingly, it is possible to decrease a possibility that the liquid outflow portion 31 is accepted by the acceptance portion 76 and the ink may flow further outward from the acceptance portion 76, and a possibility that the ink may evaporate from the liquid outflow portion 31. In addition, regarding that the same configuration as that of the first embodiment is provided, the same advantageous effect as that of the first embodiment is achieved.

D-3. Modification Example of Fourth Embodiment

Figure 34:
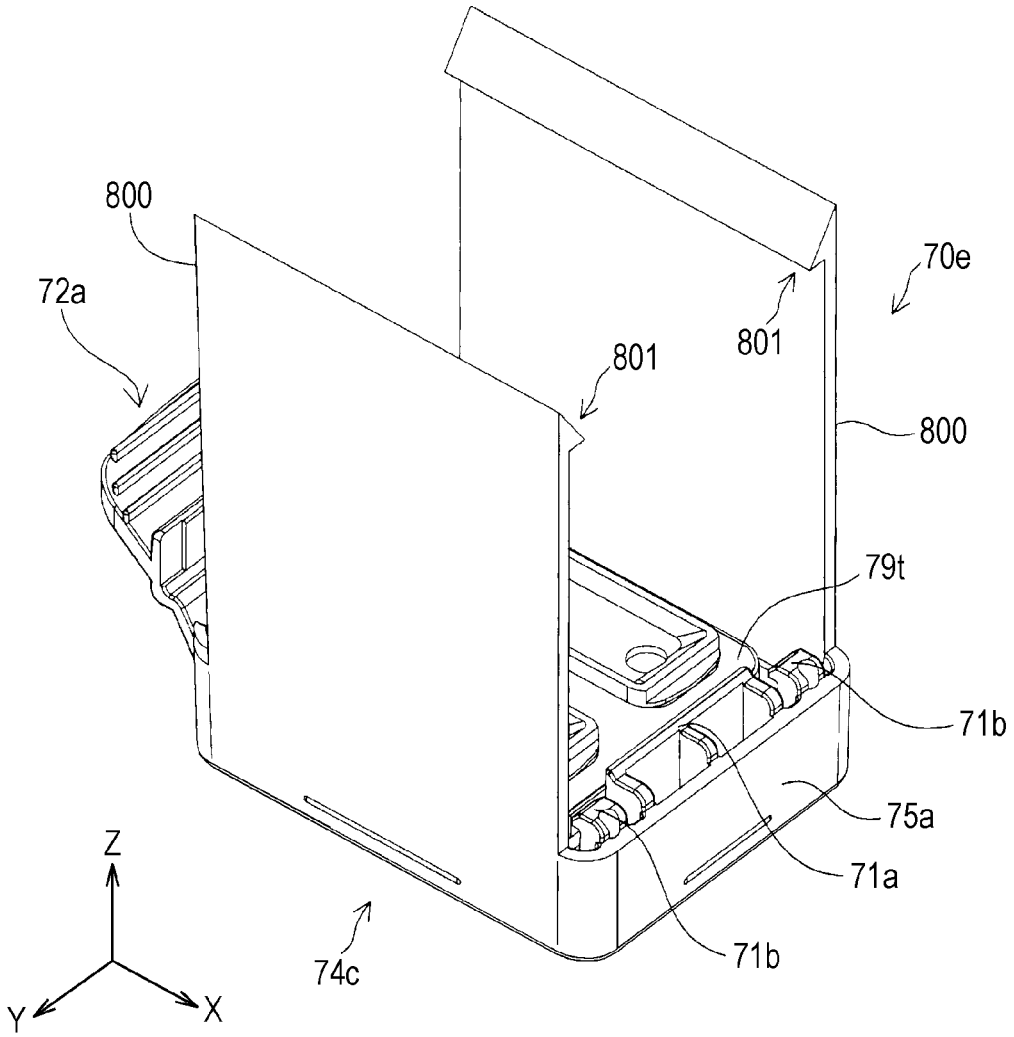
FIG. 34 is a first perspective view of a cap as a modification example.
Figure 35:
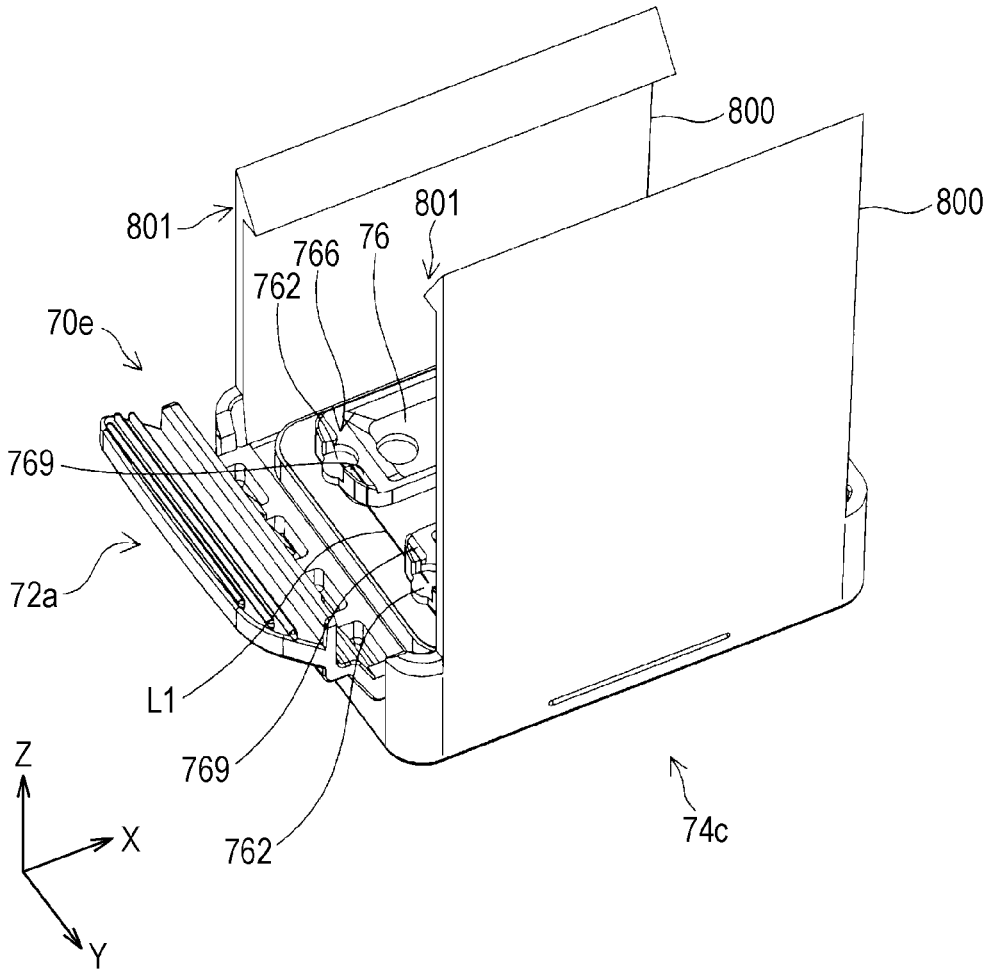
FIG. 35 is a second perspective view of a cap as a modification example.

The cap 70*d* of the fourth embodiment described above may also be modified to be applicable to the cartridge having a plurality of liquid supply portionliquid supply portions 280. FIG. 34 is a first perspective view of a cap 70*e* as a modification example. FIG. 35 is a second perspective view of the cap 70*e* as a modification example. The cap 70*e* which is the modification example of the cap 70*d* in the fourth embodiment can be attached to the cartridge 20*a* (refer to FIG. 21) in the second embodiment. Further, the same reference numerals are given to the same configuration elements as those of the cap 70*a* in the second embodiment and the cap 70*d* in the fourth embodiment, and the description thereof will not be repeated. Even in the cap 70*e* of the modification example, with regard to the same configuration as the cap 70*a* in the second embodiment and the cap 70*d* in the fourth embodiment, the same advantageous effect is achieved.

E. Fifth Embodiment

E-1. Configuration of Cap 70*f*

Figure 36:
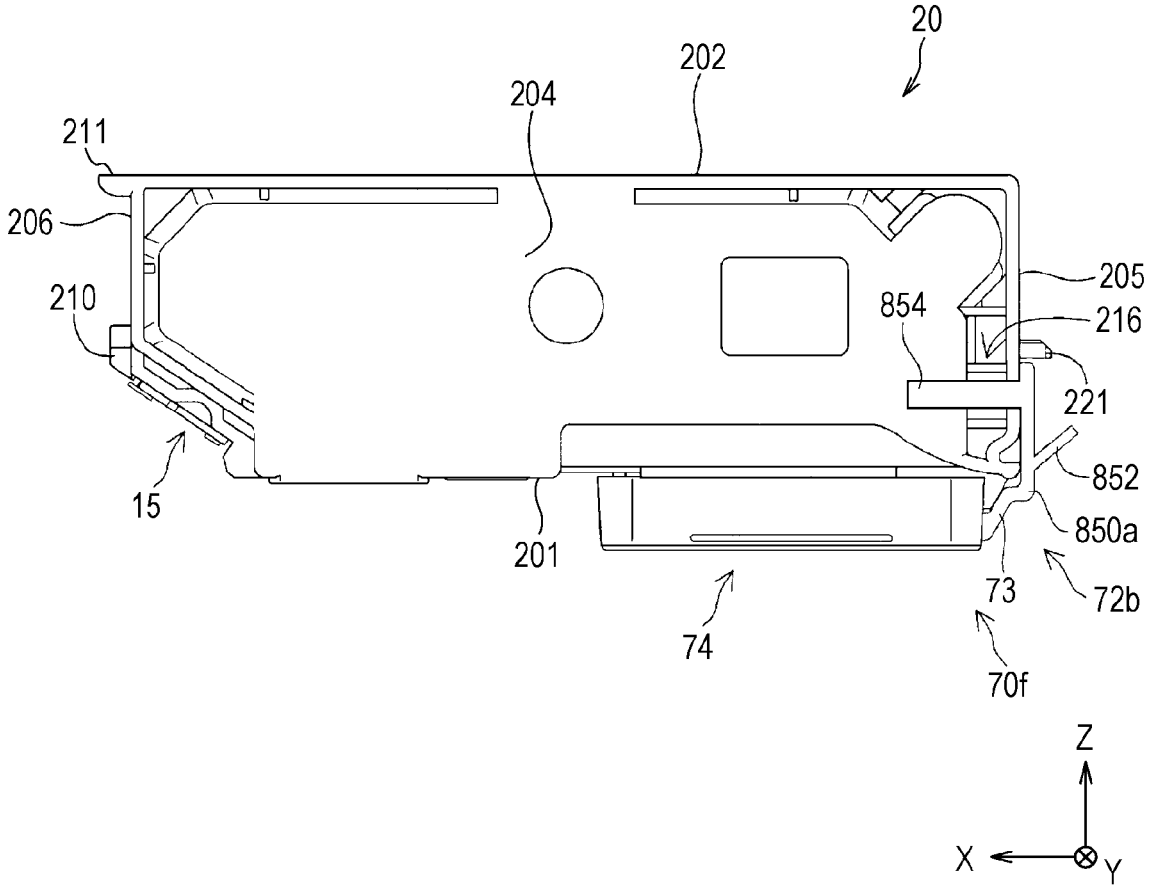
FIG. 36 is a rear view of a cartridge on which a cap in a fifth embodiment is mounted.

FIG. 36 is a rear view of the cartridge 20 on which a cap 70*f* of a fifth embodiment is mounted. As illustrated in FIG. 36, similarly to the cartridge 20 of the first embodiment, a cap (the cap 70*f*) can be mounted on the cartridge 20 of the fifth embodiment. The cartridge 20 of the fifth embodiment has the same configuration as the cartridge 20 of the first embodiment. The cap 70*f* of the fifth embodiment is different from the cap 70 (refer to FIGS. 17 to 19) of the first embodiment in that an erected portion 850*a* is provided instead of the erected portion 850. Since other configurations are the same as those of the cap 70 in the first embodiment, the description thereof will not be repeated.

The erected portion 850*a* of the cap 70*f* is different from the erected portion 850 of the cap 70 of the first embodiment in that the erected portion 850*a* extends long in the +Z axis direction and in that a pair of pinching portions 854 is provided.

Figure 37:
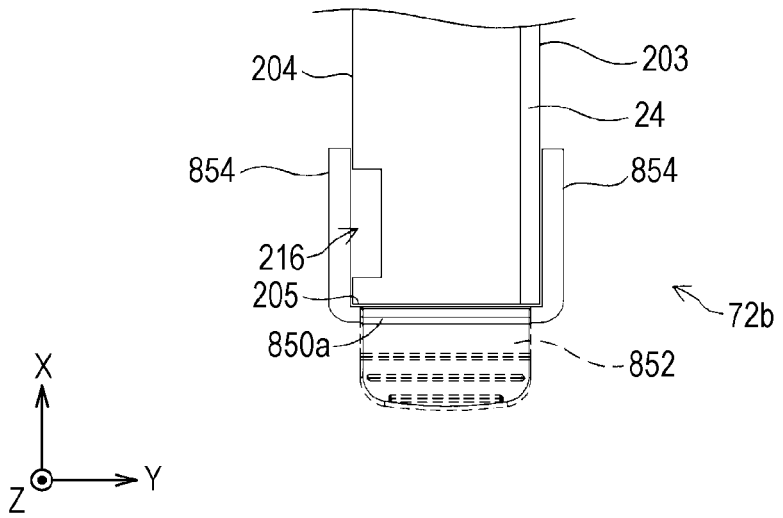
FIG. 37 is a partial cross-sectional view of a cartridge on which a cap is mounted.

FIG. 37 is a partial cross-sectional view of the cartridge 20 on which the cap 70*f* is mounted. FIG. 37 is a cross-sectional view of a contact portion between the fifth surface 205 of the cartridge 20 and a cap lever 72*b* of the cap 70*f* when viewed in the −X axis direction. As illustrated in FIGS. 36 and 37, a pair of the pinching portions 854 is formed close to an end portion (close to an end portion opposite to an end portion connected to the connection portion 73) of the erected portion 850*a* in the +Z axis direction. A pair of the pinching portions 854 each is a thin plate member with a rectangular shape in a plane view where the X axis direction is assumed as the longitudinal direction. In addition, a pair of the pinching portions 854 each is formed of the synthetic resins such as polypropylene similarly to the base portion 75 and the connection portion 73.

As illustrated in FIG. 37, one pinching portion 854 is connected to an end portion of the erected portion 850*a* in the +Y axis direction and the other pinching portion 854 is connected to an end portion of the erected portion 850*a* in the −Y axis direction. Therefore, a pair of the pinching portions 854 is arranged with a predetermined interval (approximately the same length as the width of the cartridge 20) in the Y axis direction. In a pair of the pinching portions 854, one pinching portion 854 comes into contact with the fourth surface 204 and the other pinching portion 854 comes into contact with the third surface 203, whereby maintaining (pinching) the cartridge 20.

As illustrated in FIG. 37, the pinching portion 854 coming into contact with the fourth surface 204 comes into contact with the fourth surface 204 crossing over the thickness slimmer 216 formed on the fourth surface 204 in the +X axis direction, based on a connection section with the erected portion 850*a*. In other words, the length of the pinching portion 854 in the X axis direction is longer than the length from the fifth surface 205 to an end portion of the thickness slimmer 216 in the +X axis direction. If the end portion of the pinching portion 854 in the +X axis direction is arranged at the thickness slimmer 216, a maintaining force (a pinching force) for the cartridge 20 using a pair of the pinching portions 854 weakens. Therefore, the pinching portions 854 in the fifth embodiment are configured to be arranged crossing over the thickness slimmer 216, whereby improving the maintaining force (the pinching force) for the cartridge 20 using a pair of the pinching portions 854. Further, the pinching portion 854 in the fifth embodiment corresponds to a contact portion in claims.

E-2. Advantageous Effect

The cap 70*f* of the fifth embodiment described above includes a pair of the pinching portions 854 coming into contact with the third surface 203 and the fourth surface 204 in a state where the cap 70*f* is mounted on the cartridge 20. For this reason, a pair of the pinching portions 854 can perform the reliable positioning of the cap 70*f* in the Y axis direction (the width direction), whereby enabling the opening 288 to be reliably covered using the cap 70*f*. In addition, in a pair of the pinching portions 854, the pinching portion 854 coming into contact with the fourth surface 204 comes into contact with the fourth surface 204 crossing over the thickness slimmer 216 in the +X axis direction. Therefore, compared to a configuration where the end portion of the pinching portion 854 coming into contact with the fourth surface 204 is located at the thickness slimmer 216, it is possible to improve the maintaining force (the pinching force) for the cartridge 20 using a pair of the pinching portions 854. In addition, regarding that the same configuration as that of the first embodiment is provided, the same advantageous effect as that of the first embodiment is achieved.

Further, even though not illustrated, the cap 70*f* of the fifth embodiment described above may be modified to be applicable to the cartridge (for example, the cartridge 20*a* in FIG. 21) having a plurality of liquid supply portionliquid supply portions 280.

F. Sixth Embodiment

F-1. Configuration of Cap 70*g*

Figure 38:
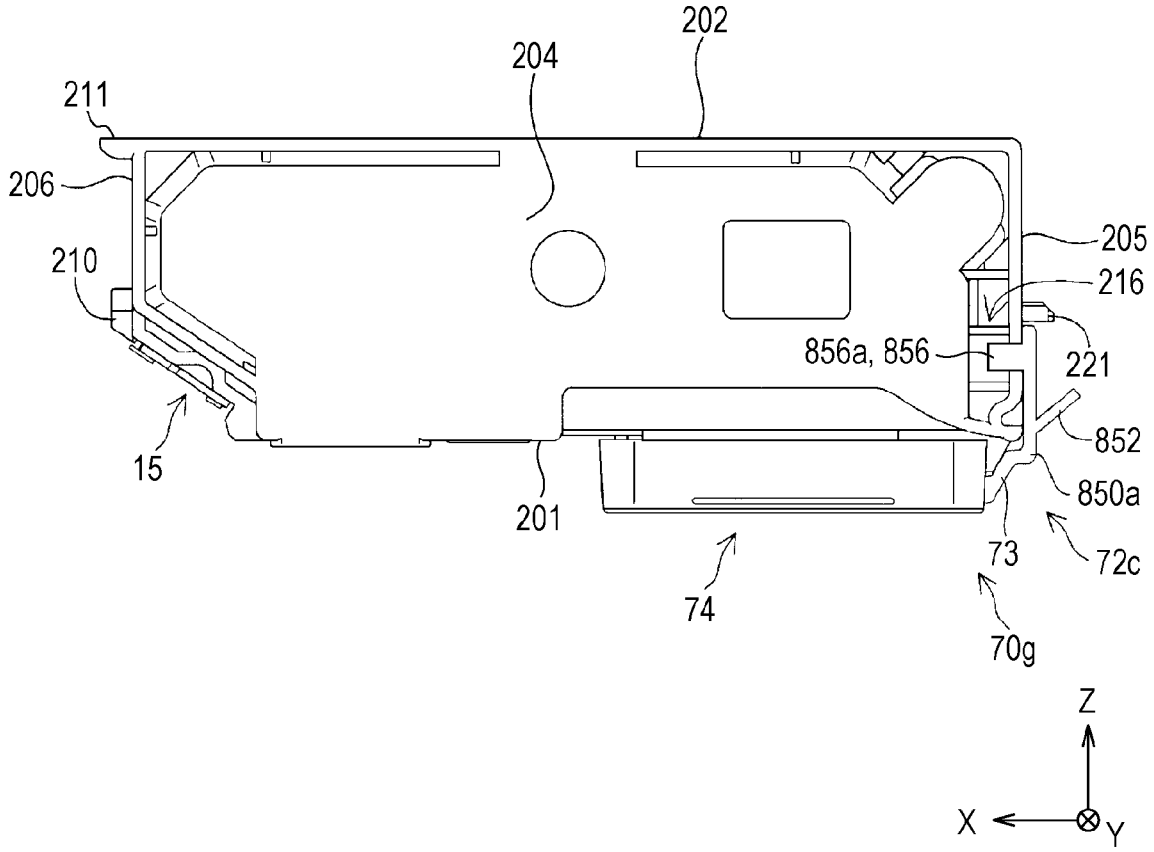
FIG. 38 is a rear view of a cartridge on which a cap in a sixth embodiment is mounted.

FIG. 38 is a rear view of the cartridge 20 on which a cap 70*g* of a sixth embodiment is mounted. As illustrated in FIG. 38, similarly to the cartridge 20 of the first embodiment, a cap (the cap 70*g*) can be mounted on the cartridge 20 of the sixth embodiment. The cartridge 20 of the sixth embodiment has the same configuration as the cartridge 20 of the first embodiment. The cap 70*g* of the sixth embodiment is different from the cap 70*f* of the fifth embodiment in that a pair of pinching portions 856 is provided instead of a pair of the pinching portions 854. Since other configurations are the same as those of the cap 70*f* in the fifth embodiment, the description thereof will not be repeated.

Figure 39:
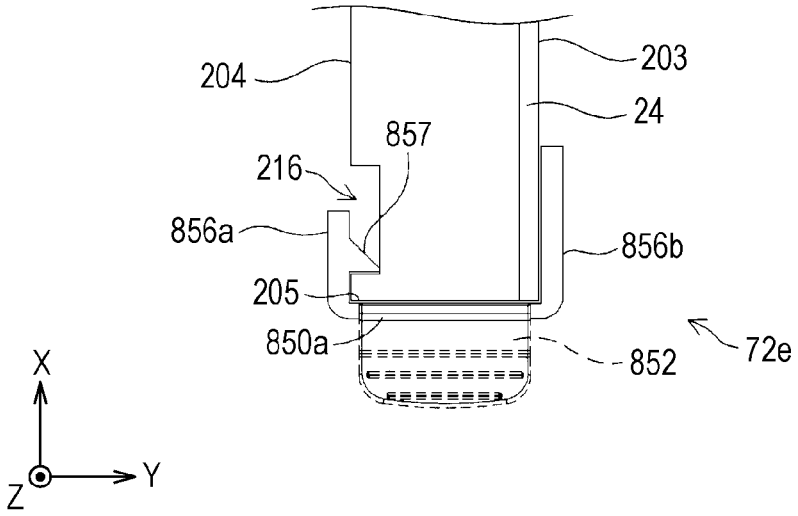
FIG. 39 is a partial cross-sectional view of a cartridge on which a cap is mounted.

FIG. 39 is a partial cross-sectional view of the cartridge 20 on which the cap 70*g* is mounted. FIG. 39 is a cross-sectional view of a contact portion between the fifth surface 205 of the cartridge 20 and a cap lever 72*c* of the cap 70*g* when viewed in the −X axis direction. As illustrated in FIGS. 38 and 39, a pair of the pinching portions 856 (a pinching portion 856*a* and a pinching portion 856*b*) has a shorter length in the X axis direction than the length of a pair of the pinching portions 854 of the cap 70*f* in the X axis direction in the fifth embodiment. More specifically, as illustrated in FIG. 39, in a pair of the pinching portions 856, the pinching portion 856*a* coming into contact with the fourth surface 204 is arranged at a position where an end portion thereof in the +X axis direction corresponds to the thickness slimmer 216. Further, in a pair of the pinching portions 856, the pinching portion 856*b* coming into contact with the third surface 203 has the same length in the X axis direction as the length of the pinching portion 856*a* in the X axis direction.

Here, the pinching portion 856*a* includes a protrusion 857 on a surface opposing the fourth surface 204. The protrusion 857 is extended in the +Y axis direction on the surface opposing the fourth surface 204 in the pinching portion 856*a*. The protrusion 857 is inserted to the thickness slimmer 216. This allows a rib (a portion between the thickness slimmer 216 and the fifth surface 205) formed in the peripheral edge portion close to the fifth surface 205 to be pinched by the protrusion 857 and the erected portion 850*a*, on the fourth surface 204. In this manner, the positioning of the cap 70*g* in the X axis direction is performed. In addition, since a pair of the pinching portions 856 pinches the cartridge 20, the positioning of the cap 70*g* in the Y axis direction is performed, similarly to the cap 70*f* of the fifth embodiment. Further, the protrusion 857 in the sixth embodiment corresponds to an insertion portion in claims.

F-2. Advantageous Effect

The cap 70*g* of the sixth embodiment described above includes a pair of the pinching portions 856 coming into contact with the third surface 203 and the fourth surface 204 in a state where the cap 70*f* is mounted on the cartridge 20. For this reason, a pair of the pinching portions 856 can perform the reliable positioning of the cap 70*g* in the Y axis direction (the width direction), whereby enabling the opening 288 to be reliably covered using the cap 70*g*. In addition, in a pair of the pinching portions 856, the pinching portion 856*a* coming into contact with the fourth surface 204 includes the protrusion 857 to be inserted to the thickness slimmer 216. This enables the rib between the thickness slimmer 216 and the fifth surface 205 to be pinched by the protrusion 857 and the erected portion 850*a*, and thereby the reliable positioning of the cap 70*g* in the X axis direction can be performed.

Further, although not illustrated, the cap 70*g* of the sixth embodiment described above may be modified to be applicable to the cartridge having a plurality of liquid supply portionliquid supply portions 280.

G. Seventh Embodiment

G-1. Configuration of Cartridge 20 and Cap 70*h*

Figure 40:
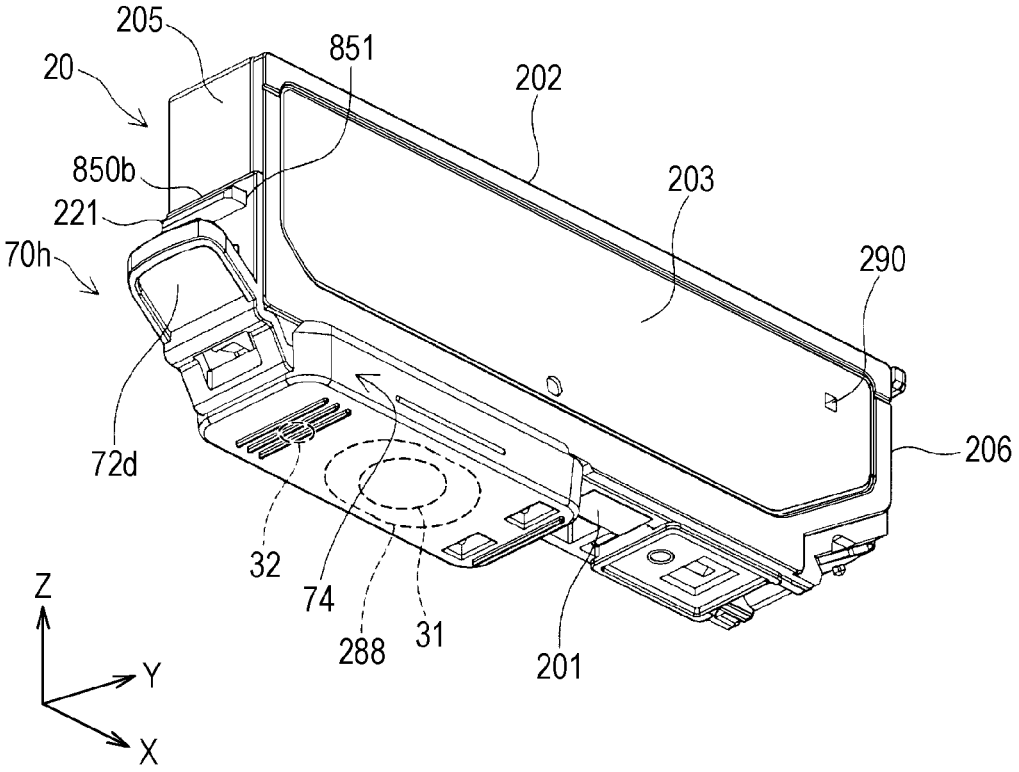
FIG. 40 is a perspective view of a cartridge on which a cap in a seventh embodiment is mounted.
Figure 41:
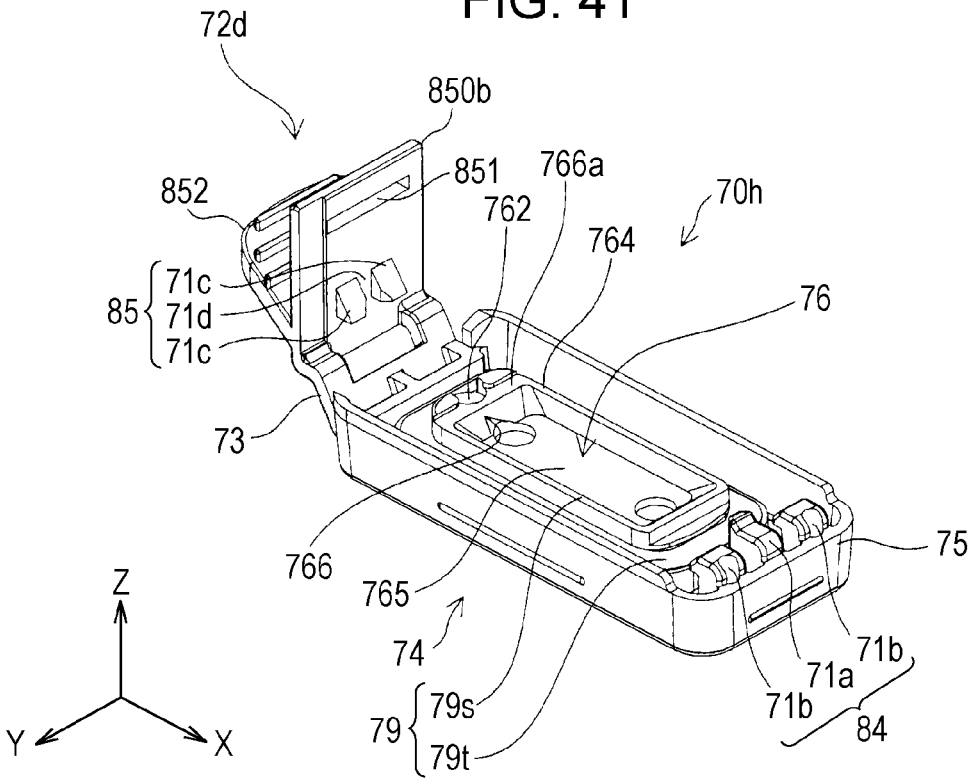
FIG. 41 is a first perspective view of a cap.
Figure 42:
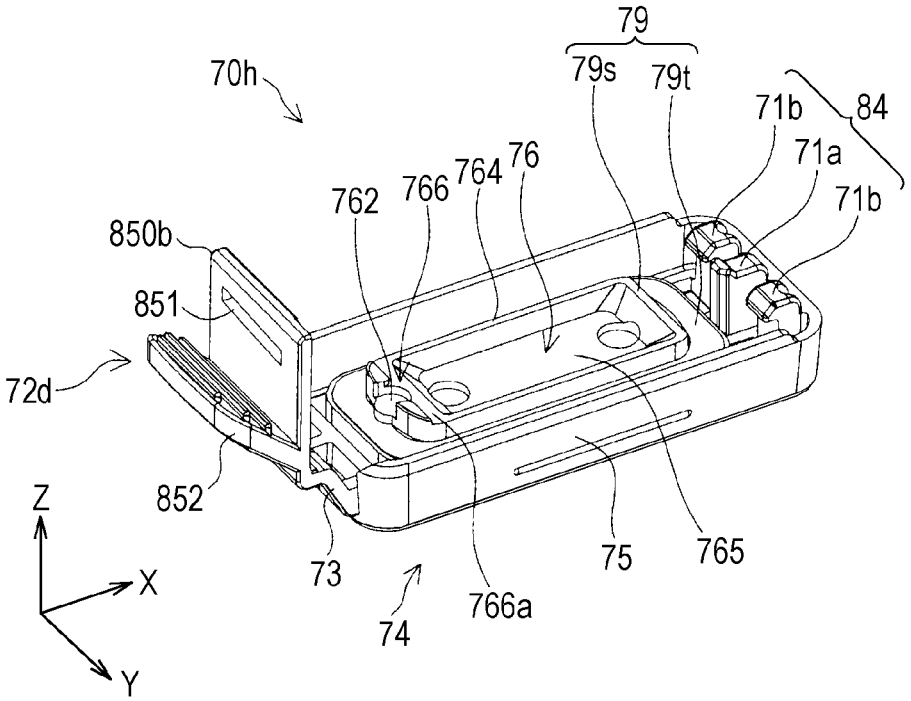
FIG. 42 is a second perspective view of a cap.

FIG. 40 is a perspective view of the cartridge 20 on which a cap 70*h* of a seventh embodiment is mounted. FIG. 41 is a first perspective view of the cap 70*h*. FIG. 42 is a second perspective view of the cap 70*h*.

As illustrated in FIG. 40, the cap 70*h* can be mounted on the cartridge 20 of the seventh embodiment, similarly to the cartridge 20 in the first embodiment. The cartridge 20 of the seventh embodiment has the same configuration as the cartridge 20 of the first embodiment. The cap 70*h* of the seventh embodiment is different from the cap 70 of the first embodiment in that an erected portion 850*b* is provided instead of the erected portion 850. Since other configurations are the same as those of the cap 70 in the first embodiment, the description thereof will not be repeated.

The erected portion 850*b* of the cap 70*h* in the seventh embodiment has a longer length in the +Z axis direction compared to the erected portion 850 of the cap 70 in the first embodiment. As illustrated in FIGS. 41 and 42, the erected portion 850*b* includes an engagement hole 851 in the vicinity of an end portion in the +Z axis direction. The engagement hole 851 is a through hole passing through the erected portion 850*b* in the thickness direction. As illustrated in FIG. 40, in a state where the cap 70*h* is mounted on the cartridge 20, the second locking portion 221 is inserted to the engagement hole 851. The second locking portion 221 is inserted to the engagement hole 851 to be engaged with the engagement hole 851.

G-2. Advantageous Effect

The cap 70*h* of the seventh embodiment has the engagement hole 851, and in a state where the cap 70*h* is mounted on the cartridge 20, the second locking portion 221 of the cartridge 20 is inserted to the engagement hole 851 to be engaged therewith. Therefore, it is possible to closely engage the cap 70*h* with the cartridge 20. In addition, the second locking portion 221 of the cartridge 20 can be shared for use in engaging with the holder 60 and in engaging with the cap 70*h*. For this reason, in the cartridge 20, compared to a configuration where configuration elements used in engaging with the cap 70*h* are prepared in addition to the second locking portion 221 and the second container side engagement portionengagement portion 212, it is possible to simplify the configuration of the cartridge 20 and thereby it is possible to lower the manufacturing cost of the cartridge 20. In addition, regarding that the same configuration as that of the first embodiment is provided, the same advantageous effect as that of the first embodiment is achieved.

Further, although not illustrated, the cap 70*h* of the seventh embodiment described above may be modified to be applicable to the cartridge having a plurality of liquid supply portionliquid supply portions 280. In the seventh embodiment, the second container side engagement portionengagement portion 212 and the second locking portion 221 correspond to a second container side engagement portionengagement portion in claims. In addition, in the seventh embodiment, the second engagement portionengagement portion 85 and the engagement hole 851 correspond to a second cover side engagement portionengagement portion in claims.

H. Eighth Embodiment

Although not illustrated, a cap (a cap in an eighth embodiment) can be mounted on the cartridge 20 of the eighth embodiment, similarly to the cartridge 20 of the first embodiment. The cartridge 20 of the eighth embodiment has the same configuration as the cartridge 20 of the first embodiment. The cap of the eighth embodiment is different from the cap 70 of the first embodiment in that the cap engages with the cartridge 20 in a different section from the first container side engagement portionengagement portion 330, and in that the base portion 75 covers at least a portion from the first container side engagement portionengagement portion 330 in the first surface 201 to the first end portion 201*t*, in addition to the liquid supply portionliquid supply portion 280. Other configurations are the same as those of the cap 70 in the first embodiment.

The cap of the eighth embodiment has a fifth surface side engagement portion and a sixth surface side engagement portion. The fifth surface side engagement portion engages with the fifth surface 205 of the cartridge 20 and for example, can engage with at least any one of the second container side engagement portionengagement portion 212 of the cartridge 20 and the second locking portion 221. The sixth surface side engagement portion engages with the sixth surface 206 of the cartridge 20 and for example, can engage with at least any one of the first locking portion 210 of the sixth surface 206 and the protrusion 211.

The cap of the eighth embodiment having the above-described configuration enjoys the same advantageous effect as the cap 70 of the first embodiment. In addition, the cap of the eighth embodiment covers at least a portion from the first container side engagement portionengagement portion 330 in the first surface 201 to the first end portion 201*t*. A section from the first container side engagement portionengagement portion 330 to the first end portion 201*t* is located vertically below with respect to the air introduction port 290, in a state where the cap 70 is mounted on the cartridge 20 and the cap 70 and the cartridge 20 are placed such that the first surface 201 is located vertically below and the second surface 202 is located vertically above respectively. In a case where the ink leaks out from the air introduction port 290 in such a mounted state, the ink flows along the third surface 203 toward the section from the first container side engagement portionengagement portion 330 to the first end portion 201*t* in the first surface 201. However, since the related section is covered by the cap in the eighth embodiment, it is possible to inhibit the ink from smearing the prism unit 270 (the transmission surface 275). In addition, if the cap of the eighth embodiment is not mounted on the cartridge 20, there is a possibility that the ink leaking out from the air introduction port 290 may reach the first surface 201 and infiltrate into the concave portion 217. In this case, there is a possibility that the ink infiltrating into the concave portion 217 may be solidified (due to the increased viscosity) and may smear the transmission surface 275, and a possibility that the ink may smear the liquid supply tube 640 when the cartridge 20 is mounted on the printer 50. However, if the cap of the eighth embodiment is mounted on the cartridge 20, it is possible to inhibit the ink leaking out of the air introduction port 290 from infiltrating into the concave portion 217. Accordingly, it is possible to inhibit the solidified ink (the thickened ink) from smearing the transmission surface 275 or the liquid supply tube 640. Therefore, it is possible to inhibit an erroneous detection as to whether there is the ink or not and the occurrence of defective ink ejecting.

I. Modification Example

I-1. First Modification Example

In the above-described embodiment, a so-called semi-airtight type of cartridge is exemplified for description, but the invention may be applied to other types of cartridges. For example, the invention is also applicable to a type of cartridge (so-called ink pack) whose liquid containing unit 200 always communicates with the outside or a type of cartridge whose liquid containing unit 200 is always closed in an airtight manner.

I-2. Second Modification Example

In the above-described embodiment, the liquid supply portionliquid supply portion 280 (the opening 288) is covered using the caps 70 and 70*a* to 70*h*, but instead of the caps 70 and 70*a* to 70*h*, the liquid supply portionliquid supply portion 280 may be covered using a sheet shaped member (film). Specifically, it is also possible to cover the liquid supply portionliquid supply portion 280 in such a manner that the sheet member formed of the synthetic resins (for example, materials including nylon and polypropylene) being engaged with the first container side engagement portionengagement portion 330 and covering the liquid supply portionliquid supply portion 280, the first surface 201, the third surface 203, the second surface 202 and the fourth surface 204 are wound around each other. That is, in general, as the cover of the invention, it is possible to employ an arbitrary cover which can engage with the first container side engagement portionengagement portion 330 and cover the liquid supply portionliquid supply portion 280.

I-3. Third Modification Example

Without being limited to an ink jet printer and its ink cartridge, the invention is also applicable to an arbitrary liquid ejecting apparatus and to a cartridge (a liquid container) used in an arbitrary liquid ejecting apparatus consuming other liquids except for the ink. For example, the invention is applicable to cartridges used in various types of liquid ejecting apparatus as follows.

(1) An image recording apparatus such as a facsimile machine
(2) A color material ejecting apparatus used in manufacturing color filters for an image display apparatus such as a liquid crystal display
(3) An electrode material ejecting apparatus used in forming electrodes of an organic Electro Luminescence (EL) display or a Field Emission Display (FED)
(4) A liquid ejecting apparatus ejecting liquids including living body organic compound used in manufacturing biochips
(5) A sample ejecting apparatus as a precision pipette
(6) A lubricant ejecting apparatus
(7) A resin liquid ejecting apparatus
(8) A liquid ejecting apparatus ejecting lubricant, using a pinpoint, onto precision instruments such as timepieces and cameras
(9) A liquid ejecting apparatus ejecting transparent resin liquid such as UV curable resin liquid onto a substrate in order to form micro-hemisphere lenses (optical lenses) used in optical communication elements
(10) A liquid ejecting apparatus ejecting acid or alkaline etching liquid for etching substrates
(11) A liquid ejecting apparatus including a liquid consumption head ejecting other arbitrary minute quantity of droplets Further, the "droplets" mean a state of the liquid ejected from the liquid ejecting apparatus includes granular shapes, tears shapes and thread shapes which leave a trail. In addition, the "liquid" here may be a material consumable for the liquid ejecting apparatus. For example, the "liquid" may be materials in a state where the substance is liquefied, and also includes materials in a state of high or low viscous liquid state and materials in a liquid state such as sol, gel water, other inorganic solvent, organic solvent, solution, liquid state resin and liquid state metal (metallic melt). In addition, the "liquid"

includes not only the liquid as one state of the substance, but also those which particles of functional materials consisting of solid bodies such as pigments and metallic particles are dissolved in a solvent, dispersed and mixed. In addition, representative examples of the liquid include the ink described above in the embodiments and the liquid crystal. Here, the ink includes various liquid compositions such as water-based color ink, oil-based ink, gel ink and hot-melt ink.

I-4. Fourth Modification Example

In the above-described embodiments and modification examples, the cartridges 20 and 20*a*, the caps 70 and 70*a* to 70*h* have been described as a separate body, but the cartridges 20 and 20*a* may be regarded as including the caps 70 and 70*a* to 70*h*. That is, the liquid container on which the cover of the invention is mounted may be regarded as a liquid container.

I-5. Fifth Modification Example

In the above-described embodiments, a section containing the ink is the liquid containing unit 200 inside the cartridges 20 and 20*a*, but the invention is not limited thereto. For example, the cartridges 20 and 20*a* may not be provided with the liquid containing unit 200 and may be configured such that the liquid containing unit is disposed inside an ink supply unit which can be mounted on the cartridges 20 and 20*a*. In this configuration, the ink may be supplied from the liquid containing unit to the liquid supply portionliquid supply portion 280 by allowing the liquid containing unit inside the ink supply unit to communicate with the liquid supply portionliquid supply portion 280.

In the above-described embodiments and modification examples, the expression such as "being in contact with", "coming into contact with" and "bringing into contact with" not only represent that one is in contact with the other, one comes into contact with the other or one is brought into contact with the other, but also represents a broad concept including a state where one simply covers the other without being in contact with each other. That is, it represents a concept including a function which can be realized by sealing and coming into contact, specifically, a state where any function can be provided which decreases a possibility that the liquid may be scattered.

The invention, without being limited to the above-described embodiments and the modification examples, may be realized by various configurations in the range without departing from the spirit thereof. For example, technical features in the embodiments and modification examples corresponding to the technical features in the embodiments described in the summary of the invention may be appropriately replaced or combined in order to partially or entirely achieve the above-described advantageous effect. In addition, if not described as essential in the description, the technical features may be appropriately deleted.

What is claimed is:

1. A cover configured to be attached to a liquid container which is configured to be mounted on a liquid ejecting apparatus, the liquid container including:

a first surface having a liquid communication port, configured to supply the liquid from the liquid container to the liquid ejecting apparatus, a wall surrounding the liquid communication port, and a container side attachment portion;

a second surface opposite to the first surface, the wall protruding in a direction from the second surface toward the first surface;

a third surface intersecting the first surface and the second surface;

a fourth surface intersecting the first surface and the second surface and opposite to the third surface;

a fifth surface intersecting the first surface, the second surface, the third surface, and the fourth surface; and a sixth surface intersecting the first surface, the second surface, the third surface, and the fourth surface, and opposite to the fifth surface, the fifth surface having a rib, the container side attachment portion located between the wall and the sixth surface in a planer view from a direction extending from the first surface toward the second surface of the liquid container when the cover is attached to the liquid container, the cover comprising:

an elastic member having an arrangement member configured to be contacted with the wall when the cover is attached to the liquid container;

a base portion on which the elastic member is located, the base portion having a first engagement portion configured to be engaged with the container side attachment portion of the liquid container when the cover is attached to the liquid container;

an erected portion intersecting the base portion, the erected portion having a second engagement portion configured to be engaged with the rib of the liquid container when the cover is attached to the liquid container; and a lever connected to the erected portion, the second engagement portion of the erected portion located between the lever and the first engagement portion in a planer view from a direction extending from the first surface toward the second surface of the liquid container when the cover is attached to the liquid container.

2. The cover according to claim 1, wherein the second engagement portion defining a hole configured to receive the rib of the liquid container when the cover is attached to the liquid container.

3. The cover according to claim 2, wherein the first engagement portion has a protrusion configured to engage the container side attachment portion of the liquid container when the cover is attached to the liquid container.

4. The cover according to claim 2, wherein the first engagement portion has two protrusions configured to engage the container side attachment portion of the liquid container when the cover is attached to the liquid container, and an insertion piece is located between the two protrusions.

5. The cover according to claim 2, wherein the elastic member comprises an elastomer, and the base portion comprises polypropylene.

6. The cover according to claim 2, wherein the elastic member further comprises an acceptance portion surrounded by the arrangement member, the acceptance portion configured to face the liquid communication port when the cover is attached to the liquid container.

7. A cartridge system comprising:

a) a liquid container configured to be mounted on a liquid ejecting apparatus, the liquid container including:

a first surface having a liquid communication port configured to supply the liquid from the liquid container to the liquid ejecting apparatus, a wall surrounding the liquid communication port, and a container side attachment portion;

a second surface opposite to the first surface, the wall protruding in a direction from the second surface toward the first surface;

a third surface intersecting the first surface and the second surface;

a fourth surface intersecting the first surface and the second surface and opposite to the third surface;

a fifth surface intersecting the first surface, the second surface, the third surface, and the fourth surface; and a sixth surface intersecting the first surface, the second surface, the third surface, and the fourth surface, and opposite to the fifth surface, the fifth surface having a rib;

the container side attachment portion located between the wall and the sixth surface in a planer view from a direction extending from the first surface toward the second surface of the liquid container when the cover is attached to the liquid container; and b) a cover attached to the liquid container, the cover including:

an elastic member having an arrangement member configured to be contacted with the wall when the cover is attached to the liquid container, a base portion on which the elastic member is located, the base portion having a first engagement portion engaged with the container side attachment portion of the liquid container;

an erected portion intersecting the base portion, the erected portion having a second engagement portion engaged with the rib of the liquid container; and a lever connected to the erected portion, the second engagement portion of the erected portion being located between the lever and the first engagement portion of the base portion in a planer view from a direction extending from the first surface toward the second surface of the liquid container.

8. The cartridge system according to claim 7, wherein the second engagement portion defines a hole that is engaged with the rib of the liquid container.

9. The cartridge system according to claim 8, wherein the first engagement portion has a protrusion engaged with the container side attachment portion of the liquid container.

10. The cartridge system according to claim 8, wherein the first engagement portion has two protrusions engaged with the container side attachment portion of the liquid container, and an insertion piece is located between the two protrusions.

11. The cartridge system according to claim 8, wherein the elastic member comprises an elastomer, and the base portion comprises polypropylene.

12. The cartridge system according to claim 8, wherein the elastic member further comprises an acceptance portion surrounded by the arrangement member and is configured to face the liquid communication port when the cover is attached to the liquid container.

13. A cover configured to be attached to a liquid container which is configured to be mounted on a liquid ejecting apparatus, the liquid container including:

a first surface having a liquid communication port configured to supply the liquid from the liquid container to the liquid ejecting apparatus and an air communication port configured to introduce air into the liquid container, a wall surrounding the liquid communication port, and a container side attachment portion;

a second surface opposite to the first surface, the liquid communication port protruding in a direction from the second surface toward the first surface;

a third surface intersecting the first surface and the second surface;

a fourth surface intersecting the first surface and the second surface and opposite to the third surface;

a fifth surface intersecting the first surface, the second surface, the third surface, and the fourth surface; and a sixth surface intersecting the first surface, the second surface, the third surface, and the fourth surface, and opposite to the fifth surface;

the fifth surface having a rib, the container side attachment portion located between the wall and the sixth surface in a planer view from a direction extending from the first surface toward the second surface of the liquid container when the cover is attached to the liquid container, the cover comprising:

an elastic member having an arrangement member configured to be contacted with the wall when the cover is attached to the liquid container, and a sealing portion configured to seal the air communication port when the cover is attached to the liquid container;

a base portion on which the elastic member is located, the base portion having a first engagement portion configured to engage the container side attachment portion of the liquid container;

an erected portion intersecting the base portion, the erected portion having a second engagement portion configured to be engaged with the rib of the second container side attachment portion of the liquid container when the cover is attached to the liquid container, and a lever connected to the erected portion, the second engagement portion of the erected portion being located between the lever and the first engagement portion of the base portion in a planer view from a direction extending from the first surface toward the second surface of the liquid container when the cover is attached to the liquid container.

14. The cover according to claim 13, wherein the second engagement portion defines a hole configured to receive the rib of the liquid container when the cover is attached to the liquid container.

15. The cover according to claim 14, wherein the first engagement portion has a protrusion configured to be engaged with the container side attachment portion of the liquid container when the cover is attached to the liquid container.

16. The cover according to claim 14, wherein the first engagement portion has two protrusions configured to be engaged with the container side attachment portion of the liquid container when the cover is attached to the liquid container, and an insertion piece located between the two protrusions.

17. The cover according to claim 14, wherein the elastic member comprises an elastomer, and the base portion comprises polypropylene.

18. The cover according to claim 14, wherein the elastic member further includes an acceptance portion surrounded by the arrangement member, the acceptance portion configured to face the liquid communication port when the cover is attached to the liquid container.

19. A cartridge system comprising:

a) a liquid container configured to be mounted on a liquid ejecting apparatus, the liquid container including:

a first surface having a liquid communication port configured to supply the liquid from the liquid container to the liquid ejecting apparatus, an air communication port configured to introduce air into the liquid container, a wall portion surrounding the liquid communication port, and a container side attachment portion;

a second surface opposite to the first surface, the liquid supply portion protruding in a direction from the second surface toward the first surface;

a third surface intersecting the first surface and the second surface;

a fourth surface intersecting the first surface and the second surface and opposite to the third surface;

a fifth surface intersecting the first surface, the second surface, the third surface, and the fourth surface; and a sixth surface intersecting the first surface, the second surface, the third surface, and the fourth surface, and opposite to the fifth surface, the fifth surface having a rib, and the container side attachment portion located between the wall and the sixth surface in a planer view from a direction extending from the first surface toward the second surface of the liquid container; and b) a cover attached to the liquid container, the cover including:

an elastic member having an arrangement member configured to be contacted with the wall when the cover is attached to the liquid container, and a sealing portion configured to seal the air communication port when the cover is attached to the liquid container;

a base portion on which the elastic member is located, the base portion having a first engagement portion engaged with the container side attachment portion of the liquid container;

an erected portion intersecting the base portion, the erected portion having a second engagement portion being engaged with the rib of the second container side attachment portion of the liquid container; and a lever connected to the erected portion, the second engagement portion of the erected portion being located between the lever and the first engagement portion of the base portion in a planer view from a direction extending from the first surface toward the second surface of the liquid container.

20. The cartridge system according to claim 19, wherein the second engagement portion defines a hole engaged with the rib of the liquid container.

21. The cartridge system according to claim 20, wherein the first engagement portion has a protrusion engaged with the container side attachment portion of the liquid container.

22. The cartridge system according to claim 20, wherein the first engagement portion has two protrusions engaged with the container side attachment portion of the liquid container, and an insertion piece is located between the two protrusions.

23. The cartridge system according to claim 20, wherein the elastic member comprises an elastomer, and the base portion comprises polypropylene.

24. The cartridge system according to claim 20, wherein the elastic member further comprises an acceptance portion surrounded by the arrangement member, the acceptance portion configured to face the liquid communication port when the cover is attached to the liquid container.

* * * * *